United States Patent [19]

Tsutsumi et al.

[11] Patent Number: 4,660,617

[45] Date of Patent: Apr. 28, 1987

[54] METHOD OF CHANGING WIDTH OF SLAB IN CONTINUOUS CASTING

[75] Inventors: Kazuhiko Tsutsumi; Wataru Ohashi; Takeyoshi Ninomiya; Masami Temma, all of Sakai, Japan

[73] Assignee: Nippon Steel Corporation, Tokyo, Japan

[21] Appl. No.: 783,589

[22] Filed: Oct. 3, 1985

[30] Foreign Application Priority Data

| | | | |
|---|---|---|---|
| Nov. 9, 1984 | [JP] | Japan | 59-236474 |
| Dec. 10, 1984 | [JP] | Japan | 59-260381 |
| Dec. 17, 1984 | [JP] | Japan | 59-265905 |
| May 21, 1985 | [JP] | Japan | 60-109508 |
| May 21, 1985 | [JP] | Japan | 60-109509 |

[51] Int. Cl.[4] ..... B22D 11/16

[52] U.S. Cl. ..... 164/451; 164/491

[58] Field of Search ..... 164/491, 436, 451, 452

[56] References Cited

U.S. PATENT DOCUMENTS

| | | | |
|---|---|---|---|
| 4,356,862 | 11/1982 | Gloor | 164/491 |
| 4,413,667 | 11/1983 | Schrewe et al. | 164/452 |
| 4,465,122 | 8/1984 | Ohya | 164/491 |

*Primary Examiner*—Nicholas P. Godici
*Assistant Examiner*—Samuel M. Heinrich
*Attorney, Agent, or Firm*—Pollock, Vande Sande & Priddy

[57] ABSTRACT

A width changing method in which the width of a slab under casting is changed by a movement of narrow face of a continuous casting mold by the operation of a horizontal driving device and a rotary driving device operable independently of the horizontal driving device. The period of width changing operation is divided into a forward taper changing period in which each narrow face is inclined toward the center of the mold and a rearward taper changing period in which each mold wall is inclined away from the center of the mold. The acceleration of the horizontal movement of each narrow face is determined by means of allowable shell deformation resistance as a parameter for each period. Also is determined the angular velocity of the rotary device or the difference in velocity between the upper and lower ends of the narrow face. The width changing operation is conducted while maintaining the acceleration and the angular velocity or the velocity difference at constant levels in respective periods.

8 Claims, 58 Drawing Figures

FIG. 20
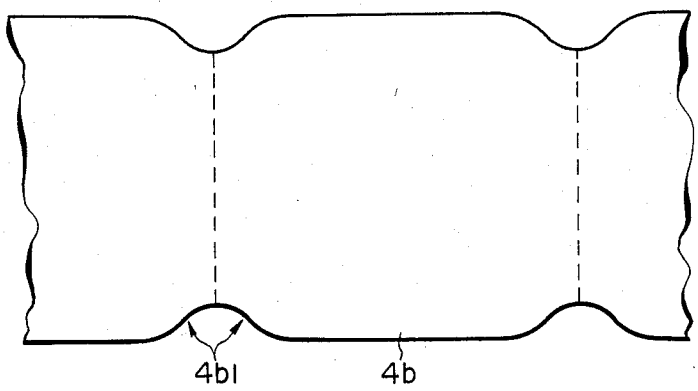
FIG. 21A
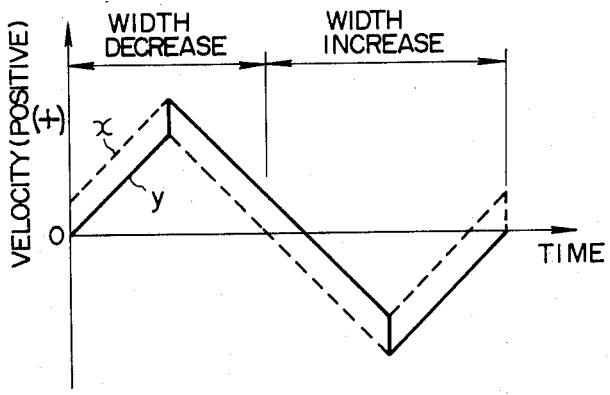
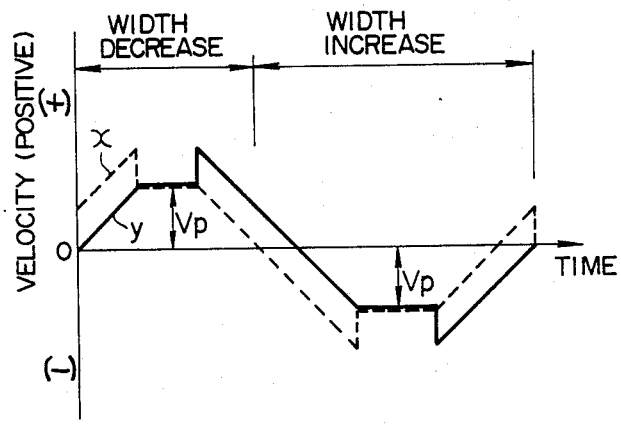
FIG. 21B

METHOD OF CHANGING WIDTH OF SLAB IN CONTINUOUS CASTING

BACKGROUND OF THE INVENTION

The present invention relates to a method changing the width of a slab which is being cast by a continuous casting machine and, more particularly, to a method in which narrow face of a continuous casting machine are moved to such as to increase or decrease the width of the slab which is being cast by the continuous casting machine.

In the field of continuous casting, particularly continuous casting of steel, there is an increasing demand for improvement in the rate of operation, as well as in the yield of the cast product. To meet these demands, continuous casting methods have been proposed and carried out in which the width of the slab which is being cast by a continuous casting machine is changed without requiring suspension of pouring of the molten metal into the mold.

On the other hand, there is a current trend that continuous casting is directly followed by rolling. This in turn gives a rise to the demand for techniques for varying the width of the cast slab in accordance with the width of the product web to be obtained while the slab is being cast continuously. In changing the width of the slab under casting without stopping the continuous casting machine, it is quite important that the length of the transient region over which the width is varied is minimized, i.e., that the aimed width is attained without delay. This in turn requires a technique which enables a quick change of the slab width.

The continuous casting machine having a width changing function is usually conducted by means of a composite casting mold which is composed of two broad face and two narrow face which are movable in the longitudinal direction of the broad face. The slab width is varied by moving the narrow face towards or away from the center of the mold by a suitable means. A quick change of slab width by this method, however, encounters various problems such as an increase in the power for driving the narrow face and generation of defect. For this reason, it has been difficult to attain a higher speed of width changing with the use of the mold of the type explained.

Typical conventional methods for changing the slab widths have been disclosed in Japanese Patent Laid-Open No. 60326/1978 and Japanese Patent Publication No. 33772/1969.

On the other hand, Japanese Patent Laid-Open No. 74354/1981 discloses a method for varying the dimensions of a strand in continuous casting while casting is proceeding, wherein, during at least a portion of the time in which the pivoting movement of the mold wall takes place, the relationship between the displacement speeds of two movement-imparting device arranged above and below the narrow face is altered, and the position of the pivot axis is displaced parallel to its initial position.

The present applicant also developed methods in which the upper and lower ends of the narrow face are moved simultaneously such as to shorten the time required for the change of the width, and has proposed these methods in Japanese Patent Application Nos. 184103/1982 and 143157/1983. These methods, however, make use of translational movement of the narrow face. The methods proposed by Japanese Patent Laid-Open No. 74354/1981 and Japanese Patent Application Nos. 184103/1982 and 143157/1983 could not appreciably shorten the time required for one full cycle of width changing operation, although these methods are effective in shortening the time till the translational movement is commenced.

SUMMARY OF THE INVENTION

Accordingly, it is a primary object of the invention to improve the methods disclosed in Japanese Patent Application Nos. 184103/1982 and 143157/1983 in such a way as to remarkably shorten the time required for the increase or decrease of the slab width during continuous casting so as to the yield and allowing a stable operation without any fear of casting defects such as break out and cracking, thereby overcoming the abovedescribed problems of the prior art.

Another object of the invention is to provide a method which permits a quick change of the slab width and elimination of casting defect and, at the same time, fulfills the conditions for the rolling, as well as requirements from the shorter wall driving systems, while enabling a stable continuous casting operation.

Still another object of the invention is to provide a method in which any error from the command width changing amount which is caused by the difference between the amount of taper before the commencement of the width changing operation and that after completion of the operation is effectively absorbed in the course of changing of the width, thereby allowing a precise control of the slab width.

A further object of the invention is to provide a continuous casting mold which permits an increase or decrease of the slab width in the minimal time, without causing any casting defect in the product.

A still further object of the invention is to provide a method which employs a casting mold of the type having a horizontal driving means and a rotary driving means capable of operating independently of the horizontal driving means, wherein the time required for an increase or decrease of the billet width is minimized such as to reduce the length of the transient region, thereby improving the yield and allowing a stable casting operation without risk of generation of casting defect.

BRIEF DESCRIPTION OF THE DRAWINGS

FIG. 20 is a plan view of a slab having restricted leading and trailing ends;

FIGS. 21A and 21B are diagrams showing the velocities of movement of the upper and lower ends of the narrow face in accordance with a width changing method for producing the slab with restricted ends as shown in FIG. 20;

DESCRIPTION OF THE PREFERRED EMBODIMENT

Figure 2:
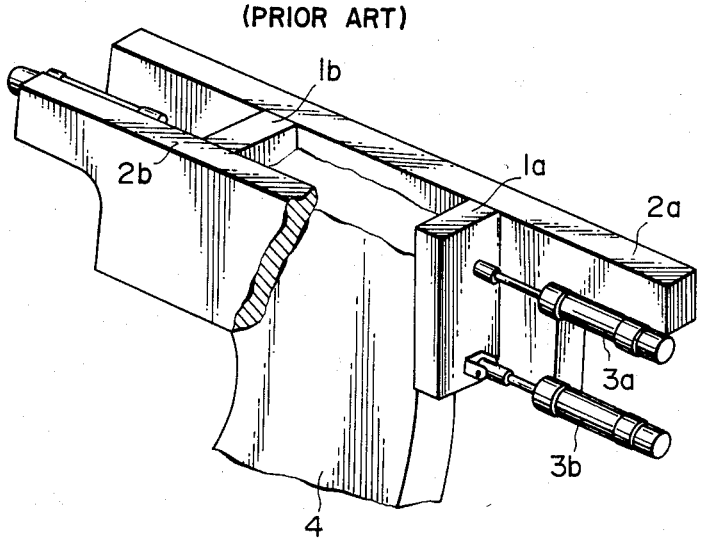
FIG. 2 (PRIOR ART)
FIG. 2 is a perspective view of a known variable-width type casting mold.

FIG. 2 schematically shows an example of known width changing system of the type having narrow face movable along stationary broad face. More specifically, a pair of narrow faces 1*a*, 1*b* are clamped between a pair of broad faces 2*a*, 2*b* which are secured to a mold oscillation table (not shown). Driving means 3*a* and 3*b* such as electro hydrualic driving units are connected to the narrow faces 1*a*, 1*b* such as to drive these walls towards and away from each other, thereby changing the width of a slab 4 which is being cast continuously.

FIGS. 3A to 3C and FIGS. 4A to 4C, respectively, show the manners of decremental and incremental width change operations. Namely, for decreasing the width of the slab, each narrow face 1 is pivotally moved to a position shown by broken line a in a first step shown in FIG. 3A. In the next step shown in FIG. 3B, the narrow face is moved translationally to a position shown by broken line a. Finally, the narrow face is pivotally moved to resume the initial inclination of taper as shown by broken line a in the final step shown in FIG. 3C. On the other hand, for increasing the width of the slab, the narrow face is pivotally moved to a position shown by broken line a in the first step and then moved translationally to the position shown by broken line a in the next step shown in FIG. 4B. Finally, in the step shown in FIG. 4C, the narrow face 1 is pivotally moved to reduce the inclination as shown by broken line a.

Figures 3A, 3B, 3C:
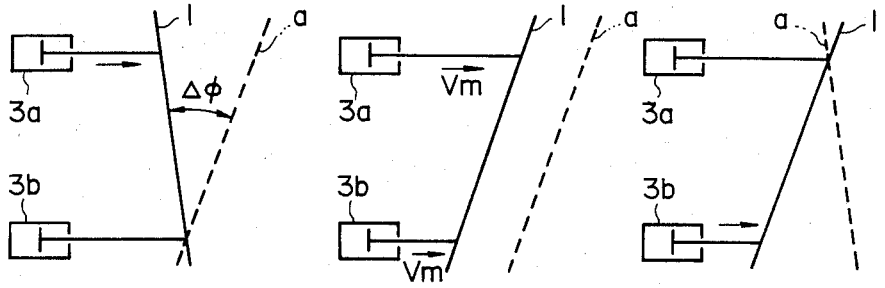
FIG. 3A (PRIOR ART) FIG. 3B (PRIOR ART) FIG. 3C (PRIOR ART)
FIGS. 3A to 3C are schematic illustrations of a known process for decreasing the slab width during continuous casting.
Figures 4A, 4B, 4C:
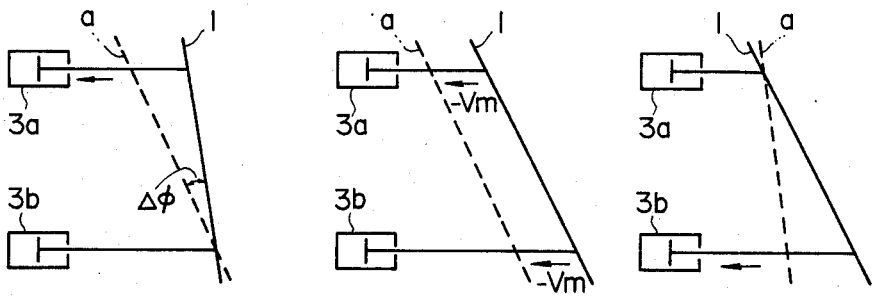
FIG. 4A (PRIOR ART) FIG. 4B (PRIOR ART) FIG. 4C (PRIOR ART)
FIGS. 4A to 4C are illustrations of a known process for increasing the slab width during continuous casting.

Thus, the taper changing actions as shown in FIG. 3A and 3C, as well as in FIGS. 4A and 4C, are conducted perfectly independently of the translational actions shown in FIGS. 3B and 4B. In this conventional operation, an impractically long time is required for the taper changing actions, so that the length of the transient region of slab over which the width is changed is inevitably long even though the velocity Vm of the translational movement is increased, resulting in a low yield.

Various methods have been proposed for increasing the velocity Vm of translational movement, in order to shorten the length of the transient region of the slab. For attaining a higher velocity Vm of translational movement overcoming the deformation resistance produced by the solidified shell without breaking the shell, it is necessary to increase the taper changing angle $\Delta\phi$. This in turns allows a formation of air gap between the narrow face 1 and the slab 4, resulting in various problems such as a cracking in the slab 4 an break out of the same. Consequently, there is a practical limit in the increase of the translational movement velocity Vm and, hence, in the shortening of the time required for the width changing operation.

In order to overcome the above-described problem, Japanese Patent Laid-Open No. 74354/1981 discloses a method in which the change of taper of the narrow face is conducted in a shorter time by moving both the upper and lower ends of the wall simultaneously. This width changing method, however, still requires the translational movement of the narrow face after the change of the taper. Since the time-consuming translational movement is essential, this method cannot remarkably shorten the time required for completion of the width changing operation. In addition, this method cannot provide a constant strain rate of slab which will be explained later, and causes a fluctuation in the thrust required for the driving system, resulting in an inefficient use of the power of the driving unit such as a cylinder.

Figure 1A:
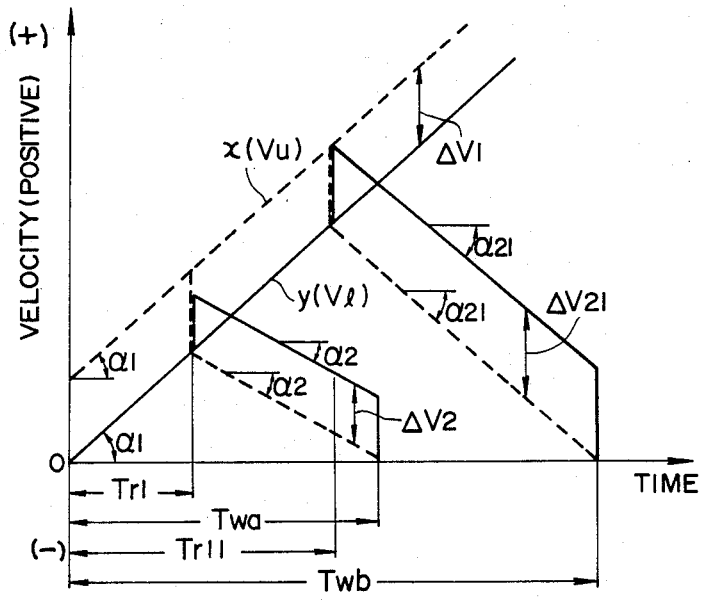
FIGS. 1A and 1B are diagrams showing the velocities of movement of the upper and lower ends of narrow face of a mold when the width of the slab is being changed in accordance with the method of the invention.
Figure 1B:
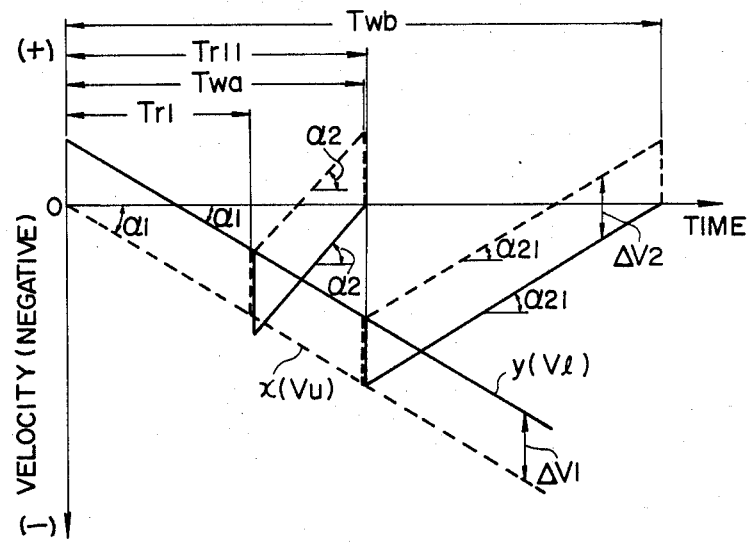

FIGS. 1A and 1B are diagrams illustrating the velocities of horizontal movement (referred to as "moving velocities", hereinunder) of the upper and lower ends of the narrow face during decremental and incremental width changing operations, respectively. The movement towards the center of the mold is expressed by a plus sign (+), while a minus sign (−) is used to represent a movement away from the center of the mold. In this Figure, a broken line curve x represents the moving velocity of the upper end of narrow face corresponding to the meniscus in the mold expressed by Vu, while a full line curve y represents the moving velocity of the lower end of the narrow face expressed by Vl. For decreasing the slab width, the narrow face as a whole is moved towards the center of the mold. In the earlier half period of this operation, the upper end of the narrow face is moved towards the center of the mold relatively to the lower end of the narrow face such that the narrow face is inclined forwardly. Then, in the later half period of the operation, the narrow face is moved such that the upper end thereof is moved relatively to the lower end seemingly apart from the mold center, thus attaining a rearward inclination of the narrow face. Each of FIGS. 1A and 1B show two different patterns of width changing operation. The command width changing amounts are expressed in terms of width changing times TWa and TWb, and the timing of change of the posture of narrow face from the forward inclination to the rearward inclination are expressed by $Tr_I$ and $Tr_{II}$.

Figure 5:
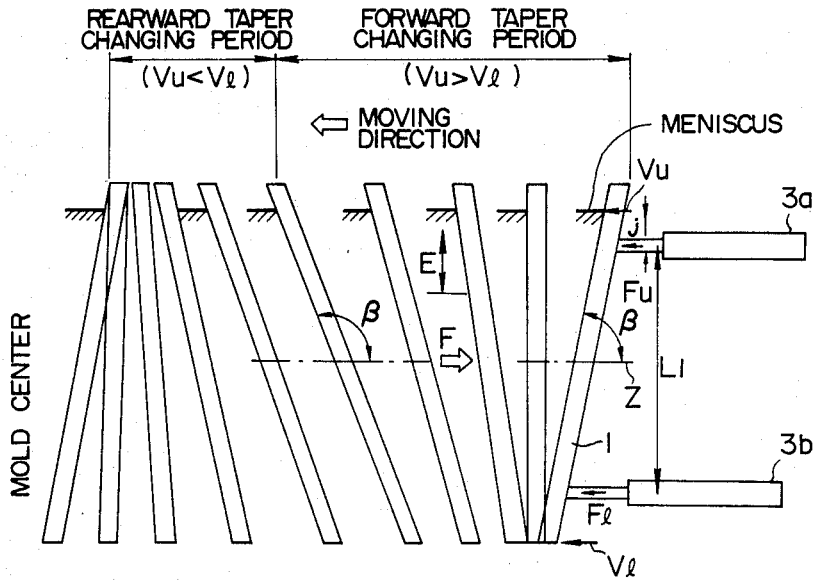
FIG. 5 is a schematic illustration of the movement of the narrow face for decreasing the slab with in accordance with a method of the invention.

FIG. 5 schematically shows the movement of the narrow face for reducing the slab width. In the earlier half period in which the narrow face is inclined forwardly, the moving velocity Vu of the upper end of the narrow face is maintained higher than the moving velocity Vl of the lower end by a constant value, so that the angle $\beta$ of the narrow face 1 with respect to the horizontal line Z and, hence, the amount of forward inclination are progressively increased. Conversely, in the later half period of the operation, the moving velocity Vl of lower end of the moving wall plate is maintained higher than the moving velocity Vu of the upper end of the same, so that the angle $\beta$ of inclination and, hence, the amounts of forward inclination are progressively decreased. In this specification, the period in which the forward inclination $\beta$is progressively increased, i.e., the period in which the narrow face is progressively inclined towards the center of the mold, will be referred to as "forward taper changing period", while the period in which the angle $\beta$ is progressively decreased, i.e., the period in which the narrow face is progressively inclined apart from the center of the mold, will be referred to as "rearward taper changing period".

The moving velocities Vu and Vl of the upper and lower ends of the narrow face have a constant acceleration $\alpha$ both in the earlier and rearward taper changing periods. In the forward taper changing period, the acceleration $\alpha$ is positive such as to cause a progressive increase of the amount of forward inclination, whereas, in the rearward taper changing period, the acceleration $\alpha$ is negative such as to progressively increase the rearward inclination. The negative acceleration $\alpha$ in the rearward taper changing period can be regarded as being deceleration. In this specification, however, the acceleration in both direction are generally expressed as acceleration with the positive and negative signs (+) and (−), respectively. Thus, in the earlier and rearward taper changing periods, the amounts of foreward and rearward tapering are increased as the time lapses.

Referring to FIG. 1A, the acceleration and the difference between the moving velocities Vu and Vl at both face ends in the forward taper changing period are expressed by $\alpha_1$ and $\Delta V_1$, respectively, whereas the accelerations and the velocity difference in the rearward taper changing period are expressed by $\alpha_2$, $\alpha_{21}$ and $\Delta V_2$, $\Delta V_{21}$, respectively.

Figure 6:
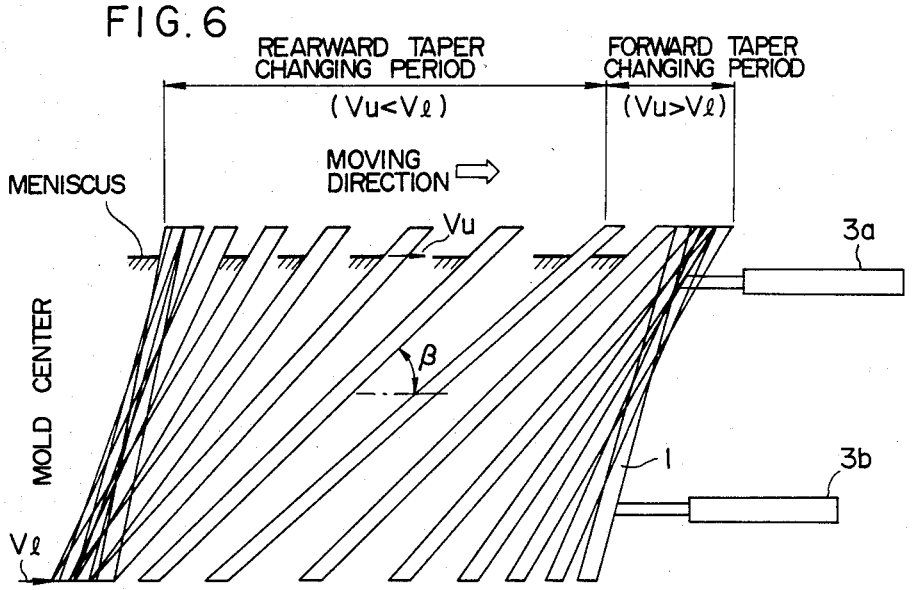
FIG. 6 is a schematic illustration of the movement of narrow face for increasing the slab width in accordance with the method of the invention.

The width changing operation for increasing the width of the slab under casting will be explained hereinunder with reference to FIG. 1B and also with FIG. 6 which is a schematic illustration. The incremental width changing operation is conducted by moving the narrow face away from the center of the mold. In the earlier half period, the moving velocity Vl at the lower end of the narrow face is maintained higher than the moving velocity Vu at the upper end of the same by a constant value such as to cause a rearward inclination of the narrow face. After a travel over a predetermined distance, the operation is switched without delay such that the moving velocity Vu at the upper end of the narrow face is maintained higher than the moving velocity Vl of the lower end of the same, thereby increasing the forward inclination of the narrow face.

The moving velocities Vu and Vl of the upper and lower ends of the narrow face have a constant acceleration Δ also in this case.

According to the invention, the acceleration $\alpha$ is suitably selected in accordance with the factors such as steel grade, size of the slab, casting speed, and so forth. At the same time, the difference of the moving velocity ΔV is determined in accordance with the following formula (1).

$$\Delta V = \alpha \cdot L / Uc \quad (1)$$

where,

ΔV: difference of moving velocity between upper and lower ends of narrow face (mm/min)

$\alpha$: acceleration of upper and lower ends of narrow face (mm/min$^2$)

L: length of narrow face (mm)

Uc: casting speed (mm/min)

According to the invention, various advantages effects are produced as will be explained later, by maintaining this velocity difference constant both in the forward and rearward taper changing periods.

Figure 7:
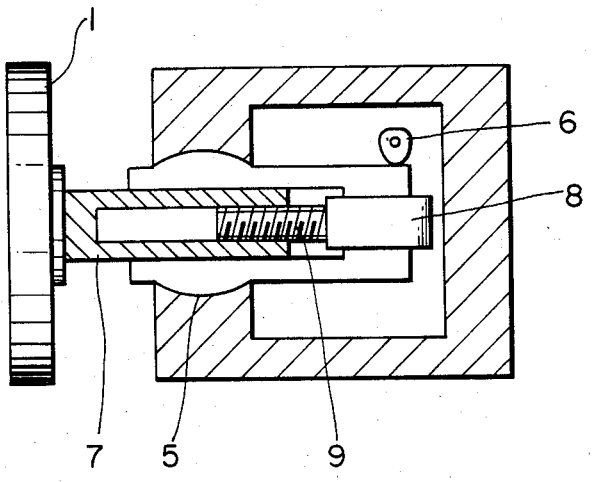
FIG. 7 (PRIOR ART)
FIG. 7 is a sectional view of another example of the driving means in a known variable-width type casting mold.

Various types of driving equipment can be used as well as that shown in FIG. 2. FIG. 7 exemplarily shows a known driving device which has a single spindle 7 connected to the back side of the narrow face 1. The spindle 7 is movable horizontally and is rockable on a spherical seat 5 by the action of a cam mechanism 6. With this arrangement, it is possible to simultaneously effect both horizontal and rotational movements of the spindle 1. In FIG. 7, a reference numeral 8 denotes an electric motor adapted to drive the spindle 7 thorugh a screw shaft 9.

According to the invention, an efficient width change can be attained by using the acceleration Δ and the velocity difference ΔV as the controlling factors, for the reasons which will be explained hereinunder.

As explained before, the speed-up of the width changing operation has to be conducted in due consideration for avoiding any break out of the slab during casting, as well as generation of casting defects in the slab. To this end, it is essential to maintain a moderate pressing force such as to avoid generation of air gap between the slab and the narrow face and also to avoid any excessive pressing of the slab by the narrow face. FIG. 8 illustrates the condition for generation of air gap in relation to the movement of the narrow face. In this Figure, Xu and Xl represent the displacements of the upper and lower ends of the narrow face in relation to the time t after the commencement of the width changing operation. A symbol $\beta$ represents the angle of inclination of the narrow face with respect to the horizontal line z, while $\theta$ represents the inclination angle of the same with respect to a vertical line. Thus, the angle $\theta$ is given as $\theta = \beta - 90°$.

The displacement of the upper and lower ends of the narrow face in a unit time dt are expressed by dXu and dXl, respectively, while the casting speed is expressed by Uc. Thus, the slab moves downwardly by a distance [Uc·dt] in the unit time dt. Thus, the amount of deformation of the slab caused by the pressing in the unit time is given as the difference between the displacement or travel of the slab and a value which is expressed by Uc·dt·tan $\theta$. The amounts of deformation at the upper and lower ends of the narrow face are expressed by dλu and dλl, respectively, and are given by the following formulae (7) and (8).

$$d\lambda u = dXu - Uc \cdot dt \cdot \tan\theta \quad (7)$$

$$d\lambda l = dXl - Uc \cdot dt \cdot \tan\theta \quad (8)$$

Figure 8A:
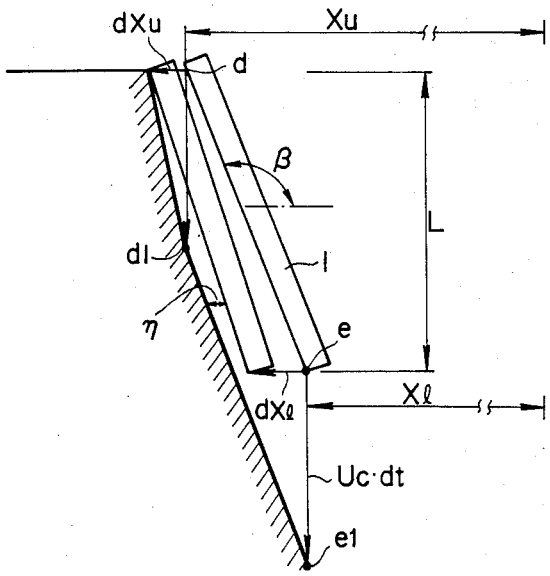
FIGS. 8A and 8B are illustrations of concepts of movement of the narrow face and the condition for generation of air gaps.
Figure 8B:
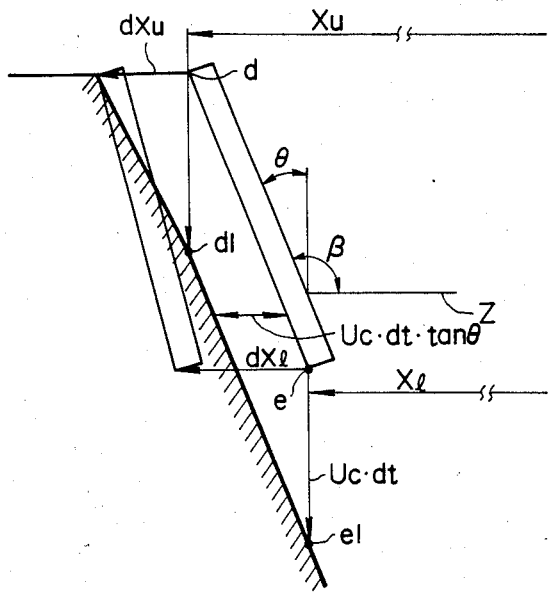

If the displacement of the narrow face is smaller than the value expressed by (Uc·dt·tan $\theta$), the narrow face cannot follow up the slab so that an air gap $\eta$ is formed as shown in FIG. 8A. For these reasons, the amounts of deformation dλu and dλl have to be positive (+). The rate of deformation, i.e., the amounts of deformation per unit time, are obtained by dividing the formulae (7) and (8) by dt as follows.

$$d\lambda u/dt = dXu/dt - Uc \cdot \tan\theta \quad (9)$$

$$d\lambda l/dt = dXl/dt - Uc \cdot \tan\theta \quad (10)$$

On condition of t=0, the value tan $\theta$ is given as follows, because of condition of Xu=X=0.

$$\tan\theta = (Xu - Xl)/L \quad (11)$$

Since the values dXu/dt and dXl/dt represent the velocities Vu and Vl at the upper and lower ends, the formulae (9) and (10) are given by the following formulae (12) and (13), respectively.

$$d\lambda u/dt = Vu - Vc \cdot (Xu - Xl)/L \quad (12)$$

$$d\lambda l/dt = Vl - Uc \cdot (Xu - Xl)/L \quad (13)$$

Representing the whole slab width by 2W, each narrow face shares a half width W. The strain $\epsilon$ of the slab, therefore, is obtained by dividing the deformation amount dλu and dλl by W, respectively. The formulae (12) and (13) are modified as follows by way of the rate $\dot{\epsilon}$ of change of the strain $\epsilon$ ($\dot{\epsilon} = d\epsilon/dt$).

$$W \cdot \dot{\epsilon}u = Vu - Uc \cdot (Xu - Xl)/L \quad (14)$$

$$W \cdot \dot{\epsilon}l = Vl - Uc \cdot (Xu - Xl)/L \quad (15)$$

It proved that the excessive pressing of the slab and generation of the air gap $\eta$ can be avoided by maintaining the strain rate $\dot{\epsilon}$ constant in relation to time. Furthermore, since the driving power for driving the narrow face is determined by the strain rate $\dot{\epsilon}$ of the slab, it is possible to maintain a constant driving power by maintaining a constant strain rate $\dot{\epsilon}$ in relation to time. To this end, the result of differentiation of the formulae (14) and (15) by time should be zero, i.e., the condition of $d\dot{\epsilon}/dt = 0$ should be met. This condition can be expressed as follows:

$$(dVu/dt) - Uc \cdot (Vu - Vl)/L = 0 \quad (16)$$

$$(dVl/dt) - Uc \cdot (Vu - Vl)/L = 0 \quad (17)$$

The following formula (18) is obtained as a differential equation for determining the velocity Vu, by eliminating the factor Vl from the formulae (12), (13) and (16), (17).

$$dVu/dt = Uc\,\{(d\lambda u/dt) - (d\lambda l/dt)\} \quad (18)$$

-continued $$= Uc \cdot W(\epsilon u - \epsilon l)/L$$

The right side of this formula can be regarded as being constant in relation to time. A constant A which represents the right side of the above formula (18) is given by the following formula (19).

$$A = Uc \cdot W(\epsilon u - \epsilon l)/L \quad (19)$$

From this formula, the following formula (20) is obtained as a general solution for the velocity Vu.

$$Vu = A \cdot t + B \quad (20)$$

On the other hand, the general solution for the velocity Vl is given as follows, from the formulae (16) and (20).

$$Vl = A \cdot t + B - A \cdot L/Uc \quad (21)$$

In the formulae (20) and (21), B represents an integration constant.

From the formulae (20) and (21), it will be obtained that the condition of deformation, i.e., the strain rate, can be maintained constant by determining the velocities Vu and Vl as functions of primary order of the time t from the commencement of the width changing and by maintaining a constant difference ΔV between the velocities Vu and Vl.

With these knowledges, the present inventors have conducted an intense study on the width changing control in an actual continuous casting equipment, and confirmed that the above-mentioned knowledges can be utilized in an industrial scale by determining the constant A in the formulae (20) and (21) using an allowable strain resistance as the parameter.

When the constant A takes a value other than zero, both the velocities Vu and Vl are increased or decreased. The constant A, which increases or decreases the velocities Vu and Vl is used in this invention as the acceleration. The constant B appearing in the formulae (20) and (21) is the initial velocity of the upper end of the narrow face, can be determined suitably in accordance with the width changing condition and operating conditions of the continuous casting. Since the acceleration Δ is given, the difference between the velocities Vu and Vl is given as the function of the acceleration Δ, length L of the narrow face and the casting speed Uc, as the following formula (1) which is mentioned before.

$$\Delta V = Vu - Vl = \alpha \cdot L/Uc \quad (1)$$

Since the velocity difference ΔV between the upper and lower mold face ends is a function of the acceleration when the acceleration α takes a positive value, the upper end of the narrow face is inclined towards the center of the mold relatively to the lower end of the same, such as to increase the inclination angle β. Conversely, when the acceleration α takes a negative value, the upper end of the shorter mold wall is inclined away from the center of the mold, thus decreasing the angle β. During a steady continuous casting, the narrow face are maintained at a suitable angle. After the changing of the slab width, therefore, it is necessary to recover this predetermined angle of taper. This means that one cycle of the width changing operation has to have a combination consisting of at least one period in which the acceleration α takes a positive value and at least a period in which the acceleration α takes a negative value. The simplest form of this combination is the pattern which includes one forward taper changing period and one rearward taper changing period as shown in FIG. 1. This pattern minimizes the time length for the changing the slab width and facilitates the width control because of elimination of any wasteful time.

For instance, when the acceleration α is zero, the velocity difference ΔV is zero so that the condition of Vu=Vl is met, i.e., the moving velocities of the upper and lower ends of the narrow face are equalized. This is equivalent to the translational movement which is carried out in the conventional width changing method. It is true that the translational movement in the conventional method ensures a stable state of pressing of the slab and, hence, can eliminate any casting defect, so that the changing of width in the conventional method relies upon this translational movement. This conventional method, however, requires forward and rearward taper changing periods before and after the translational movement. It is difficult to maintain the suitable pressing force in these taper changing periods. Thus, there has been a practical limit in the shortening of the width changing time. The present invention overcomes this problem by setting the acceleration α at a value which is not zero and which is determined in accordance with the allowable shell deforming resistance.

An explanation will be made hereinunder as to a practical way for determining the acceleration α.

The time required for the width changing operation is gradually shortened as the acceleration α is increased. However, when the acceleration α exceeds a certain threshold, problems are caused such as break out of the shell due to buckling of the slab, an operation failure due to insufficient driving power as a result of an increase in the deformation resistance, and so forth.

As a result of an intense study, the present inventors have found that the optimum range of the acceleration α can be determined from the allowable deformation resistance of the shell. The allowable shell deformation resistance is determined in some cases by the shell strength and in other cases by the driving power for driving the narrow face.

Referring first to the case where the allowable shell resistance is determined from the strength of the shell. When the narrow face is pressed, a strain is caused in the solidification shell formed on the shell. In this case, a resistance corresponding to the strain rate is produced in the shell. When this resistance becomes greater than a limit of the strength of the shell, the shell is buckled to allow generation of casting defects. In order to avoid the generation of defect, it is necessary that the strain rate in the shell has to be smaller than a threshold strain limit which is determined by the shell strength. As explained before, the strain rate at the upper and lower ends of the mold face are given by formulae (12) and (13).

In this specification, a term "earlier half period of width changing operation" is used to generally mean both the forward taper changing period in the decremental width changing operation and the rearward taper changing period in the incremental width changing operation. Similarly, a term "later half period of width changing operation" is used to mean both the rearward taper changing period in the decremental width changing operation and the forward taper changing period in the incremental width changing operation.

The moving velocities $Vu_1$ and $Vl_1$ of the upper and lower ends of the narrow face in the earlier half period are given by the formulae (22) and (23), while the moving velocities of the upper and lower ends $Vu_2$ and $Vl_2$ in the later half period are given by formulae (24) and (25).

$$Vu_1=\alpha_1\cdot t+B_1 \quad (22)$$

$$Vl_1=\alpha_1\cdot t+B_1-\alpha_1\cdot L/Uc \quad (23)$$

$$Vu_2=\alpha_2\cdot(t-Tr_1)+B_2 \quad (24)$$

$$Vl_2=\alpha_2\cdot(t-Tr_1)+B_2-\alpha_2\cdot L/Uc \quad (25)$$

where, $\alpha_1$: acceleration in earlier half period (mm/min$^2$)

$\alpha_2$: acceleration in the later half period (mm/min$^2$)

$B_1$: initial velocity of upper end when the width changing is commenced (mm/min)

$B_2$: initial velocity of the upper end at the time of switching from earlier half period to the later half period of width changing operation Thus, the strain rates at the upper and lower ends of the mold face in the earlier half period are determined by the formulae (26) and (27) which are derived by integrating the formulae (22) and (23) and substituting the result of integration for the formulae (14) and (15).

$$\dot{\epsilon}u_1=B_1/W \quad (26)$$

$$\dot{\epsilon}l_1=(B_1-\alpha_1\cdot L/Uc)/W \quad (27)$$

Similarly, the strain rates in the later half period of width changing operation are determined by the formulae (28) and (29) which are obtained by integrating the formulae (22) and (23) and substituting the result of integration to the formulae (14) and (15).

$$\dot{\epsilon}u_2=(B_2-\alpha_1\cdot Tr_1)/W \quad (28)$$

$$\dot{\epsilon}l_2=\{B_2-(\alpha_2\cdot L/Uc)-\alpha_1\cdot Tr_1\}/W \quad (29)$$

The strain rate, when it is negative, causes generation of an air gap, whereas a positive strain rate in excess of a predetermined level may cause a buckling of the slab. The strain rate $\dot{\epsilon}$, therefore, should be greater than zero but should not exceed a predetermined maximum allowable value. In other words, it is essential that the condition $0\leqq\dot{\epsilon}\leqq\dot{\epsilon}$ max is met.

The inventors have made an intense study on the maximum allowable strain rate $\dot{\epsilon}$ max and found that the value of $\dot{\epsilon}$ max varies between the upper and lower ends of the mold face, and confirmed that the function of the invention of this application can be performed without fail when the values shown in Table 1 are used, in the case of steels which are processed in accordance with conventional continuous casting.

Thus, the following formulae (30) to (33) are derived from the formulae (26) to (29). Namely, the formulae (30) and (31) apply, respectively, to the upper and lower ends of the narrow face in the earlier half period of the width changing operation, whereas the formulae (32) and (33) apply, respectively, to the upper and lower ends in the later half period of the operation.

TABLE 1

| Kind of steel | $\dot{\epsilon}$ max u (upper end) | $\dot{\epsilon}$ max l (lower end) |
|---|---|---|
| Ordinary low-carbon steel | $6.0\times10^{-3}$ 1/sec | $5.5\times10^{-3}$ 1/sec |
| Ordinary medium-carbon steel | $6.0\times10^{-3}$ 1/sec | $5.0\times10^{-3}$ 1/sec |

$$0<B_1/W\leqq\dot{\epsilon}\text{ max }u \quad (30)$$

$$0<(B_1-\alpha_1\cdot L/Uc)\cdot 1/W\leqq\dot{\epsilon}\text{ max }l \quad (31)$$

$$0<(B_2-\alpha_1\cdot Tr)\cdot 1/W\leqq\dot{\epsilon}\text{ max }u \quad (32)$$

$$0<(B_2-\alpha_2\cdot l/Uc-\alpha_1\cdot Tr)\cdot 1/W\leqq\dot{\epsilon}\text{ max }l \quad (33)$$

where, $\dot{\epsilon}$max u: maximum allowable strain rate at upper end (min$^{-1}$)

$\dot{\epsilon}$max l: maximum allowable strain rate at lower end (min$^{-1}$)

In order to attain a stead casting during the width changing operation, it is necessary that the conditions of the above-mentioned formulae are satisfied. To this end, it is necessary that the following conditions (a) to (h) are met:

$$B_1>0 \quad (a)$$

$$B_1>\alpha_1\cdot L/Uc \quad (b)$$

$$B_1<W\cdot\dot{\epsilon}\text{ max u} \quad (c)$$

$$B_1<W\cdot\dot{\epsilon}\text{ max l}+\alpha_1\cdot L/Uc \quad (d)$$

$$B_2\geqq\alpha_1\cdot Tr \quad (e)$$

$$B_2\geqq\alpha_1\cdot Tr+\alpha_2\cdot L/Uc \quad (f)$$

$$B_2\leqq W\cdot\dot{\epsilon}\text{ max }u+\alpha_1\cdot Tr \quad (g)$$

$$B_2\leqq W\cdot\dot{\epsilon}\text{ max }l+\alpha_1\cdot Tr+\alpha_2\cdot L/Uc \quad (h)$$

Figure 9A:
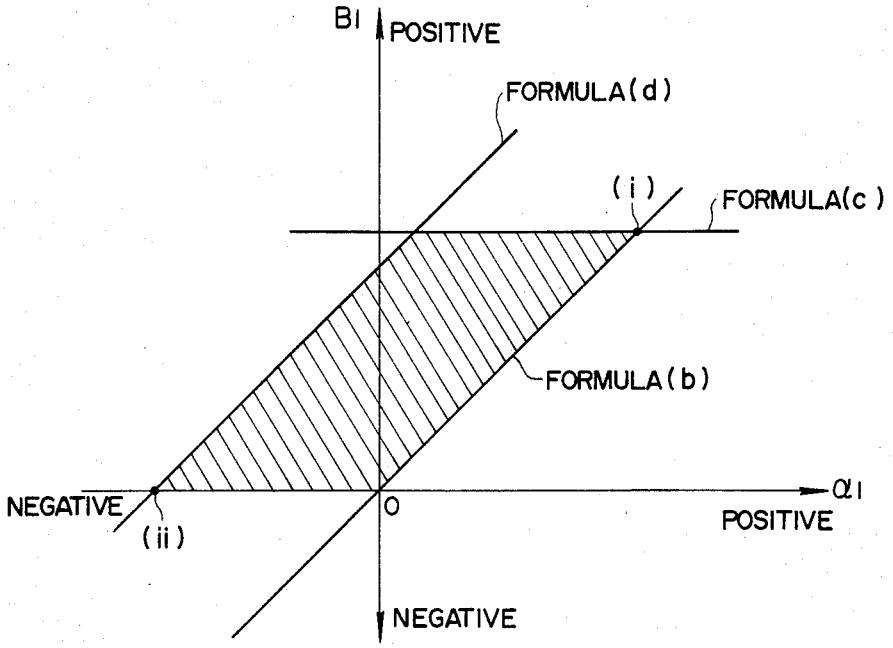
FIGS. 9A and 9B are diagrams showing the ranges of factors $\alpha$ and B for elimination of the casting defect.
Figure 9B:
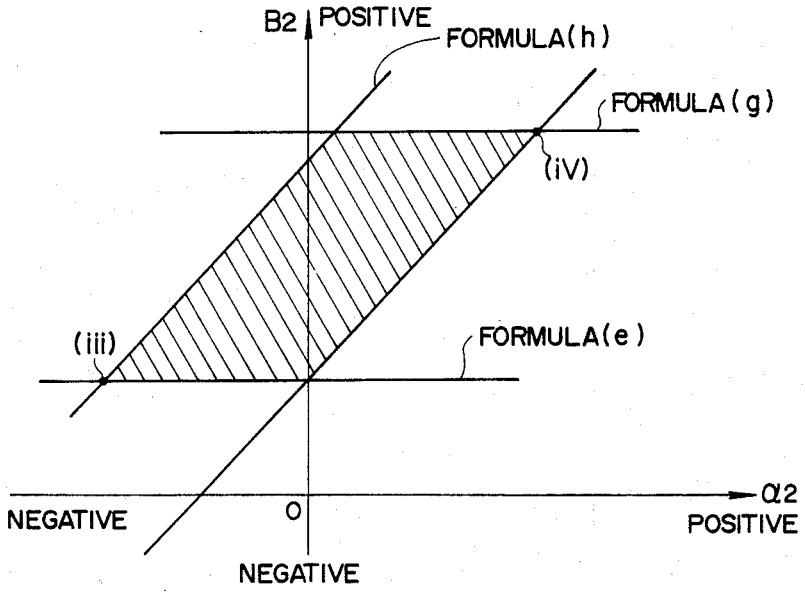

FIG. 9A illustrates the conditions (a) to (h) for the earlier half period, while FIG. 9B shows the conditions for the later half period. In these Figures, axis of abscissa represents the accelerations $\alpha_1$, $\alpha_2$, while axis of ordinate show the initial velocities $B_1$ and $B_2$. In these Figures, hatched areas show the ranges which permit a width change while maintaining a constant and stable casting. Thus, the width changing method in accordance with the invention can be carried out successfully by selecting the accelerations $\alpha_1$ and $\alpha_2$ such as to fall within the hatched area. The initial velocities $B_1$ and $B_2$ are determined naturally when the accelerations $\alpha_1$ and $\alpha_2$ are selected.

The width changing operation has to be completed in a short time as possible, and the acceleration $\alpha$ should be selected from the hatched region such as to meet this requirement. In the earlier half part of the decremental width changing operation, the acceleration $\alpha_1$ and the initial velocity $B_1$ should be positive and preferably have large absolute values. This means that the point (i) appearing in FIG. 9A provides the optimum condition.

Thus, it is necessary that the following condition (34) is met:

$$B_1=\alpha_1\cdot L/Uc=W\cdot\dot{\epsilon}\text{ max }u \quad (34)$$

In the later half period of operation, the operation must be such that the inclination or taper of the shorter mold wall is reset to the initial one. This requires that the following conditions are met:

$$\alpha_1 \cdot Tr = -\alpha_2 \cdot (Tw - Tr) \quad (35)$$

$$Tw - Tr = -(\alpha_1/\alpha_2) \cdot Tr \quad (36)$$

For shortening the time required for the width changing, it is necessary that the acceleration $\alpha_2$ has a large value. Thus, the point (iii) appearing in FIG. 9B determines the optimum condition. This condition is expressed by the following formula (37).

$$B_2 = \alpha_1 \cdot Tr = W \cdot \dot{\epsilon} \max l + \alpha_1 \cdot Tr + \alpha_2 \cdot L/Uc \quad (37)$$

Conversely, for shortening the width changing time in the earlier half part of the incremental width changing operation, both the acceleration $\alpha_1$ and the initial velocity $B_1$ are preferably large. Thus, the point (ii) appearing in FIG. 9A provides the optimum condition, and the initial velocity $B_1$ is given by the following formula (38).

$$B_1 = 0 = W \cdot \epsilon \max l + \alpha_1 \cdot L/Uc \quad (38)$$

In the later half period of the incremental width changing operation, the acceleration $\alpha_2$ is preferably selected large because conditions of $\alpha_1 < 0$ and $\alpha_2 > 0$ exists in the following formula (39). Thus, the point (iv) appearing in FIG. 9B provides the optimum condition, and the initial velocity $B_2$ is expressed by the following formula (40).

$$Tw - Tr = -(\alpha_1/\alpha_2) \cdot Tr \quad (39)$$

$$B_2 = \alpha_1 \cdot Tr + \alpha_2 \cdot L/Uc = W \cdot \dot{\epsilon} \max u + \alpha_1 \cdot Tr \quad (40)$$

The acceleration $\alpha$ and initial velocity B for minimizing the width changing time is thus determined. Table 2 shows such conditions for minimizing the width changing time.

TABLE 2

| | decremental width change | incremental width change |
|---|---|---|
| $\alpha_1$ | $(Uc/L) \cdot W \cdot \dot{\epsilon}$ max u | $(-Uc/l) \cdot W \cdot \dot{\epsilon}$ max l |
| $\alpha_2$ | $(-Uc/L) \cdot W \cdot \dot{\epsilon}$ max l | $(Uc/L) \cdot W \cdot \dot{\epsilon}$ max u |
| $B_1$ | $\alpha_1$ L/Uc | 0 |
| $B_2$ | $\alpha_1$ Tr | $\alpha_1$ Tr + $\alpha_2$ L/Uc |

Under the conditions shown in Table 2, the velocities Vu and Vl at the upper and lower ends take the values shown in the following Tables 3 and 4, in case of decremental and incremental width changing operations, respectively.

TABLE 3

| | earlier half period | later half period |
|---|---|---|
| Vu | $\alpha_1 t + \alpha_1 \cdot L/Uc$ | $\alpha_2(t - Tr) + \alpha_1 \cdot t$ |
| Vl | $\alpha_1 t + [0]$ | $\alpha_2(t - Tr) + \alpha_1 \cdot t - \alpha_2 \cdot L/Uc$ |

TABLE 4

| | earlier half period | later half period |
|---|---|---|
| Vu | $\alpha_1 \cdot t + [0]$ | $\alpha_2(t - Tr) + \alpha_1 \cdot t - \alpha_2 \cdot L/Uc$ |
| Vl | $\alpha_1 \cdot t - \alpha_1 \cdot L/Uc$ | $\alpha_2(t - Tr) + \alpha_1 \cdot t$ |

As will be obtained from Tables 3 and 4, for commencing a decremental width changing operation, it is necessary that the initial velocity $B_1$ of the upper end of the narrow face is selected to be $\Delta V_1$, i.e., such as to meet the condition of $B_1 = \Delta V_1 = \alpha_1$ L/Uc. For shortening the time required for the narrowing, it has proved to be effective to select the initial velocity of the lower end of the narrow face to be zero, as shown in the following formula.

$$Vl = Vu - \Delta V_1 = (\alpha_1 \cdot t + \alpha_1 \cdot L/Uc) - (\alpha_1 \cdot L/Uc)$$
$$= \alpha_1 \cdot t + [0]$$

Similarly, for shortening the time required for the width changing, it has proved to be effective to select the initial velocity of the upper end of the narrow face set at zero.

Claims 2 and 3 attached to this specification set forth these conditions. FIGS. 1A and 1B show the embodiment in which, for the decremental width change, the initial velocity at the lower end of the narrow face is set at zero and, for the incremental width change, the initial velocity of the upper end of the same are set at zero.

Experiences show that the following condition (41) exists considering that the shell thickness is greater in the portion adjacent the upper end than the portion adjacent the lower end of the narrow face.

$$\dot{\epsilon} \max u > \dot{\epsilon} \max l \quad (41)$$

In view of the shell deformation resistance, it is possible and effective for attaining higher width changing speed to select the accelerations such as to meet the conditions (42) and (43).

for decremental width change:

$$|\alpha_1| > |\alpha_2| \quad (42)$$

for incremental width change:

$$|\alpha_1| < |\alpha_2| \quad (43)$$

If the absolute values of the accelerations $\alpha_1$ and $\alpha_2$ are not equal to each other, a complicated control is required in the turning point, i.e., at the point from which the control is switched from the forward taper changing to the rearward taper changing. For an easier control, therefore, it is preferred that the absolute values of the accelerations $\alpha_1$ and $\alpha_2$ are equal to each other. Anyway, the accelerations $\alpha_1$ and $\alpha_2$ can be selected freely within the preferred range mentioned before, in accordance with the conditions of the equipment and operation.

When the shell deformation resistance is limited from the view point of power of the driving device, the accelerations and initial velocity are determined as follows. When the method of the invention has to be carried out by means of an existing plant, or when it is not allowed to increase the power of the driving unit due to restriction of installation space or cost, the driving unit may fail to realize the acceleration and initial velocity determined from the view point of the shell strength. In such a case, it is a reasonable way to determine the acceleration $\alpha$ and the initial velocity B which can allow an effficient use of the power of the driving unit within the given length of the shell.

Among various types of driving unit available, a cylinder type driving unit will be used by way of example, and a description will be made hereinunder as to a method for determining the acceleration $\alpha$ and the initial velocity B from the power of the cylinder type driving unit.

The inventors have conducted experiments using various values of the acceleration $\alpha$ and initial velocity B, and found that the total force F for driving the narrow face is given by the following formula (44).

$$F=2\int_0\int_0 G^n\cdot\dot{\epsilon}(E)^n dsdE \quad (44)$$

where, (E) is given by the following formula (45).

$$\dot{\epsilon}(E)=(\dot{\epsilon}u-\dot{\epsilon}l)\cdot E/L+\dot{\epsilon}l \quad (45)$$

In regard to the earlier half period of the width changing operation, the values $\dot{\epsilon}u_1$ and $\dot{\epsilon}l_1$ determined by the formulae (26) and (27) are used as the values $\dot{\epsilon}u$ and $\dot{\epsilon}l$. On the other hand, in regard to the later half period of the width changing operation, the values $\dot{\epsilon}u_2$ and $\dot{\epsilon}l_2$ determined by the formulae (28) and (29) are used as $\dot{\epsilon}u$ and $\dot{\epsilon}l$. As will be realized from the formulae (26) to (29), (E) is determined if the acceleration and the initial velocity B of the upper end of the narrow face are given. On the other hand, the shell thickness H can be determined from the following formula (46), while a creep constant C is determined by the following formula (47).

$$H=Ho\cdot(E/Uc)^{\frac{1}{2}} \quad (46)$$

$$G=Go\cdot \exp(q/Re) \quad (47)$$

In formula (46), Ho represents solidification coefficient which ranges between 18 mm/min$^{\frac{1}{2}}$ and 25 mm/min$^{\frac{1}{2}}$ in the cases of ordinary steel. More specifically, this coefficient is determined by measuring the shell thickness for respective steels. Factors Go, n and q appearing in formulae (44) and (47) are coefficients which are determined by physical properties of the steel to be cast and can be determined through a tensile test for each steel. A factor s is the distance as measured from the surface of the shell on the broad face in the direction of thickness of this shell, while E represents the distance as measured from the upper end of the narrow face. A factor Re is the temperature (°K.).

The driving forces required for the upper and lower cylinders for driving the narrow face in the manner shown in FIG. 5 are represented by Fu and Fl, respectively. Fu and Fl are given by the following formulae (48) and (49), respectively.

$$Fl=F(So-j)/L_1 \quad (48)$$

$$Fu=F-Fl \quad (49)$$

where, j: distance between miniscus and position at which the upper cylinder is secured (mm)

$L_1$: distance between upper and lower cylinders (mm)

F: total required force for both cylinders (Kg)

So: value determined by the following formula (50) (mm)

$$So=\int_0 E\int_0 G^n\cdot\dot{\epsilon}^n dsdE/\int_0\int_0 G^n\cdot\dot{\epsilon}^n dsdE \quad (50)$$

Thus, the value $\dot{\epsilon}$ is determined by the formula (45) while successively changing the values $\alpha$ and B, and the total required force F is determined from the formula (44) using this value $\dot{\epsilon}$. Said total driving force F is determined, the required driving forces Fu and Fl for the upper and lower cylinders are determined by the formula (48) and (49). On the other hand, the powers exterted by the upper and lower cylinders (referred to as "cylinder power", hereinunder) are determined by subtracting static pressure Fg of the molten steel and the sliding friction power F$\mu$ from the powers Fa generated by the cylinders, as expressed by the following formulae (51) and (52).

$$Fuu=Fa-Fg-F\mu \quad (51)$$

$$Fll=Fa-Fg-F\mu \quad (52)$$

where,

Fa: power generated by the cylinders

Fuu: upper cylinder power (Kg)

Fll: lower cylinder power (Kg)

Fg: static pressure of the molten steel acting on narrow face (Kg)

F$\mu$: sliding friction power (Kg)

It is thus possible to determine the velocity difference $\Delta V$ upon determination of the acceleration $\alpha$ and the initial velocity B of the upper end of the narrow face such as to meet the condition of Fuu>Fu and Fll>Fl.

An explanation will be made hereinunder as to the timing of the change from the forward taper changing period to be rearward taper changing period the turning point in the width changing operation in accordance with the invention. For instance, in the case of a decremental width change, forward and rearward taper changing operations are made in the earlier and later half periods as will be seen from FIG. 1A. The timing of switching over from the forward taper changing to the rearward taper changing operation can be determined in accordance with the following method.

The whole time required for completing the width changing operation is expressed by Tw, while the timing of the turning point is expressed by Tr. In the forward taper changing period, the inclination or taper of the narrow face is increased from that in the ordinary operation, whereas, in the rearward taper changing period, the inclination or taper has to be reset to that in the ordinary operation. These conditions can be expressed by the following formula (53) from which are derived the following formulae (54) and (55) are derived to determine the velocity differences $\Delta V_1$ and $\Delta V_2$ in the forward and rearward taper changing periods.

$$\Delta V_1 Tr+\Delta V_2(Tw-Tr)=0 \quad (53)$$

$$\Delta V_1=\alpha_1\cdot L/Uc \quad (54)$$

$$\Delta V_2=\alpha_2\cdot L/Uc \quad (55)$$

In these formulae, $\alpha_1$ represents the acceleration in the forward taper changing period and has a positive direction (+), while $\alpha_2$ represents the acceleration in the rearward taper changing period and has the negative direction (−).

Using the formulae (54) and (55), the formula (53) mentioned above can be rewritten as follows:

$$\alpha_1\cdot Tr+\alpha_2\cdot(Tw-Tr)=0 \quad (56)$$

Representing the command width changing amount by 2Q, the change of width to be attained by each narrow face, i.e., the required displacement of each narrow face, is expressed by Q, so that the condition given by the following formula (57) is obtained. The command width changing amount is positive (+) and negative (−) when the width is to be decreased and increased, respectively.

$$(\tfrac{1}{2})\cdot\alpha_1\cdot Tr^2+B_1\cdot Tr+(\tfrac{1}{2})\cdot\alpha_2(Tw-Tr)^2+B_2\cdot(Tw-Tr)=Q \quad (57)$$

Substituting the formula (56) for the formula (57) mentioned before, the following formula (58) is obtained.

$$(\tfrac{1}{2})\cdot[1+(\alpha_1/\alpha_2)]\alpha_1 Tr^2+[B_1-(\alpha_1/\alpha_2)\cdot B_2]\cdot Tr-Q=0 \quad (58)$$

It is possible to determine the timing Tr of the turning point, i.e., the timing of switching over from the forward taper changing operation to the rearward taper changing operation, by solving the formula (58) as shown by the following formulae (59) and (60).

On condition of $\alpha_1 \neq -\alpha_2$ $$Tr = \{1/[1+(\alpha_1/\alpha_2)]\cdot\alpha_1\}\cdot[-(\tfrac{1}{2})\cdot[1+(\alpha_1/\alpha_2)]\cdot\alpha_1+\{[B_1-(\alpha_1/\alpha_2)\cdot B_2]^2+2[1+(\alpha_1/\alpha_2)]\cdot\alpha_1 Q\}^{\frac{1}{2}}] \quad (59)$$

On condition of $\alpha_1 = -\alpha_2$ $$Tr = Q/(B_1+B_2) \quad (60)$$

From the formula (60), it will be understood that the timing Tr can be determined simply by Q, $B_1$ and $B_2$, provided that the condition of $\alpha_1=-\alpha_2$ is met and, therefore, can be controlled easily.

The while time Tw for completing the width changing operation is given by the following formula (61) which is derived from the formula (56).

$$Tw=-(\alpha_1/\alpha_2)\cdot Tr+Tr=[1-(\alpha_1/\alpha_2)]\cdot Tr \quad (61)$$

In the case of $\alpha_1=-\alpha_2$ or $\alpha_1\approx-\alpha_2$, Tr is a half or about a half of Tw. This means that the width changing operation can be conducted satisfactorily by switching over the operation from the forward taper changing operation to the rearward taper changing operation is made at a moment when a half of the command width changing amount has been attained.

(First Embodiment)

The method of the invention was applied to a process for casting an ordinary low-carbon Al killed steel conducted by means of a curved continuous casting machine having a capacity of 350 T/H. The specification and operating conditions of this equipment are shown in Table 5 below.

TABLE 5

| | |
|---|---|
| casting speed (Uc) | 1600 mm/min |
| cylinder power (Fa) | 10 tons |
| billet width (W) | 1300–650 mm |
| static pressure of molten steel acting on narrow face (Fg) | 1.5 tons |
| sliding friction resistance (Fm) | 1.5 tons |
| distance between upper and lower cylinders ($L_1$) | 640 mm |
| length of narrow face (L) | 800 mm |
| distance between upper end of narrow face and upper cylinder (j) | 60 mm |

In the foregoing description, the velocities at the meniscus and at the lower end of the narrow face are used as the moving velocities Vu and Vl, in the determination of the acceleration $\alpha$ and the velocity difference $\Delta V$. In the case where the narrow face is driven by the upper and lower cylinders, however, it is preferred to use the velocities of these cylinders for determination of the acceleration and velocity difference, from the view point of earliness of driving and control. This can be achieved simply by substituting the velocities of both cylinders for the velocities Vu and Vl.

Referring to FIG. 5, representing the distance between two cylinders by $L_1$ and the distance between the upper cylinder and the upper end of the narrow face by j, the velocities $Vu_1$ and $Vl_1$ of both cylinders are given by the following formulae (62) and (63).

$$Vu_1=(Vl-Vu)\cdot j/L+Vu \quad (62)$$

$$Vl_1=(Vl-Vu)\cdot(j+L_1)/L+Vu \quad (63)$$

Thus, the velocity difference between both cylinders is given by the following formula (64).

$$Vu_1-Vl_1=(Vl-Vu)\cdot L_1/L=\alpha\cdot L_1/Uc \quad (64)$$

It will be seen that the successful result is obtained by substituting the cylinder distance $L_1$ for the length L of the narrow face.

In the described embodiment, for the purpose of minimization of the width changing time, the initial velocities $B_1$ and $B_2$ of the upper end of the narrow face in the forward and rearward taper changing periods are determined as follows, in accordance with the formulae (30) and (31) mentioned before.

$$B_1=\alpha_1\cdot L_1/Uc \quad (65)$$

$$B_2=\alpha_1\cdot Tr \quad (66)$$

Figure 10:
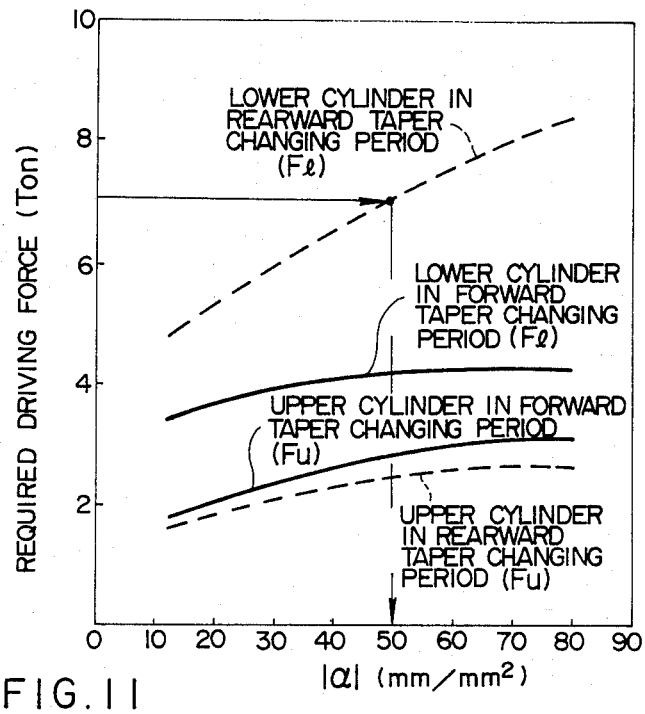
FIG. 10 is a diagram showing an example of the method for determining the value of the factor $\alpha$ from the required driving power.

On the other hand, the acceleration $\alpha$ is determined from the cylinder power, because the cylinder cannot provide in this case the acceleration which is determined from the shell strength. The cylinder powers Fuu and Fll of the upper and lower cylinders were calculated as 7 tons, from the formulae (51) and (52) mentioned before, i.e., as (10 tons−1.5 tons−1.5 tons). On the other hand, a tensile test was conducted with the steel and the values are obtained as $Go=2.5\times10^{-12}\{(Kg/mm^2)^n.sec\}$, n=0.32, q=28,000 (1/°K.). Also, the shell thickness was measured and the factor Ho proved to be 20 ($mm/min^{\frac{1}{2}}$). Under these conditions, the required driving forces Fu and Fl were measured in accordance with the formulae (44) to (56), while varying the value of the acceleration $\alpha$. The result is shown in FIG. 10. In order to that the required driving forces Fu and Fl of the cylinders are below the cylinder powers Fuu and Fll, the acceleration $\alpha$ was selected to be 50 $mm/min^2$. Then, the velocity difference $\Delta V$ is determined as follows by the formula (64) corresponding to the formula (1).

$$\Delta V=\alpha\cdot L_1/Uc=50\times640/1600=20 \text{ (mm/min)}$$

The accelerations $\alpha_1$ and $\alpha_2$ in the forward and rearward taper changing periods are determined to be $\alpha_1 = -\alpha_2$, in order to attain a high controllability as explained before. Therefore, the cylinder velocities in the forward and rearward taper changing periods are determined as follows:

In case of forward taper changing period in decremental width change ($0 \leqq t \leqq Tr$)

$$Vu = 20 + 50t \text{ (mm/min)} \quad (67)$$

$$Vl = 50t \text{ (mm/min)} \quad (68)$$

In case of rearward taper changing period in decremental width change ($Tr \leqq t \leqq Tw$)

$$Vu = 50(Tw - t) \text{ (mm/min)} \quad (69)$$

$$Vl = 20 + 50(Tw - t) \text{ (mm/min)} \quad (70)$$

The half value of the width changing time Tw, i.e., the timing of the turning point Tr, is determined by the following formulae (71) and (72), in accordance with the formula (60) mentioned before.

$$Tr = 0.2\{(1 + 0.50Q)^{\frac{1}{2}} - 1\}\text{(min)} \quad (71)$$

$$Tw = 0.4\{(1 + 0.5Q)^{\frac{1}{2}} - 1\}\text{(min)} \quad (72)$$

where, Q represents the width change narrowing at each side of billet in terms of mm.

Figure 11:
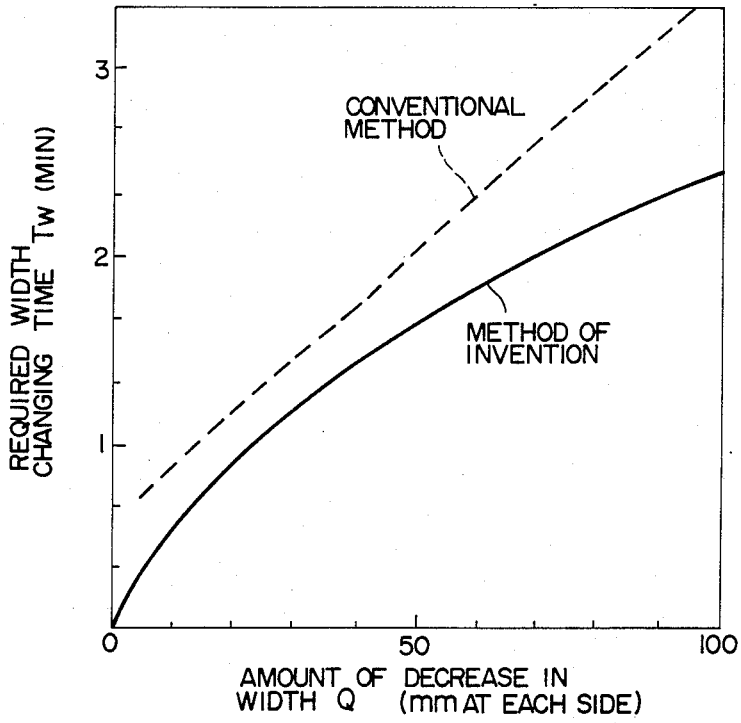
FIG. 11 is a chart showing the relationship between the command width changing amount which is in this case decremental amount and the time required for the width change, in comparison with that in the conventional method.

Using the thus determined velocities Vu and Vl at the upper and lower ends, the narrow face was forwardly inclined for a time Tr which is a half of the whole width changing time Tw. Thereafter, the width reducing control was conducted by moving the narrow face for rearward inclination. FIG. 11 shows the relationship between the amount of change of width (narrowing) in relation to the width change, as compared with that in the conventional method. The characteristics of the method of present invention and that of the conventional method are shown by full line and broken line, respectively. The axis of abscissa shows the amount of narrowing of the width (Q mm) while axis of ordinate represents the width changing time Tw.

The width reduction in accordance with the conventional method was carried out in the manner explained in FIG. 3. In this case, the velocity Vm of the translational movement was limited to 35 mm/min, in order to effect the width narrowing operation with the required driving power maintained less than 7 tons, while maintaining the amount of air gap to a level small enough to avoid the generation of casting defects.

From FIG. 11, it will be seen that the method of the invention can shorten the time required for the width changing as compared with the conventional method, regardless of the amount of reduction of the width, and that the time shortening effect of the invention becomes as the amount of narrowing of the width is increased.

Figure 12A:
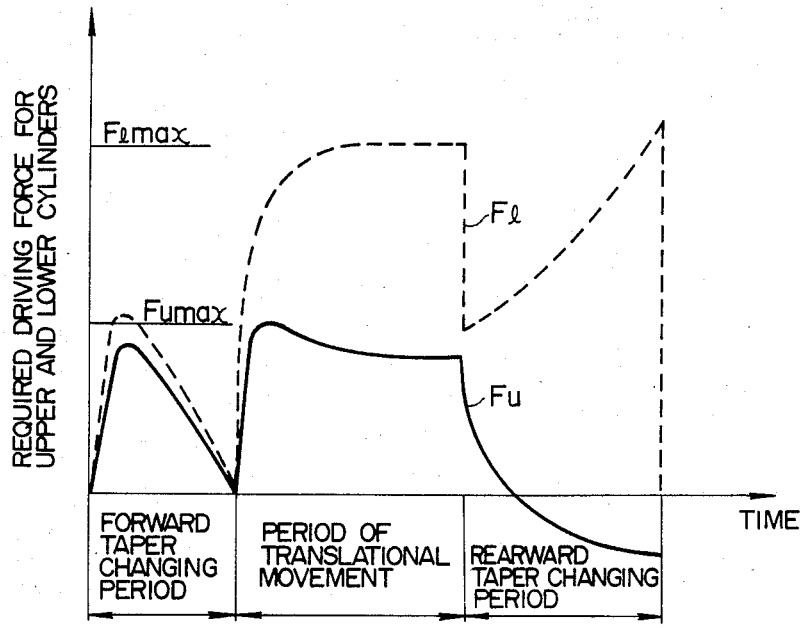
FIG. 12A (PRIOR ART)
FIGS. 12A and 12B are charts which show the manner in which the shell deformation resistance acting on upper and lower cylinders during the width decreasing operation in relation to the time from the commencement of the width changing operation, as observed in the method of the invention and the conventional method, respectively.
Figure 12B:
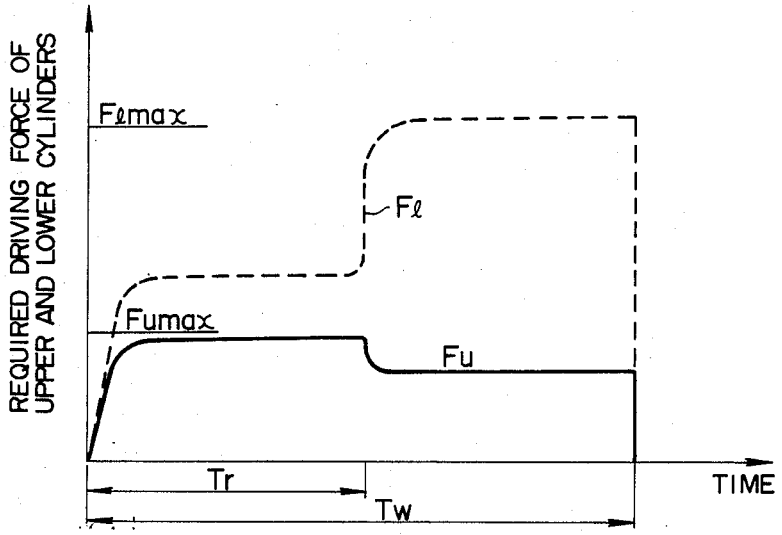

FIGS. 12A and 12B are charts which show the manner in which the shell deformation resistance acting on upper and lower cylinders during width decreasing operation in relation to time from commencement of the width changing operation, and FIG. 12A shows the chart as observed in the conventional method, and FIG. 12B shows the chart of the present invention. In these Figures, the full line curves show the force required for the upper cylinder, while broken line curves show that required for the lower cylinder.

As will be seen from FIGS. 12A and 12B, the maximum forces Fu max and Fl max required for both cylinders in the method of the invention are almost the same those in the conventional method. It was thus confirmed that the method of the invention does not need any increase in the required driving force. It was also confirmed that the method of the invention causes substantially no air gap and, hence, no casting defect, while the conventional method showed an air gap which was 1.5 mm at the maximum.

In case of the widening width changing operation also, the velocities at the upper and lower ends Vu and Vl at the upper and lower ends of the narrow face were set in accordance with the Table 4 and formulae (44) to (50), and the velocity patterns for the upper and lower cylinders are determined in accordance with the following formulae (73) to (76).

In rearward taper changing period ($0 \geqq t \geqq Tr$)

$$Vu = -50t \text{ (mm/min)} \quad (73)$$

$$V_1 = 20 - 50t \text{ (mm/min)} \quad (74)$$

In forward taper changing period ($Tr \leqq t \leqq Tw$)

$$Vu = 20 - 50(Tw - t) \text{ (mm/min)} \quad (75)$$

$$V_1 = -50(Tw - t) \text{ (mm/min)} \quad (76)$$

The whole width changing time Tw and the timing of turning point Tr are given by the following formulae (77) and (78).

$$Tr = 0.2\{(1 + 0.5Q)^{\frac{1}{2}} + 1\}\text{(min)} \quad (77)$$

$$Tw = 0.4\{(1 + 0.5Q)^{\frac{1}{2}} + 1\}\text{(min)} \quad (78)$$

where Q represents the amount of width widening at each side in terms of mm.

Figure 13:
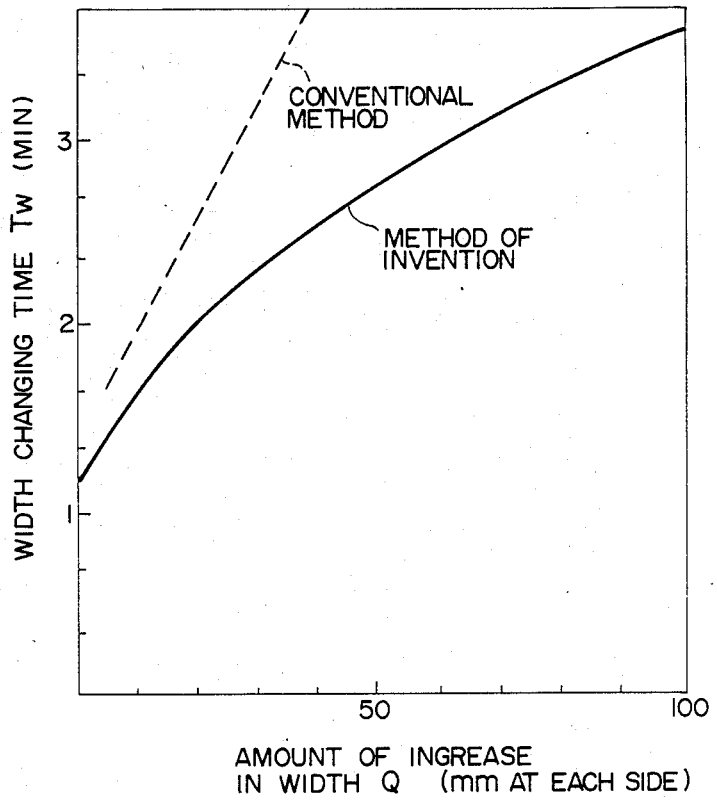
FIG. 13 is a chart showing the time required for changing the width in accordance with a method embodying the invention in comparison with that achieved by the conventional method.

FIG. 13 shows the width changing time in accordance with the invention as compared with the conventional method. More specifically, in this Figure, the axis of abscissa represents the widening of the width Q mm for each side, while the axis of ordinate represents the width changing time Tw (min). The characteristics of the method of the invention and the conventional method are shown by full line curve and broken line curve, respectively.

The conventional method was carried out in the way explained in FIG. 4. The velocity Vm of translational movement was limited to be 15 mm/min, in order to maintain the air gap below a predetermined level and the required driving force less than 7 tons. It will be seen that, as in the case of the narrowing width changing operation, the method of the invention can provide a narrow face changing time than the conventional method regardless of the amount of change of the width.

It was confirmed also that the amount of air gap generated was almost zero and the force required for the lower cylinder was less than 7 tons, thus falling within the allowable ranges as in the case of decremental width changing operation.

As will be understood from the foregoing description, the method of the invention minimizes the time required for the change of width of the casting mold, thus minimizing the length of the transient region over which the width is changed and, accordingly, remarkably improving the yield.

Furthermore, the width could be changed as desired within the range of between 1300 and 650 mm, while maintaining the air gap and shell deformation reaistance within the allowable ranges, thus ensuring a stable casting without the risk of cracking and breaking out.

Figures 14A, 14B:
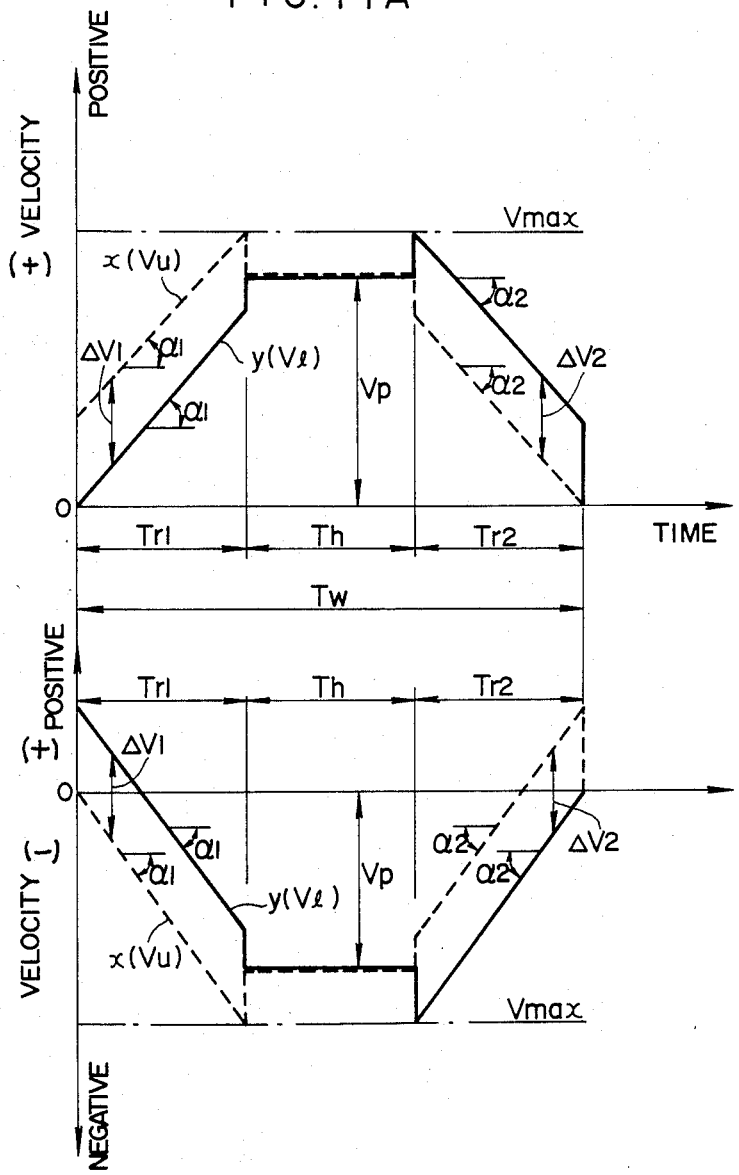
FIGS. 14A and 14B are diagrams showing the velocities of movement of the upper and lower ends of the narrow face during the width changing operation as observed in another embodiment of the invention.

FIGS. 14A and 14B are diagrams corresponding to FIGS. 1A and 1B, showing the moving velocities of both ends of the narrow face, in narrowing and widening width changes in accordance with another embodiment of the invention.

Referring first to FIG. 14A illustrating the narrowing width changing operation, the narrow face is moved towards the center of the mold. In the earlier half period of this operation, forward taper changing operation is conducted until the velocity Vu at the upper end of the narrow face reaches the maximum velocity V max. After the maximum velocity V max is reached, the narrow face is moved translationally at a translational moving velocity Vp which will be mentioned later. Then, an operation is made to rearwardly incline the narrow face after elapse of a time Th which is determined by the command width changing amount, thus completing one cycle of width changing operation.

Figure 15:
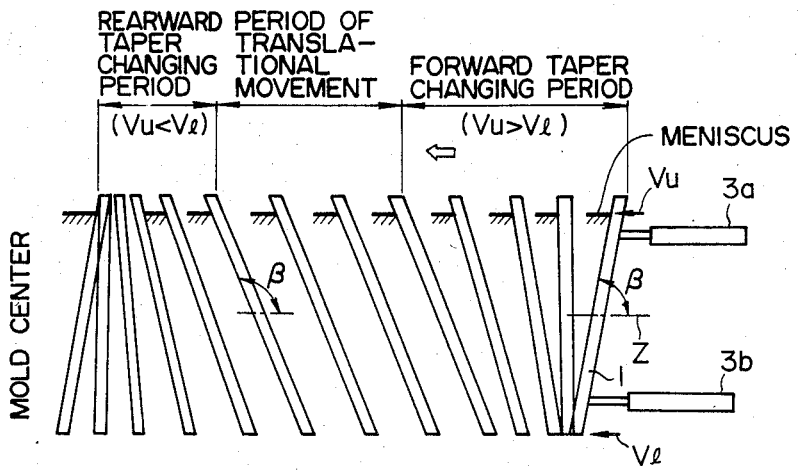
FIG. 15 is a schematic illustration of the movement of the narrow face during width decreasing operation in accordance with the method shown in FIG. 14A.

FIG. 15 schematically shows the movement of the narrow face in this embodiment. It will be seen that, in the forward taper changing period, the upper end of the narrow face is moved at a velocity Vu which is higher than that Vl of the lower end by a predetermined amount, so that the taper angle $\beta$ and, hence, the forward inclination are progressively increased. Conversely, in the rearward taper changing period, the velocity Vl of the lower end is maintained higher than the velocity Vu at the upper end so that the taper angle $\beta$ and, hence, the forward inclination are progressively decreased.

The velocities Vu and Vl at the upper and lower ends of the narrow face have a constant acceleration which is positive and, hence, serves to increase the velocity in the forward taper changing period and which is negative such as to decrease the velocity in the later half period. In addition, a velocity difference $\Delta V$ is maintained between the velocities Vu and Vl, so that the forward and rearward inclinations are increased in both periods.

Figure 16:
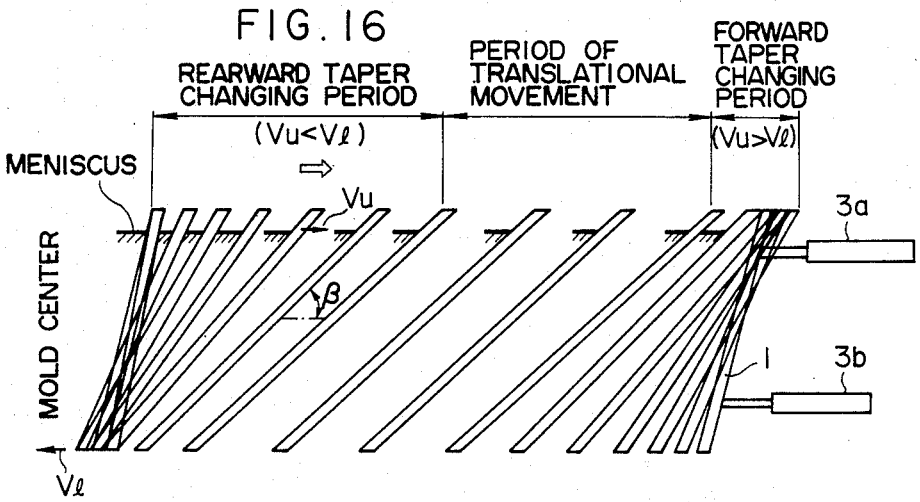
FIG. 16 is a schematic illustration of the movement of the narrow face during width increasing operation in accordance with the method shown in FIG. 14.

The widening width changing operation in this embodiment will be explained hereinunder with reference to FIG. 14 and FIG. 16 which are schemiatic illustration. The widening width changing operation has to be done by moving the narrow face away from the center of the mold, in contrast to the narrowing width changing operation. In the earlier half part of the operation, the velocity Vl of the lower end of the narrow face is maintained higher than the velocity of the upper end of the narrow face by a predetermined constant value, until the upper end velocity Vu reaches a maximum allowable velocity Vmax which will be explained later. When the velocity Vmax is reached, a translational movement is conducted at a translational moving velocity Vp which will be explained later and, after lapse of a time Th for translational movement, forward tapering operation is started by maintaining the velocity Vu at the upper end of the narrow face than the velocity Vl at the lower end. In this case also, the velocities Vu and Vl at the upper and lower ends of the narrow face are maintained such as to have a constant acceleration $\alpha$ and the velocity difference $\Delta V$.

In this embodiment, a translational period in which the narrow face is moved translationally is preserved between the earlier half period and later half period of the width changing operation.

As has been described, according to the invention, the acceleration $\alpha$ is determined beforehand in accordance with the conditions such as the kind of the steel, size of the slab, casting speed and so forth, using the allowable shell deformation resistance as the parameter. At the same time, the difference $\Delta V$ of velocity between the velocity Vu at the upper end and the velocity Vl of the lower end is determined in accordance with the formula (1) and is maintained constant in each of the forward and rearward taper changing periods during the width changing operation. On the other hand, the maximum allowable moving velocity Vmax is determined from the conditions such as the condition of rolling which is conducted following the casting, limitation from the narrow face driving device, and so forth. When the velocity $Vu_1$ of the upper end of the narrow face in the earlier half period of the operation has exceeded the maximum allowable velocity Vmax, a translational movement is conducted between the earlier and later half periods of the operation. The velocity Vp of the translational movement is given by the following formulae (2) and (3).

$$|Vmax| \geqq |Vp| \quad (2)$$

$$Vp \geqq \alpha_1 \cdot Tr_1 \quad (3)$$

where,

Vmax: maximum allowable moving velocity of narrow face (mm/min)

$\alpha_1$: acceleration of upper and lower ends of narrow face (mm/min$^2$)

$Tr_1$: time of forward or rearward taper changing action in earlier half period of operation (min)

Vp: velocity of translational movement (mm/min)

By virtue of this translational movement, according to this embodiment, it is possible to stably and continuously cast a slab in a condition meeting the requirement by the succeeding rolling, while avoiding generation of casting defects.

As explanation will be made hereinunder as to cases where the velocity Vp of translational movement is limited.

Figure 17A:
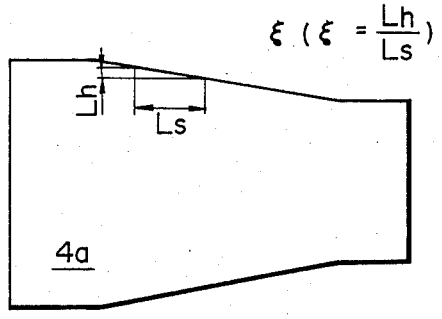
FIGS. 17A and 17B are plan views explanatory of a slab under width changing operation.
Figure 17B:
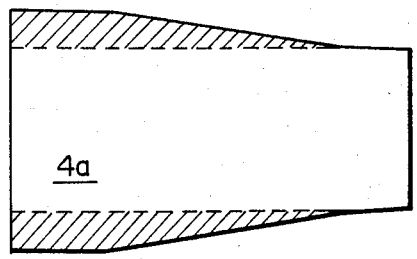
Figure 18:
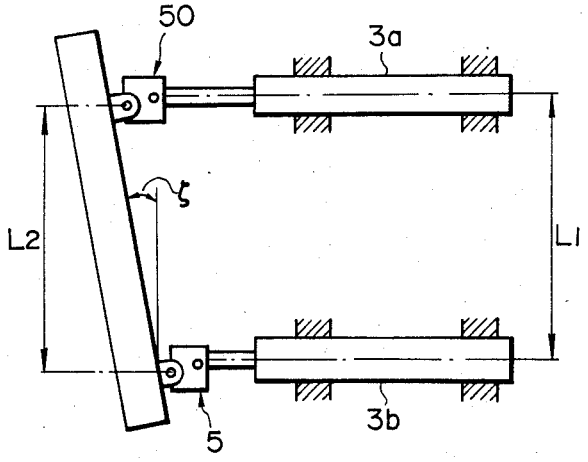
FIG. 18 is an illustration of an example of the narrow face driving means.

When this width control is conducted, the slab formed in the transient period of the width change has a taper on both sides as shown in FIG. 17A. The taper amount $\xi$ is equal to Lh/Ls where Lh is one-half of the width change over a slab length Ls. The portion of the slab with tapered sides (referred to as "tapered slab", hereinunder) has to be wasted as a scrap or, alternatively, reheated and rolled after removal of the tapered sides as shown by broken lines in FIG. 17B. Thus, the conventional method suffers from a reduction in the yield or, alternatively, a rise in the energy cost. Therefore, it has been desired that the tapered slab is rolled and used as a product without requiring any machining such as cutting.

More specifically, in the conventional method, an increase of the taper $\xi$ makes it possible to heat the desired end portions of the slab by an induction slab end heating devices which are disposed on a conveyer systems for conveying the slab from the continuous casting machine to the rolling mill. Even if the heating is conducted, an error in the width dimension may be caused in the final product.

It is true that a technique has been developed to correct the width by a width reduction device at the upstream side of the rolling mill. However, there is a practical limit in the correction of the width by this width reduction device, so that it is not possible to completely eliminate the width error in the final product when the taper amount $\xi$ is increased beyond a certain value. Therefore, the allowable taper amount $\xi$ for the transient slab 4*a* is determined in consideration of factors such as the taper amount allowable for the equipment following the continuous casting apparatus, allowable error for the rolled final product and so forth. In the present invention, the term "rolling condition" is used to generally mean conditions including the width precision in the rolling and other conditions under which the rolling is conducted, as well as the conditions allowed by various equipments disposed between the continuous casting machine and the rolling mill.

Since the shape of the slab is determined by the width of the lower end of the slab, the amount of taper $\xi$ is expressed by the following formula (80) as a function of the casting speed and the velocity Vl of the lower end of the narrow face.

$$\xi = Vl/Uc \tag{80}$$

Therefore, in order to maintain the amount of taper less than $\xi$, the velocities Vu and Vl at both ends of the narrow face have to be lower than the maximum velocity Vmax which is given by the following formula (81).

$$V\max = \xi \cdot Uc \tag{81}$$

A typical driving device for driving the narrow face has upper and lower cylinders 3*a* and 3*b* connected to each narrow face 1 through pivot joints 50. In this arrangement, the cylinders 3*a*, 3*b*, pivot joints 50 and the narrow face 1 in combination constitute a link mechanism, so that there is a limit in the pivot angle $\zeta$ in the pivot joints 50 and, hence, in the taper angle $\beta$ in the width changing operation. The width changing method shown in FIG. 1 causes the taper angle $\beta$ to increase or decrease as the time lapses, so that the limit in the taper angle $\beta$ inevitably limits the time length of the forward and rearward taper changing periods, thus limiting the narrow face. More practically, the limit of the pivot angle $\zeta$ is determined by the nature of the link mechanism for absorbing the change in the distance L2 between the upper and lower joints. This limit angle will be referred to as maximum allowable rotation angle $\zeta$max, hereinunder. The pivot angle $\zeta$ can be expressed as follows in terms of the degree of taper, as in the case of the taper amount shown in FIG. 17.

$$\zeta = 66\ V \cdot t/L \tag{82}$$

The velocity $Vu_1$ of the upper end of the narrow face in the earlier half part of the width changing operation is given as follows.

$$Vu_1 = \alpha_1 \cdot t + B_1 \tag{83}$$

This formula can be rewritten as follows:

$$Vu_1 = Uc \cdot \zeta + B_1 \tag{84}$$

Therefore, the velocity Vmax is determined by the following formula (85).

$$V\max = Uc \cdot \zeta\max + B_1 \tag{85}$$

When the limit is imposed by the power of the cylinder, the maximum velocity Vmax is the same as the maximum velocity of the cylinder.

Thus, the maximum velocity Vmax of the narrow face is determined by one or both of the rolling condition and the driving device for driving the narrow face. In the width changing method explained before, the moving velocity of the narrow face is maximized at the turning point Tr. In the earlier half part of the width changing operation, the velocity Vu of the upper end is always greater than the velocity Vl of the lower end, so that the maximum moving velocity is the same as the velocity Vu of the upper end. This maximum velocity by $Vu_1$max is expressed by the following formula (86).

$$Vu_1\max = \alpha_1 \cdot Tr + B_1 \tag{86}$$

In the invention of this application, when the velocity $Vu_1$max exceeds the maximum velocity Vmax, the translational movement of the narrow face is commenced at the velocity which is below the maximum velocity Vmax but higher than a certain velocity which will be mentioned later.

The velocity Vp of the translational movement has to be selected such that no air gap is formed and no excessive pressing of the slab is caused during the earlier half period of the width changing operation.

The slab deformation velocity during the translational movement at the upper and lower ends can be obtained from the following formula (87) which is derived from formulae (12) and (13) mentioned before.

$$d\lambda u/dt = d\lambda l/dt = (Vp - Uc \cdot \Delta V_1 \cdot Tr_1/L) = (Vp - \alpha_1 \cdot Tr_1) \tag{87}$$

If the differential values $d\lambda u/dt$ and $d\lambda l/dt$ are negative, air gap is formed between the slab and the narrow face, resulting in casting defects in the slab. These differential values, therefore, have to be positive. This in turn requires that the translational movement velocity Vp must meet the condition of the formula (87) is necessary that the conditions of the aforementioned formulae (2) and (3) are met.

$$|V\max| \geqq |Vp| \tag{2}$$

$$Vp \geqq \alpha_1 \cdot Tr_1 \tag{3}$$

The aforementioned limit of movement of the narrow face is to limit the absolute value of the moving velocity so that the formula (2) is required to have a symbol expressing the absolute values.

An explanation will be made hereinunder as to the method of determining the time length Th of the translational movement, with reference to the case of a narrowing width changing operation. In the case of the narrowing width changing operation, forward taper changing operation and reqrward taper changing operation are conducted in the earlier and later half periods of the operation. The time length $Tr_1$ of the forward taper changing period is the time length till the velocity $Vu_1$ of the upper end of the shorter mold wall reaches Vmax. This condition is expressed by the following formula (88).

$$\alpha_1 \cdot Tr_1 + \Delta V_1 = Vmax \quad (88)$$

Therefore, the time $Tr_1$ is determined by the following formula (89).

$$Tr_1 = (Vmax - \Delta V_1)/\alpha \quad (89)$$

The taper angle which has been increased in the forward taper changing period to a predetermined angle from the ordinary state has to be returned to the ordinary angle in the rearward taper changing period. This requirement is expressed by the following formula (90), and the time $Tr_2$ of the rearward taper changing period is determined by the following formula (93).

$$\Delta V_1 \cdot Tr_1 + \Delta V_2 \cdot Tr_2 = 0 \quad (90)$$

$$\Delta V_1 = \alpha_1 \cdot L/Uc \quad (91)$$

$$\Delta V_2 = \alpha_2 \cdot L/Uc \quad (92)$$

$$Tr_2 = -(\alpha_1/\alpha_2) \cdot Tr_1 \quad (93)$$

Representing the commanded taper changing amount by 2Q, the amount of movement require for each narrow face is Q, so that the following condition is established.

$$(\tfrac{1}{2}) \cdot \alpha_1 (Tr_1)^2 + B_1 Tr_1 + (\tfrac{1}{2}) \cdot \alpha_2 (Tr_2)^2 + B_2 Tr_2 + Vp \cdot Th = Q \quad (94)$$

Thus, the time duration Th of the translational movement is given by the following formula (95) which is derived from the formula (94).

$$Th = (1/Vp) \cdot [Q - \{(\tfrac{1}{2}) \cdot \alpha_1 (Tr_1)^2 + B_1 Tr_1 + (\tfrac{1}{2}) \cdot \alpha_2 (Tr_2)^2 + B_2 Tr_2\}] \quad (95)$$

On conditions of $\alpha_1 = \alpha_2$, the formula (94) is reformed to the following formula (96), so that the width control is facilitated remarkably.

$$Th = (1/Vp) \cdot \{Q - (B_1 + B_2) \cdot Tr_1\} \quad (96)$$

As will be understood from the formula (95), if the commanded width changing amount is small enough to meet the condition of formula (97), the operation is switched over from the forward tapering directly to the rearward tapering, without necessitating the step of the translational movement. Thus, the translational movement is not required since the moving velocity Vu of the upper end of the narrow face does not reach the maximum velocity Vmax in the forward taper changing period.

$$Q < (\tfrac{1}{2}) \cdot \alpha_1 (Tr_1)^2 + B_1 Tr_1 + (\tfrac{1}{2}) \cdot \alpha_2 (Tr_2)^2 + B_2 Tr_2 \quad (97)$$

In the case of an widening width change, the time duration $Tr_2$ and Th are determined in the same way as that in the narrowing width changing operation, on condition that the time duration $Tr_1$ is determined by the following formula (98).

$$Tr_1 = Vmax/\alpha_1 \quad (98)$$

Figure 19:
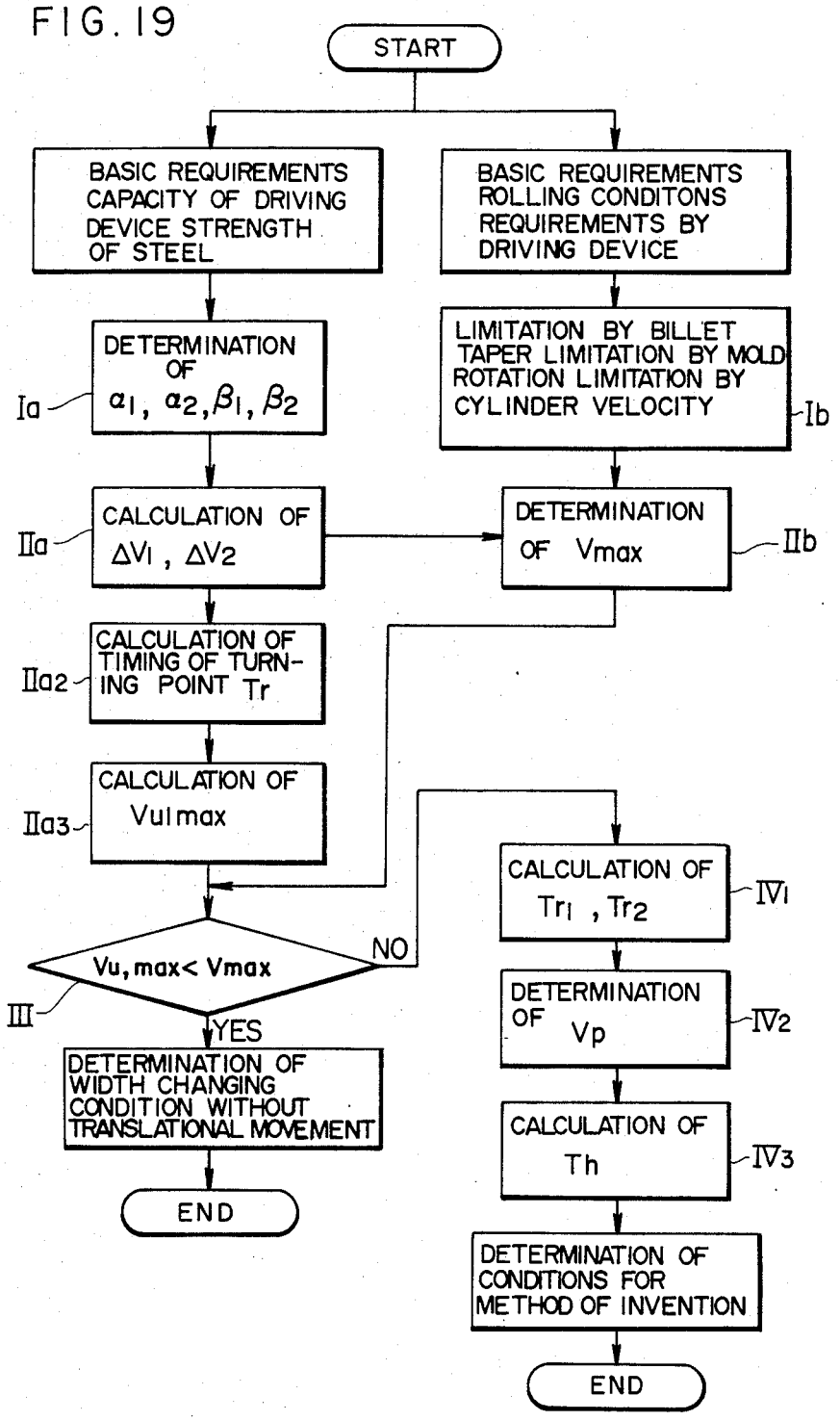
FIG. 19 is a block diagram explanatory of an example of a controlling method in accordance with the invention.

The width changing operation in accordance with this embodiment will be explained with specific reference to a block diagram shown in FIG. 19.

In an initial value setting section Ia, the accelerations $\alpha_1$ and $\alpha_2$ are determined in accordance with conditions such a the continuous casting condition, restriction from the narrow face driving device and so forth, by using the allowable shell deformation resistance as a parameter. At the same time, initial velocities $B_1$ and $B_2$ of the narrow face are determined. In another initial value setting section Ib, the maximum allowable taper amount $\xi$max of the slab maximum allowable pivot angle $\zeta$max, cylinder velocities and other factors are determined in view of the rolling conditions, restriction from the narrow face driving device, and so forth.

Using the accelerations $\alpha_1$ and $\alpha_2$, as well as the initial velocities $B_1$ and $B_2$ outputted from the initial value setting section Ia, a computing section IIa1 computes the velocity differential $\Delta V_1$ and $\Delta V_2$ in accordance with the formula (1). Then, in the computing section IIa2, the time Tr till the turning point is computed in accordance with the formulae (57) to (60). Using the result of the computation of the computing section IIa2, the maximum value $Vu_1$max of the velocity of upper end of the narrow face is determined in accordance with the formula (86). The set value of the initial value setting section Ib is inputted to the computing section IIb which computes the maximum allowable moving velocity Vmax of the narrow face. The maximum allowable moving velocity Vmax thus set in the computing section IIb is inputted to a comparator section III which receives also the maximum value Vumax of the velocity of upper end in the earlier half period as computed by the computing section IIa3, and is compared with the latter.

If the result of comparison has proved to be $|Vu_1 max| \leqq |Vmax|$, the translational movement is not necessary, so that a control pattern is determined such that later half period consisting in rearward taper changing operation (in case of width reduction) or forward taper changing operaton (in case of width increase) is commenced immediately after the completion of the earlier half period which consists in forward taper changing action (in case of width narrowing) or rearward taper changing action (in case of width widening), and the width changing operation is executed in accordance with this pattern.

Conversely, when the condition of $|Vu_1 max| \geqq |Vmax|$ is met, a translational movement is required between the earlier and later half periods. In this case, the computing sections IV1 to IV3 compute, respectively, the time durations $Tr_1$ and $Tr_2$ of the earlier and later half periods in accordance with the formulae (89) to (93), the velocity Vp of translational movement in accordance with the formulae (2) and (3) and the time duration Th of the translational movement in accordance with the formula (95) or (96), thus determining the width changing pattern in accordance with which a width changing operation is executed.

According to the invention, it is thus possible to conduct a width changing operation which satisfies either one or both of the requirements from the rolling conditions and the requirement from restriction concerning the narrow face driving device. If the desired tapers (referred to as "restricting portions 4$b_1$", hereinunder) are formed on the leading and trailing ends of the unit slab 4*b* as shown in FIG. 20, the amount of removal of the steel from the top and the bottom of the product after the rolling is reduced. In some cases, the formation of such restricted portions is required as an essential condition of rolling. The invention can be effectively apply also to such rolling conditions.

FIG. 21 shows an example of the case where the restricted portions are formed. In this case, a narrowing width changing operation is conducted for the trailing end of the unit slab and, after the completion of the narrowing width changing operation, a widening width changing operation is commenced without delay such as to form a restricted portion on the leading end of the unit slab. The acceleration Δ and the velocity difference ΔV can be determined in this case in the same way as that described before. In addition, the maximum velocity Vmax is determined from the amount ξ of taper of the restricted portion $4b_1$. Other factors such as $Tr_1$, Vp and Th can be set in the same way as that explained before.

(Second Embodiment)

The method of the invention was applied to the production of an ordinary low-carbon Al killed steel conducted by a curved continuous casting machine of 350 t/h capacity having the same specification and operating conditions as those used in the first embodiment. The distance $L_1$ between the upper and lower cylinders was used in place of the length of the narrow face, as in the case of the first embodiment.

Actually, the width changing method of the invention was used for reducing the overall width (2W) of the slab from 1300 mm to 900 mm. In order to minimize the time for changing the width, the initial velocity $B_1$ of the upper end in the forward taper changing period and the initial velocity $B_2$ of the upper end in the rearward taper changing period were selected as follows, in accordance with the formulae (34) and (37) explained before.

$$B_1=\alpha_1 \cdot L_1/Uc \quad (99)$$

$$B_2=\alpha_1 \cdot Tr \quad (100)$$

In this embodiment also, the acceleration α was determined from the cylinder power, because the cylinder cannot provide the acceleration determined by the shell strength. More specifically, referring to FIG. 11, the acceleration was selected to be 50 mm/min$^2$ in order that the required forces Fu and Fl for the upper and lower cylinders are below the cylinder powers Fuu and Fll. Therefore, the velocity difference ΔV was calculated as follows in accordance with the formula (64) which corresponds to the formula (1).

$$\Delta V=\alpha \cdot L_1/Uc=50\times 640/1600=20 \text{ (mm/min)}$$

The accelerations $\alpha_1$ and $\alpha_2$ in the forward and rearward taper changing periods were selected to meet the condition of $\alpha_1=-\alpha_2$, in order to attaing a higher controllability. Therefore, the velocities of the upper and lower cylinders in the forward and rearward taper changing periods are determined as follows.

Forward taper changing in narrowing width change ($0 \leqq t \leqq Tr$)

$$Vuu=20+50t \text{ (mm/min)} \quad (101)$$

$$Vll=50t \text{ (mm/min)} \quad (102)$$

Rearward taper changing in narrowing width change ($Tr \leqq t \leqq tW$)

$$Vuu=50(Tw-t) \text{ (mm/min)} \quad (103)$$

$$Vll=20+50(Tw-t) \text{ (mm/min)} \quad (104)$$

Then the time duration Tr till the turning point was determined in accordance with the following formulae (105) and (106), in view of the formula (60).

$$Tr=0.2\{(1+0.5Q)^{\frac{1}{2}}-1\}\text{(min)} \quad (105)$$

$$Tw=0.4\{(1+0.5Q)^{\frac{1}{2}}-1\}\text{(min)} \quad (106)$$

were, Q represents the commanded width changing amount (narrowing) at each side of the slab expressed in terms of mm.

Substituting Q=400/2=200 to the formulae (105) and (106), tr and Tw were determined to be 1.8 min. and 3.6 min., respectively. Substitutind these values for the formula (85), the velocity $Vuu_1max$ of the upper cylinder at the time of completion of the forward tapering in the earlier half period was calculated as 110 mm/min.

On the other hand, the maximum allowable moving velocity Vmax of the narrow face was determined as follows. In this embodiment, the maximum allowable tapering amount ξmax allowed by the rolling conditions was 0.075, which in turn determines the maximum velocity Vmax as being 120 mm/min. On the other hand, the maximum velocity Vmax determined by the maximum cylinder velocity as a requirement by the narrow face driving device was 100 mm/min., while the maximum allowable pivot angle ζmax of the narrow face was 0.087, which in turn determined the maximum velocity Vmax as 159 mm/min.

In this embodiment, therefore, the maximum allowable moving velocity Vmax of the cylinder was selected to be 100 mm/min, due to restriction from the maximum velocity of the cylinder.

Comparing the maximum velocity Vmax=100 mm/min with the maximum velocity $Vuu_1max=110$ mm/min. at the time of completion of the forward taper changing period, it proved that the translational movement was necessary because the maximum velocity $Vuu_1max$ exceeded the maximum velocity Vmax. In order to determine the pattern of the translational movement which is conducted between the earlier half period (forward taper changing period) and the later half period (rearward taper changing period), the time duration $Tr_1$ of the earlier half period, velocity Vp of translational movement and the time duration Th of the translational movement were determined as follows.

Namely, by using the aforementioned formula (89), the time duration $Tr_1$ was determined as follows.

$$Tr_1=(Vmax-\Delta V_1)/\alpha_1=(100-20)/50=1.6 \text{ (min)}$$

In order to minimize the power require for the driving of the narrow face, the velocity Vp was selected as small as possible, within the ranges which satisfy the conditions of formulae (2) and (3) as follows.

$$Vp \geqq \alpha_1 \cdot Tr_1=50\times 1.6=80 \text{ (mm/min)}$$

The time duration Th was determined as follows in accordance with the formula (96).

$$Th=(1/80)\times(200-100\times 1.6)=0.5 \text{ (min)}$$

The pattern of the translational movement was thus determined.

Figure 22:
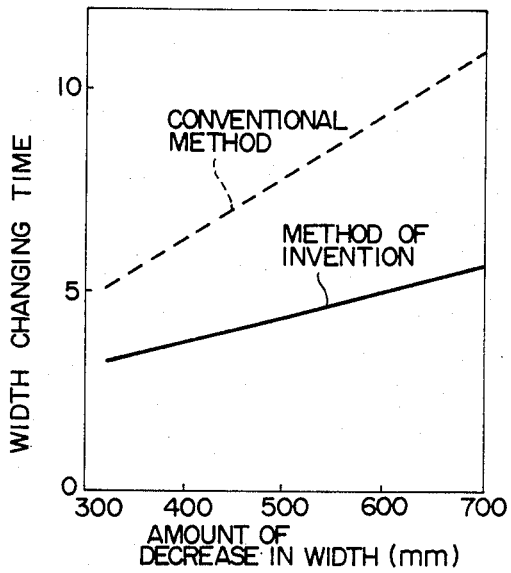
FIG. 22 is a chart showing the relationship between the command width changing amount which is in this case a decremental amount and the time required for the change of the width in the method of the invention, in comparison with that in the conventional method.

In this embodiment, the overall width was changed from 1300 mm to 900 mm. The inventors have conducted experiment in which decremental width changing operation was carried out in the same manner as that described before, with verying width changing amounts. It was confirmed that the employment of the translational movement between the earlier and later half periods is effective when the amount of width change exceeds 320 mm, in the event that the maximum velocity Vmax is 100 mm/min. FIG. 22 shows the time required for the width change in accordance with the invention as required when the commanded width changing amount (width reduction) exceeds 320 mm, as compared with that in the conventional method. In FIG. 22, the full line curve show the embodiment of the invention, while the broken line shows the conventional method. In FIG. 22, the axis of abscissa represents the amount of decrease of the slab width, while the axis of ordinate represents the width changing time Tw.

The conventional process for decreasing the width was carried out by a method shown in FIG. 3. In this case, the air gap was maintained within such a level as would not cause a large casting defect. In order to narrow the slab width maintaining the required force less than 7 tons, the velocity of translational movement could not be increased beyond 35 mm/min.

From FIG. 22, it will be seen that the embodiment of the invention permits a narrow width changing time than the conventional method, regardless of the amount of narrow of the width. It was confirmed also that the effect for shortening the time for decreasing the slab width according to the invention becomes appreciable as the amount of narrow of the width becomes greater.

The invention was carried out also for an incremental width change. It proved that the translational movement of the narrow face was necessary when the changing rate has exceeded 320 mm.

An explanation will be made hereinunder as to a practical example in which the width was widened from 900 mm to 1300 mm.

The velocities Vu and Vl of the upper and lower ends of the narrow face 1 were determined by the formulae (22) to (25), while the velocity patterns of the upper and lower cylinders were determined by the following formulae (107) to (110).

Rearward taper changing period in widening width change ($0 \leqq t \leqq Tr$)

$$Vuu = -50t \text{ (mm/min)} \quad (107)$$

$$Vll = 20 - 50t \text{ (mm/min)} \quad (108)$$

Forward taper changing period in widening width change ($Tr \leqq t \leqq Tw$)

$$Vuu = 20 - 50\,(Tw - t) \text{ (mm/min)} \quad (109)$$

$$Vll = -50\,(Tw - t) \text{ (mm/min)} \quad (110)$$

It has been known that, as explained before, the translational movement is essential when the amount of change in the width exceeds 400 mm. In this case, therefore, the time durations $Tr_1$ and Th were determined as follows, taking into account the translational movement.

Namely, the time duration $Tr_1$ was determined by the aforementioned formula (98) as follows.

$$Tr_1 = V\max/\alpha_1 = (-100)/(-50) = 2 \text{ (min)}$$

The velocity Vp of the translational movement was selected as small as possible within the range which meets the conditions of the formulae (2) and (3), in order to minimize the power required for the driving of the narrow face. Actually, the velocity was selected to meet the following conditions.

$$Vp \geqq \alpha_1 \cdot Tr_1 = -50 \times 2 = -100 \text{ (mm/min)}$$

Th is given as follows by the formula (96)

$$Th = \{1/(-100)\} \times \{-200 - (-80 \times 2)\} = 0.4 \text{ (min)}$$

The time duration Th was determined as follows in accordance with the aforementioned formula (96).

The pattern of width changing operation including the translational movement was thus determined.

Figure 23:
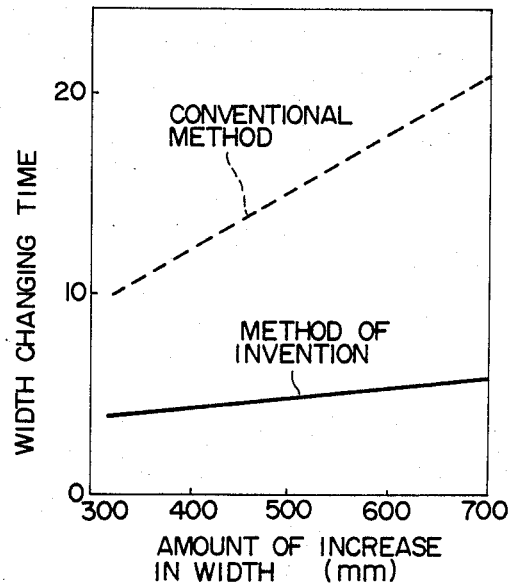
FIG. 23 is a chart showing the time required for changing the slab width in the width changing method of the invention in comparison with that in a conventional method.

FIG. 23 shows the width changing time required by the method of the invention for attaining a width increment over 320 mm, as compared with that required in the conventional method. In this Figure, axis of abscissa represents the amount of widening of the width, while the axis of ordinate represents the time Tw required for completing this width change. The characteristics of the method of the invention and conventional method are shown by a full-line curve and a broken-line curve, respectively.

The incremental width change by the conventional method was carried out in the manner shown in FIG. 4. As in the case of the narrowing width changing operation, the velocity Vm of the translational movement could not be increased beyond 15 mm/min, in order to maintain the air gap below a predetermined allowable value while maintaining the required driving power less than 7 tons. It will be also seen that, in the case of the widening width changing operation, the method of the invention can be remarkably narrowed the width changing time as compared with the conventional method, regardless of the amount of widen of the slab width.

It was confirmed also that the air gap was almost zero and the driving power required for the lower cylinder was less than 7 tons, thus falling within the allowable range as in the case of the narrowing width changing operation.

As has been described in detail, according to the invention, it is possible to change the slab width efficiently and in quite a short period of time, even under various limitations on the moving velocity of the narrow face due to the rolling conditions and the requirements by the driving unit. It is to be understood also that the present invention permits an easy production of unit slab having configurations meeting the requirements by the subsequent rolling. In fact, the method of the invention permits a desired amount of width change within the range of between 1300 and 650 mm while maintaining the air gap and shell deformation resistance, thus ensuring a stable continuous casting without suffering from any cracking and break out of the slab.

Figure 24A:
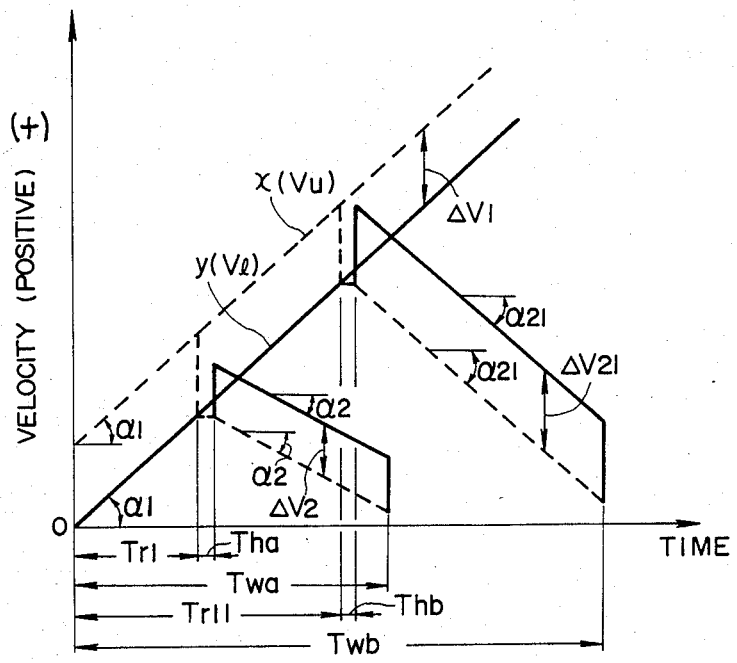
FIGS. 24A and 24B are diagrams showing the velocities of movement of the upper and lower ends of narrow face during width changing operation in accordance with still another embodiment of the invention.
Figure 24B:
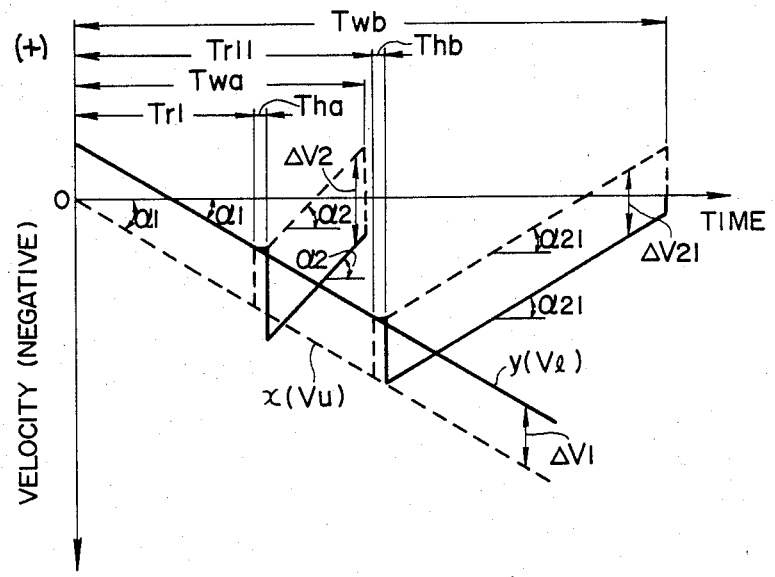

FIGS. 24A and 24B are diagrams similar to those in FIGS. 1 and 14, showing the horizontal velocities of the upper and lower ends of the narrow face during the width changing operation of still another embodiment.

The taper angle $\beta$ of the narrow face in ordinary operation is selected in accordance with the factors such as the slab size, casting speed and so forth. Hereinunder, a term "tapering amount" is used to mean the horizontal distance between the upper of narrow face and a vertical line (two-dot-and-dash line in FIG. 25) passing the lower end of the casting mold. Thus, the tapering amount is $\pm 0$ when the taper angle $\beta$ is 90°. The tapering amount is expressed by a symbol $\kappa$, hereinunder. It will be seen that the tapering amount becomes greater as the slab width gets large. Conversely, when the slab width is small, the tapering amounts gets smaller.

When the width of the slab is changed during the continuous casting, the slab width and, hence, the taper angle $\beta$ of the narrow face are changed between the states before and after the width changing operation. Thus in turn requires the tapering amount $\kappa$ to be changed. If the change of the tapering amount is to be made, for example, after the completion of operation for changing the width, it is necessary take an additional step for changing the tapering amount, besides the operation for changing the width. This causes various inconveniences as will be explained hereinunder. Namely, the control for changing the slab width is made very complicated and troublesome, and the casting tends to be conducted with inadequate tapering amount in the period between the completion of the width changing operation till the completion of the operation for changing the tapering amount. In consequence, the risks of generation of casting defects and possibility of break out are increased. In the case where the tapering amount correcting operation is conducted by moving the mold lower end or both the upper and lower ends simultaneously, there is a large possibility that the actual width changing amount is deviated from the command width changing amount, resulting in an error of the slab width.

It might be possible to determine the width changing operation pattern such that the width changing operation is completed when the command tapering amount is reached. With such a method, however, the width changing operation would be completed before the command width changing amount is reached, causing an error of the actual slab width from the command width. If this error is to be completed after the completion of the width changing operation, it is necessary to translationally move the narrow face. This additional translational driving of the narrow face encounters a large shell deformation resistance in case of a decremental width change and generation of air gap in the case of widening width change; resulting in an unstable continuous casting.

According to the invention, any error with respect to the command width changing amount, attributable to the difference between the tapering amount at the time of start of the width changing operation and the command tapering amount at the time of completion of the width changing operation, can be effectively absorbed during the translational movement in which the upper and lower ends of the narrow face are moved at an equal speed.

Figure 25:
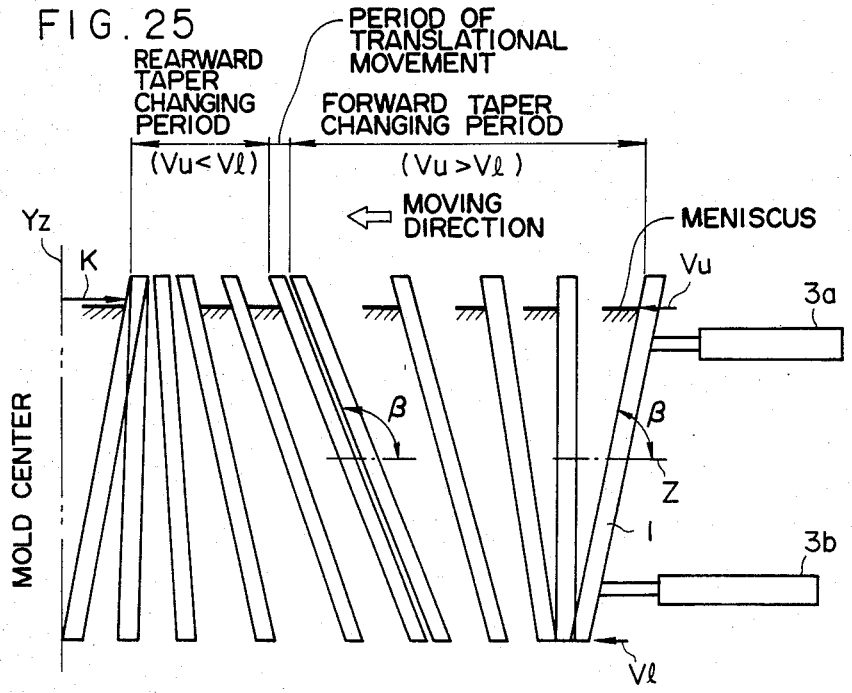
FIG. 25 is a schematic illustration of the movement of the narrow face during decremental width change in accordance with the embodiment shown in FIG. 24A.

FIG. 24A shows an example of the decremental width changing operation. The movement of the narrow face is schematically shown in FIG. 25. In the earlier half period, the velocity Vu of the upper end of the narrow face is maintained higher than the velocity Vl of the lower end by a predetermined value, so that the angle $\beta$ is progressively increased. In consequence, the forward inclination is increased and the tapering amount is decreased. Then, the translational movement in which the upper and lower ends of the narrow face are moved at an equal velocity is started when the center of the narrow face has attained almost a half the command width changing amount. This translational movement is conducted only for a short period which is enough to absorb the error from the command width changing amount attricutable to the difference between the tapering amount at the time of start of the width changing operation and the commanded tapering amount at the time of completion of the width changing operation. After the completion of the translational movement, the operation is switched over to the rearward taper changing period in which, in contrast to the forward taper changing period, the velocity Vu at the upper end of the narrow face is maintained higher than the velocity Vl at the lower end by a constant amount, thus progressively decreasing the inclination angle $\beta$ and, hence, the amount of forward inclination.

On the other hand, the velocities Vu and Vl at the upper and lower ends of the narrow face have a constant accelation which is positive, i.e., which serves to increase the velocity, in the forward taper changing period and which is negative, i.e., which served to decrease the velocity, in the rearward taper changing period, and a predetermined velocity differential $\Delta V$ is maintained between both velocities Vu and Vl. Thus, the amount of forward inclination and the amount of rearward inclination are increased in the forward taper changing period and the rearward taper changing period, respectively.

The acceleration $\alpha$ and the velocity differential $\Delta V$ are zero in the period of the translational movement.

Figure 26:
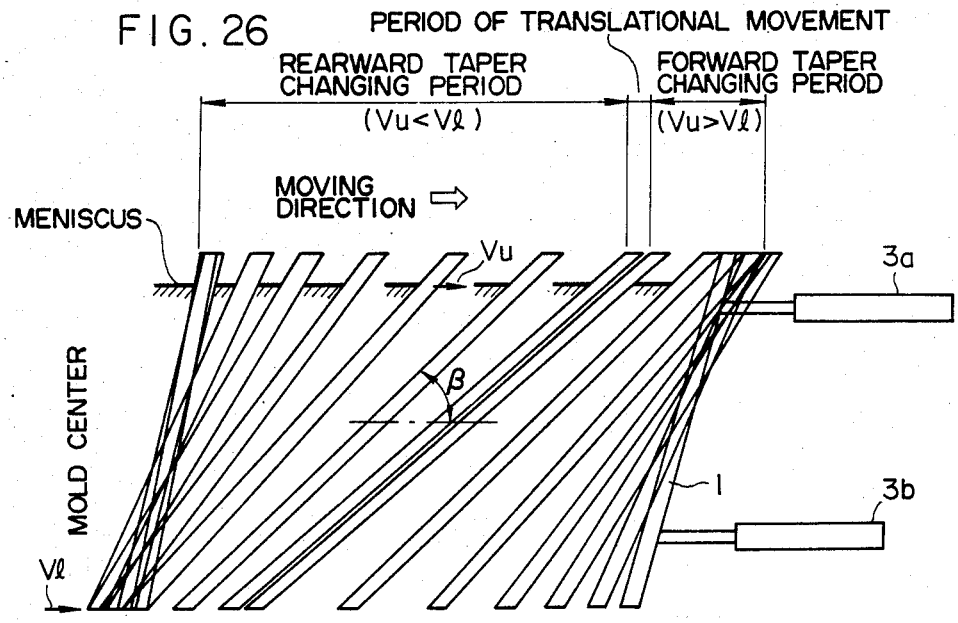
FIG. 26 is a schematic illustration of movement of the narrow face during incremental width change in accordance with the embodiment shown in FIG. 24B.

An explanation will be made hereinunder as to the incremental width changing operation, with reference to FIG. 24 and FIG. 26 which is a schematic illustration.

In contrast to the decremental width changing operation, the incremental width changing operation is conducted by moving the narrow face away from the center of the mold. In the earlier half period, the velocity Vl of the lower end of the narrow face is maintained higher than the velocity Vu of the upper end by a predetermined amount such as to rearwardly incline the narrow face. After a movement over a predetermined distance, the translational movement is conducted in order to absorb the error from the command width changing amount attributable to the difference between the tapering amount at the time of start of the width changing operation and the command tapering amount at the time of completion of the width changing operation. Thereafter, a forward taper changing operation is conducted in which the velocity of the upper end Vu is maintained higher than the velocity Vl of the lower end. In this operation also, the velocities Vu and Vl at the upper and lower ends of the narrow face have a constant acceleration $\alpha$ and a predetermined velocity difference $\Delta V$ is maintained between these velocities, so that the forward inclination amount and rearward inclination amount are increased in both taper changing periods.

Thus, in the described embodiment of the invention, the acceleration $\alpha$ is determined beforehand in accordance with the kind of steel, slab size, casting speed and so forth, using the allowable shell deformation resistance as a parameter, and the velocity differential $\Delta V$ between the velocity Vu at the upper and the velocity Vl at the lower end is determined in accordance with the formula (1). The acceleration and the velocity differential thus determined are maintained both in the forward taper changing period and the rearward taper changing period of the width changing operation. In addition, any error from the commanded width changing amount, attributable to the difference between the tapering amount at the time of commencement of the width changing operation and the commanded tapering amount at the time of completion of the width changing operation, is effectively absorbed in the period of translational movement which is employed intermediate between the forward taper changing period and the rearward taper changing period. With this method, therefore, it is possible to effect the desired width change without any risk of casting defects.

In carrying out the width changing operation using the acceleration $\alpha$ and the velocity differential $\Delta V$ as the controlling factors, assuming here that the tapering amount at the time of completion of the width changing operation is the same as that at the time of commencement of the width changing operation, the timing of switching between the rearward taper changing period and the forward taper changing period is determined by the formulae (59) and (60). As will be clear from the formula (60) in particular, the control is very easy when the condition of $\alpha_1 = -\alpha_2$, so that asn explanation will be made hereinunder as to the method of determination of the timing of switching over, on an assumption that the condition of $\alpha_1 = -\alpha_2$ is met, by way of example.

As has been described, since the slab width differs between the states before and after the width changing operation, the tapering amount is also changed between these two states. The change of the taper amount becomes large particularly when a large width change is attained in a short time in accordance with the method of the invention.

In the conventional width changing method, the tapering amount is changed both in the first and second steps shown in FIGS. 3 and 4, but the taper changing operation for attaining the tapering amount coinciding with the commanded tapering amount is conducted mainly in the third step. Since this taper changing operation is effected by moving the lower end of the narrow face, this taper changing operation inevitably causes an increase in the width changing amount by an amount corresponding to the difference between the command tapering amount and the tapering amount obtained during the translational movement. In order to eliminate this error, methods have been taken such as to finish the translational movement quickly. In the method of the invention, however, it is quite difficult to absorb the error in the forward and rearward taper changing periods because the upper and lower ends of the narrow face move at different velocities in these periods, and, therefore, a suitable measure has to be taken to obviate this problem.

An explanation will be made hereinunder as to a method in which the change of the tapering amount is executed in the course of change in the width changing process such as to absorb the error from the command width changing amount which may be caused by a change in the taper changing amount.

Figure 27:
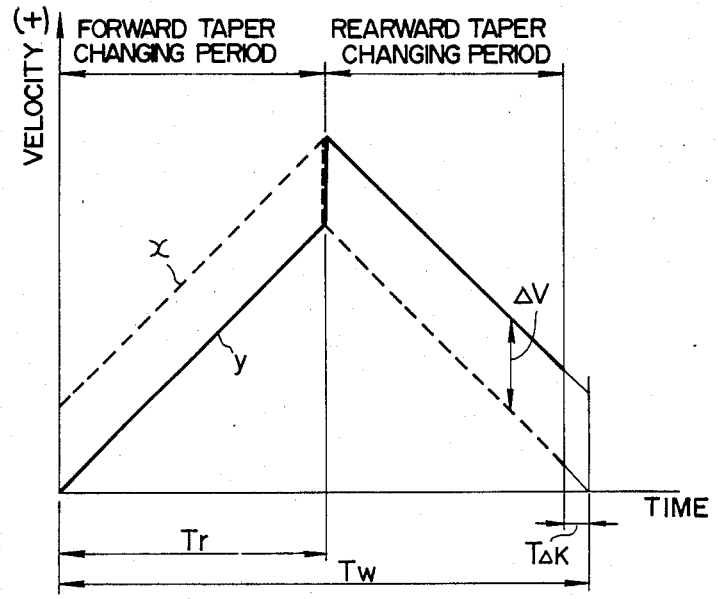
FIG. 27 is a diagram explanatory of the error in the width changing amount attributed to a change in the amount of taper.

It is well known that a large slab width causes a large tapering amount (small inclination angle $\beta$), while a small slab width causes a small tapering amount (large inclination angle $\beta$), due to the contraction of the slab caused by solidification. In the case of a narrowing width changing operation, therefore, the taper changing amount is greater in the earlier half period than in the later half period, so that, if the width changing operation is completed such that the actual tapering amount correctly coincides with the command value, the width changing time inevitably becomes shorter by T which is shown in FIG. 27 and by the following formula (111). Consequently, the width changing amount actually attained is smaller than the command width changing amount by $\Delta W$ which is given by the following formula (112).

$$T\Delta\kappa = (|\kappa_2 - \kappa_0|)/\Delta V \tag{111}$$

$$\Delta W = \int^{TW} Vl_2 \cdot dt = (\tfrac{1}{2}) \cdot \alpha \cdot (T\Delta\kappa)^2 + \Delta V \cdot T\Delta\kappa \tag{112}$$

In the case of an incremental width changing operation also, the taper changing amount is greater in the rearward taper changing period than in the earlier taper changing period, so that, if the width changing operation is completed such that the final tapering amount coincides with the command value, the width changing time becomes shorter by $T\Delta\kappa$ as in the case of the formula (111) mentioned before. Consequently, the final width changing amount becomes smaller than the command width changing amount by $\Delta W$ which is determined by the following formula (113).

$$\Delta W = \int^{TW} Vl \cdot dt = (\tfrac{1}{2}) \cdot \alpha \cdot (T\Delta\kappa)^2 \tag{113}$$

Symbols appearing in formulae (111) to (113) represent the following factors:

$\kappa_2$: commanded tapering amount at the time of completion of width change (mm)

$\kappa_0$: tapering amount at the time of commencement of width change (mm) $\Delta V$: velocity difference between upper and lower ends of narrow face (mm/min) $\alpha$: acceleration of upper and lower ends of narrow face (mm/min$^2$)

$Vl_2$: moving velocity of narrow face in later half period (rearward taper changing period in narrowing width change and forward tapering period in widening width change) (mm/min)

Tw: width changing time (min)

The amount $\Delta W$ determined by the formulae (112) and (113) corresponds to the error from the command width changing amount attributable to the difference between the tapering amount at the time of commencement of the width changing operation and the command tapering amount at the time of completion of the width changing operation. According to the invention, the above-mentioned error is absorbed by the translational movement which is conducted between the forward taper changing period and the rearward taper changing period. The time duration for the translational movement required for absorbing the error is given by the following formula (114).

$$Th = \Delta W / Vul \tag{114}$$

where, Vul represents the moving velocity of the narrow face during the translational movement (mm/min).

Figure 28:
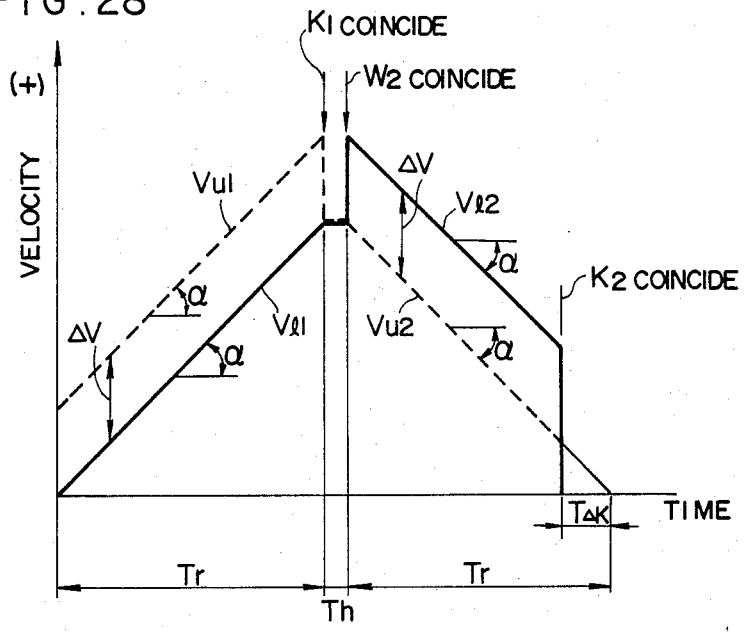
FIG. 28 is a diagram showing an example of decremental width change.
Figure 29:
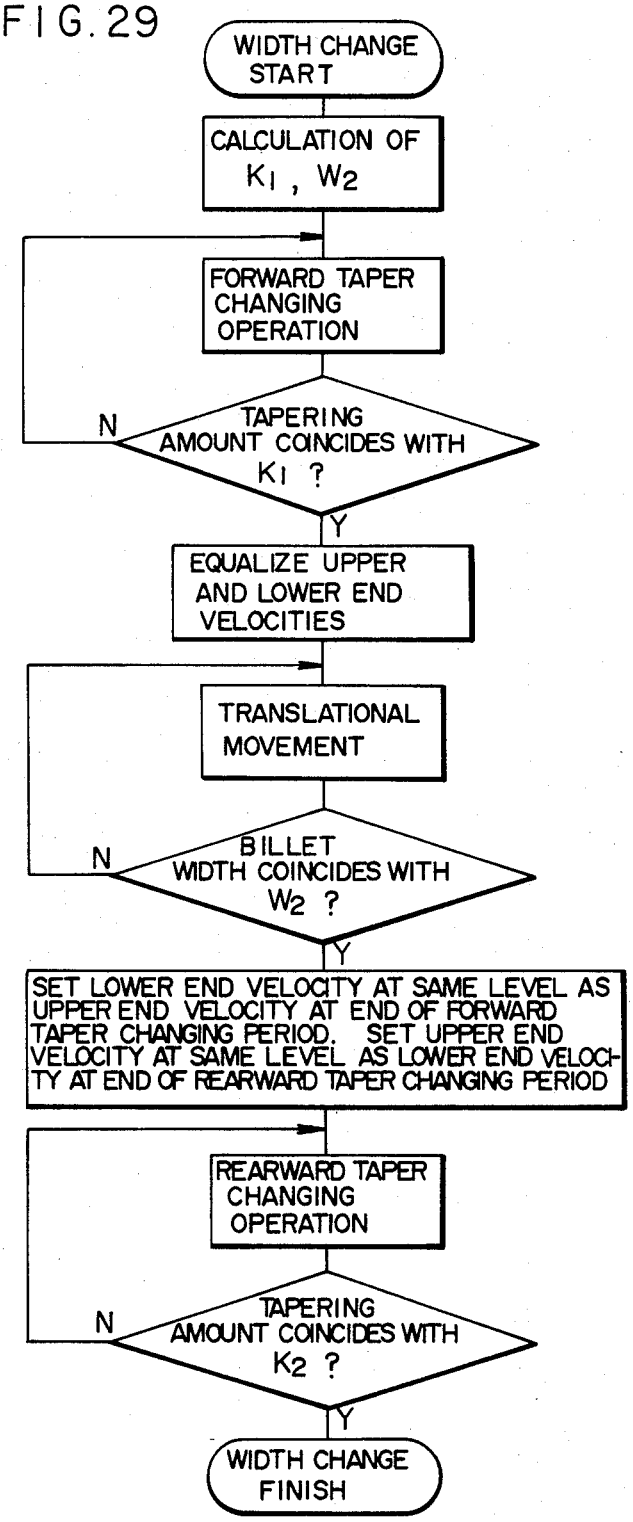
FIG. 29 is a block diagram of an example of a practical control means for decremental width change.

An example of the practical controlling method for controlling the translational movement for the purpose of absorbing the above-mentioned error will be explained in connection with a narrowing width changing operation illustrated by the diagram in FIG. 28 and the block diagram in FIG. 29.

As the first step, the tapering amount $\kappa_1$ at the time of completion of the forward taper changing operation and the slab width $W_2$ (half of whole slab width) at the time of completion of the translational movement are determined in accordance with the formulae (115) to (117).

$$Tr=(\tfrac{1}{2}\alpha)\cdot[\{\Delta V^2+4\alpha(|W_3-W_0|)\}^{\frac{1}{2}}-\Delta V] \quad (115)$$

$$\kappa_1=-\Delta V\cdot Tr+\kappa_0 \quad (116)$$

$$W_2=W_3+\{(\tfrac{1}{2})\cdot\alpha(Tr^2-T\Delta\kappa^2)+\Delta V\cdot(Tr-T\Delta\kappa)\} \quad (117)$$

where, $W_0$: (slab width before width change)$\times\frac{1}{2}$ (mm)

$W_3$: (command slab width after width change)$\times\frac{1}{2}$ (mm)

$\kappa_0$: tapering amount before width change (mm)

After the determination of $\kappa_1$ and $W_2$, the forward taper changing operation is commenced with the previously determined acceleration $\alpha$ and the velocity difference $\Delta V$ constant. This forward taper changing operation is continued until the tapering amount reaches $\kappa_1$. When the tapering amount $\kappa_1$ is reached, the moving velocities of the upper and lower ends of the narrow face are equalized thus starting the translational movement. The velocity of this translational movement can be selected as desired to range between the velocity $Vu_1$ of the upper end of the narrow face and the velocity $Vl_1$ of the lower end of the same, at the time of completion of the forward tapering period. In the described embodiment, the velocity of the translational movement is selected to be equal to the velocity $Vl_1$ of the lower end.

The translational movement is conducted until the slab width reaches $W_2$. The rearward taper changing operation is commenced immediately after the slab width $W_2$ is reached. In the rearward taper changing period, the acceleration $\alpha_2$, having the same absolute value as the acceleration $\alpha_1$ and opposite direction ($|\alpha_1|=|\alpha_2|$), is maintained. Namely, the velocity $Vu_2$ of the upper end of the narrow face immediately after the commencement of the rearward taper changing operation is equal to the velocity $Vl_1$ of the lower end of the narrow face at the time of completion of the forward taper changing operation, while the velocity $Vl_2$ of the lower end is selected to be equal to the velocity $Vu_1$ of the upper end at the time of completion of the forward taper changing operation. The constant acceleration $\alpha$ and the constant velocity difference $\Delta V$ are maintained throughout the rearward taper changing period. As a result, the tapering amount at the time of width changing is gradually recovered and the width changing operation is finished when the tapering amount has reached the command tapering amount $\kappa_2$.

As has been described, in this second embodiment of the invention, the tapering amount $\kappa_1$ at the time of completion of the forward taper changing period and the slab width $W_2$ at the time of completion of the translational movement are selected taking into account the error attributable to the difference $\Delta W$ and the computation error which may be caused in the course of computation in accordance with the formulae (115) to (117), so that the error from the commanded width changing amount is effectively absorbed by the translational movement intermediate between the forward and rearward taper changing periods.

(Third Embodiment)

The method of the invention was applied to a process for producing ordinary low-carbon Al killed steel carried out by a curved continuous casting machine having 350 t/h capacity. The specification and operating condition of this continuous casting machine are shown in Table 6.

An example will be explained hereinunder as to an example of a narrowing width changing operation in which the slab width was decreased from 1200 mm to 1000 mm. This width change requires that the tapering amount is changed from 8 mm to 5 mm.

TABLE 6

| | |
|---|---|
| Casting velocity (Uc) | 1600 mm/min |
| Cylinder power (Fa) | 10 tons |
| Slab width (W) | 1300–650 mm |
| Tapering amount (K) | 9–4 mm |
| Static pressure of molten metal acting on narrow face (Fg) | 1.5 tons |
| Sliding resistance (Fm) | 1.5 tons |
| Distance between cylinders ($L_1$) | 640 mm |
| Length of narrow face (L) | 800 mm |
| Distance between upper end of narrow face and upper cylinder (j) | 60 mm |

A computation was made in the same way as the first embodiment. On an assumption that the tapering amount at the time of commencement of the width changing operation and the tapering amount at the time of completion of the width changing are the same, the width changeing time Tw and a half of the time Tw, i.e., the time duration Tr of the forward taper changing period was computed as the following formulae (118) and (119), in accordance with the formula (115) which corresponds to the formula (60).

$$Tr = 0.2 \times \{(1 + 0.5 \times 100)^{\frac{1}{2}} - 1) = 1.23 \text{ (min)} \quad (118)$$

$$Tw = 0.4 \times \{(1 + 0.5 \times 100)^{\frac{1}{2}} - 1) = 2.46 \text{ (min)} \quad (119)$$

The error from the commanded width changing amount produced by the difference of the tapering amount between the states before and after the width changing operation for each side of the slab was computed to be 3.135 mm as the following formulae (120) and (121) in accordance with the aforementioned formulae (120) and (121). Assuming here that the velocity of the translational movement is equal to the velocity of the lower cylinder at the time of completion of the forward taper changing period, the time duration Th of the translational movement is calculated as the following formula (122) in accordance with the formula (114).

$$T\Delta\kappa = (640/800) \times (|5 - 8|)/20 = 0.12 \text{ (min)} \quad (120)$$

$$\Delta W = (\tfrac{1}{2}) \times 50 \times 0.12^2 + \{1 + (100/640)\} \times 20 \times 0.12 = 3.135 \text{ (mm)} \quad (121)$$

$$Th = 3.135/(50 \times 0.12) \quad (122)$$

-continued $$= 0.05 \text{ (min)}$$

The tapering amount at the end of the forward taper changing period and the half slab width at the end of the translational movement are calculated as the following formula (123) and (124), in accordance with the aforementioned formula (116) and (117).

$$\kappa_1 = -(800/640) \times (20 \times 1.23) + 8 \quad (123)$$

$$= -22.75 \text{ (mm)}$$

$$W_2 = 500 + [(\tfrac{1}{2}) \times 50 \times (1.23^2 - 0.12^2) + \{1 + (100/640)\} \times 20 \times (1.23 - 0.12)] \quad (124)$$

$$= 563.13 \text{ (mm)}$$

As stated before, the width changing operation of commenced with the velocities Vu and Vl of the upper and lower ends set at suitable levels, and the narrow face is moved and inclined forwardly until the tapering amount comes equal to $\kappa_1$. Then, the velocity of the upper cylinder and the velocity of the lower cylinder are equalized such as to drive the narrow face translationally until the slab width comes equal to $W_2 \times 2$. Subsequently, rearward taper changing operation is carried out with the velocity of the lower cylinder maintained at the same level as the velocity of the upper cylinder at the end of the forward taper changing period, such as to rearwardly inclne the narrow face, thus effecting a narrowing width change.

An explanation will be made hereinunder as to an example of incremental width change, in which the slab width was increased from 1000 mm to 1200 mm. In this case, it is necessary to change the tapering amount from 5 mm to 8 mm. As in the case of the decremental width change, the velocities Vuc and Vlc of the upper and lower ends of the narrow face were determined in accordance with the formulae (44) and (50), and the velocity patterns for the upper and lower cylinders are determined in accordance with the following formulae (125) to (128).

Rearward tapering period in incremental width change ($0 \leqq t \leqq Tr$)

$$Vuc = -50t \text{ (mm/min)} \quad (125)$$

$$Vlc = 20 - 50t \text{ (mm/min)} \quad (126)$$

Rearward taper changing period in incremental width change ($Tr \leqq t \leqq Tw$)

$$Vuc = 20 - 50(Tw - t) \text{ (mm/min)} \quad (127)$$

$$Vlc = -50(Tw - t) \text{ (mm/min)} \quad (128)$$

Assuming here that the tapering amount at the beginning of the width changing operation is the same as that at the end of the same, the width changing time Tw and the time duration Tr of the rearward taper changing period are given by the following formulae (129) and (130).

$$Tr = 0.2 \times \{(1 + 0.5 \times 100)^{\frac{1}{2}} + 1\} \quad (129)$$

$$= 1.63 \text{ (min)}$$

$$Tw = 0.4 \times \{(1 + 0.5 \times 100)^{\frac{1}{2}} + 1\} \quad (130)$$

-continued $$\doteq 3.26 \text{ (min)}$$

The error from the command width changing amount attributable to the difference in the tapering amount between the beginning and end of the width changing operation is computed as being 0.735 mm as the following formulae (131) and (132) in accordance with the aforementioned formulae (111) and (113). Then the time duration Th of translational movement was determined as the following formula (133) in accordance with the aforementioned formula (114).

$$T\Delta\kappa = (640/800) \times (8 - 5)/20 \quad (131)$$

$$= 0.12 \text{ (min)}$$

$$\Delta W = (\tfrac{1}{2}) \times 50 \times 0.12^2 + (100/640) \times 20 \times 0.12 \quad (132)$$

$$= 0.735 \text{ (mm)}$$

$$Th = 0.735/(50 \times 1.63 - 20) \quad (133)$$

$$= 0.01 \text{ (mm)}$$

Figure 30:
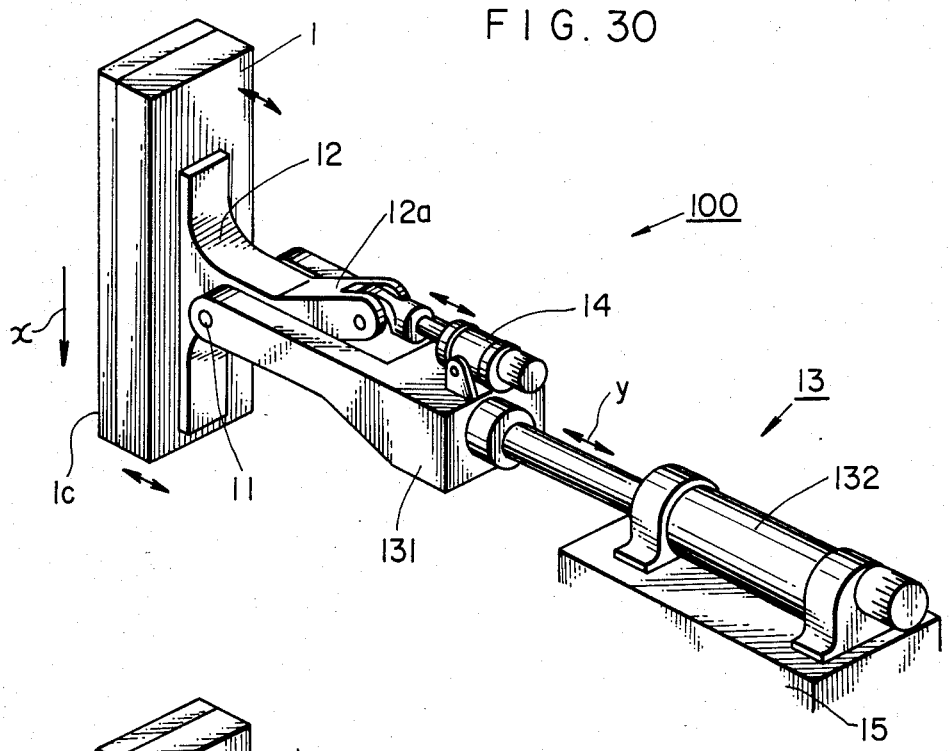
FIGS. 30 to 33 are perspective views of different examples of mold used in carrying out the method of the invention.

FIG. 30 is a perspective view of an embodiment of the casting mold suitable for use in carrying out the present invention. This is an improvement in the single spindle type driving device as shown in FIG. 7. It is true that the driving device of the type mentioned above can effect the width change in accordance with the invention provided that it can control the velocities Vu and Vl of the upper and lower ends at predetermined levels. In this driving device, however, since the center of rotation of the narrow face 1 is fixed at the center of the spherical seat 5, the upper or lower end of the narrow face offsets in the direction of casting due to inclination of the narrow face 1 as a result of the movement away from the spherical seat 5, when the width changing speed is selected to be too large or when the narrow side 1 moves forwardly in the width decreasing direction. In particular, in the case of curved casting mold which is becoming popular in recent years, a gap is formed between the broad face and the narrow face as a result of the offset mentioned above. In consequence, molten steel flows into the gap so that insufficient solidification takes place near the corners where the stress tends to be concentrated, resulting in casting defect. For these reasons, with the single spindle type driving device mentioned above, it has been diffiuclt to adopt a large taper changing amount. This in turn limits the increase in the width changing speed.

The present invention provides in its another aspect a casting mold equipement which can effectively carry out the width changing method explained before, thereby overcoming the above-described problems of the known casting mold equipment explained above.

Figure 31:
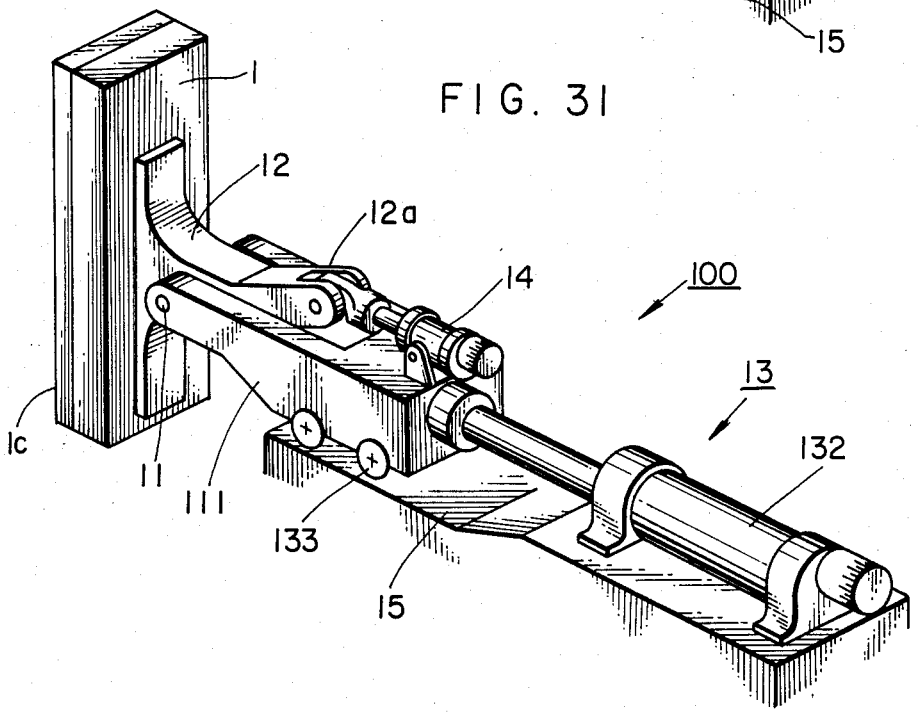

Referring to FIG. 30, a reference numeral 11 designates a rotary shaft which orthogonally crosses the casting direction x and the direction y of transverse movement of the narrow face 1. In this specification, the term "transverse movement" is used to mean a movement in the direction parallel to the horizontal axis. A reference numeral 12 denotes a bearing portion which bears the rotary shaft 11 at a centroid point on the rear side of the narrow face 1 where the total reactional force acting on the narrow face 1 is concentrated. A reference numeral 13 designates a horizontal driving device which is connected to the rotary shaft 11. The horizontal driving device 13 is rotatably connected to the rotary shaft 11 and is composed of a connector portion 131 which carries a later-mentioned rotary driving device 14 and a cylinder device 132 which drives the connector portion 131 back and forth. The cylinder device 132 is fixed to a columnar structure such as a mold traverse and a oscillation table. Thus, the narrow face 1 is connected to the horizontal driving device 13 through a rotary shaft 11, and is adapted to be moved transversely by the cylinder device 132 while being held in the casting direction. FIG. 31 shows another embodiment of the invention. FIG. 31 shows another embodiment of the mold apparatus in accordance with the invention. In this embodiment, the connector portion 131 is provided with wheels 133 adapted to run on the column 15 so that the narrow face 1 is held and supported more stably during the width changing operation.

Figure 32:
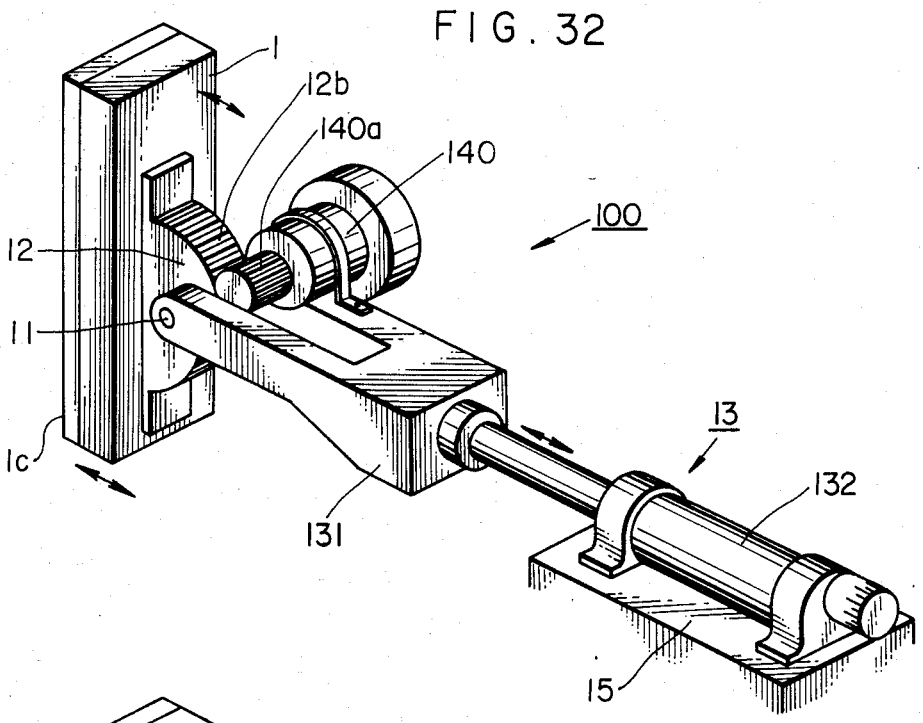

The rotary driving device 14 is mounted on the connector portion 131 of the horizontal driving device 13, so that the narrow face 1 can be rotated through the bearing 12. The embodiment shown in FIGS. 30 and 31 are provided with a rotary arm 12*a* on the bearing 12, and the end of the rotary driving device 14 is rotatably connected to the rotary arm 12*a*. The arrangement is such that, as the rotary driving device is operated, the bearing portion 12 is rotated about a fulcrum constituted by the rotary shaft 11, thereby rotating the narrow face 1. FIG. 32 shows another example of the rotary driving device used in the equipments of the invention. In this case, gear teeth are formed on the outer peripheral surface of the bearing portion 12. The rotary driving device 140 is mounted on the horizontal driving device 13 and has gear teeth 140*a* meshing with the gear teeth 12*b*. The arrangement is such that, as the rotary driving device 140 is driven, the gear 140*a* rotates so that the gear 12*b* meshing with the gear 140*a* rotates thereby rotating the narrow face 1.

The rotary motion can be made regardless of the transverse movement of the narrow face 1 because the rotary driving devices 14 and 140 are carried by the horizontal driving devices 13.

Thus, the mold apparatus of the invention has a driving mechanism which is constituted by a bearing portion which supports the rotary shaft on the rear side of the narrow face, a rotary driving device for rotationally driving the bearing portion, and a horizontal driving mechanism 100 for driving the bearing portion transversely.

Figure 33:
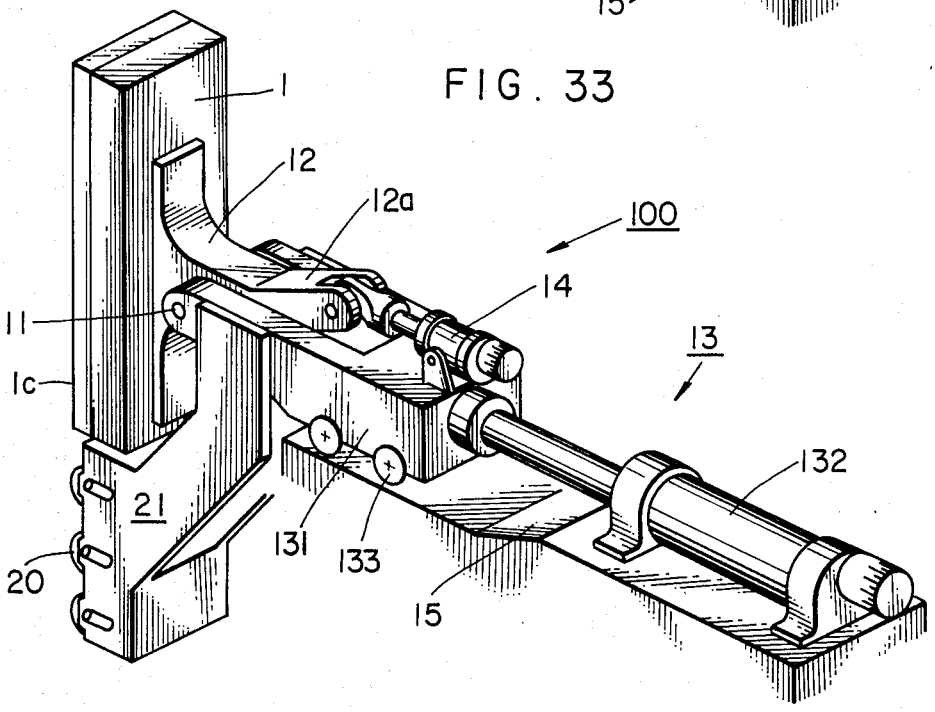

As shown in FIG. 33, the mold equipment of the invention can have a side roll carrier 21 secured to the connector portion 131 of the horizontal driving device 13 and carrying side rolls 20 which in turn support the slab 4 at the lower side of the narrow face 1. With this arrangement, it is possible to drive both the narrow face 1 and the side roll surface independently of each other, thus enabling the side roll surface of the narrow face 1 constant regardless of the taper of the narrow face 1. Consequently, the driving power of the horizontal driving device can be reduced as compared with the conventional mold apparatus in which the narrow face and the side roll carrier 21 are constructed integrally with each other.

Figure 34:
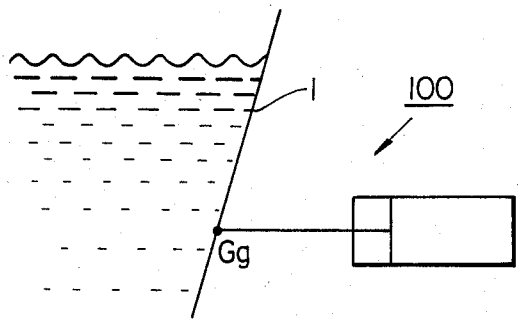
FIG. 34 is an illustration of the concept of driving mechanism for the mold used in the embodiment explained in connection with FIGS. 30 to 33.

As has been described, according to the invention, the rotary shaft 11 is supported at the rear portion of the narrow face 1 in the area near the centroid point to which the total reactional force acting on the narrow face 1 is concentrated. FIG. 34 shows the concept of this supporting structure. The reactional force acting on the narrow face during the width changing operation is the sum of forces produced by various factors such as the static pressure of the molten steel, deformation resistance of the solidification shell, friction resistance on the sliding surfaces between the narrow and broad face. Thus, a large reactional force is exerted on the narrow face when the same is moved overcoming these forces. In FIG. 34, a symbol Gg represents the balancing point among the above-mentioned forces is applied seemingly. Many experiments conducted by the present inventors showed that, by positioning the rotary shaft 11 on the Gg, it is possible to minimise the power of the rotary driving device 14, 140 for rotationally driving the narrow face 1, thus achieving a highly accurate control of rotation of the narrow face.

In ordinary mold equipment, the centroid Gg is positioned substantially at a point which is located at a distance equal to about $\frac{2}{3}$ of the length of the narrow face as measured from the narrow face, as shown in FIG. 34. Actually, however, the position of the point Gg is fluctuated under the influence of various factors. Factors which influence upon the position of the centroid are: direction of the static pressure of the molten steel that direction are changed by narrowing and widening, distribution of the shell deformation resistance and the static pressure of the molten steel, variation of the frictional resistance between the narrow face and the broad face attributable to the difference in the expansion of the mold which in turn varies depending on the mold cooling method, and so forth. The position of the Gg can be determined in consideration of these factors and operating conditions.

Experiment showed that a practically satisfactory rotation control can be carried out by selecting the position of the Gg within the region of between 750 to 800 mm, when a mold equipment having a length of 900 mm and provided with a side roll carrier of 500 mm long is operated at a casting velocity of 1.2 to 1.8 m/min and with the molten steel level of about 100 mm as measured from the top of the mold.

According to the invention, since the rotary shaft 11 is positioned very closely to the inner surface 1*c* of the narrow face, the offsets of the upper and lower ends of the narrow face in the casting direction are substantially eliminated. This in turn permits the taper changing amount to be increased largely and, hence, to remarkably increases the width changing speed.

(Fourth Embodiment)

A width changing operation was conducted by using a 350 t/h type continuous casting machine incorporating the mold apparatus shown in FIG. 30.

The specification and operating conditions of this continuous casting machine are shown in Table 7 below. An electric-hydraulic stepping cylinder having a large thrust capacity of 20 tons was used as the horizontal driving device 13, while an electric-hydraulic stepping cylinder having a smallthrust capacity of 5 tons was used as the rotary device 14. It was confirmed that the invention of this application permits a change $\Delta\phi$ in the tapering amount up to $\pm 300$ mm, which in turn afforded about 40 to 50% shortening of the whole period required for the width changing as compared with the conventional mold equipment.

TABLE 7

| | | |
|---|---|---|
| Casting speed | 1600 mm/min | |
| Slab width | 1300–580 mm | |
| Slab thickness | 250 mm | |
| Mold length | 900 mm | |
| Position of rotary shaft | 750 mm | from upper end of narrow face |
| Power of horizontal driving cylinder | 20 tons | |
| Power of rotary driving cylinder | 5 tons | |

Figure 35A:
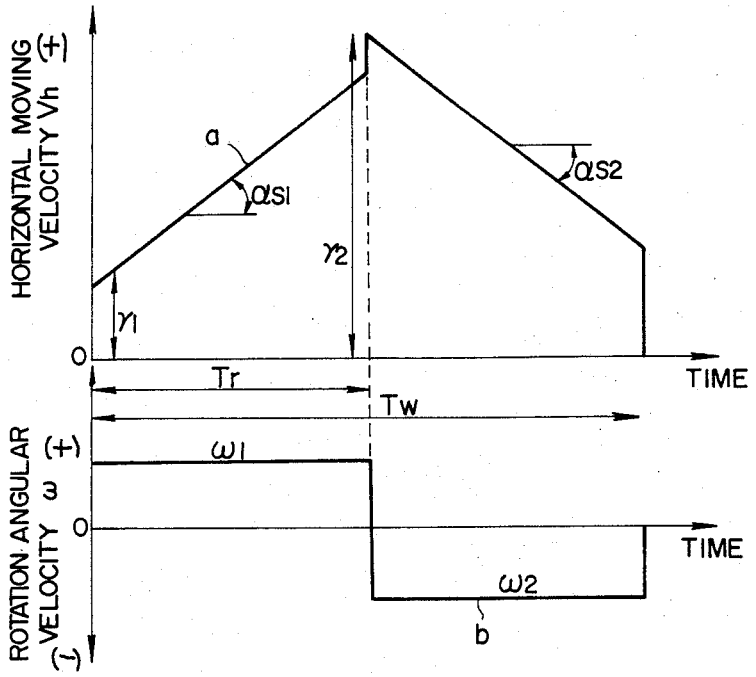
FIGS. 35A and 35B are diagrams showing the manners in which the horizontal moving velocity and angular velocity of the narrow face are changed in relation to the time from the commencement of width changing operation in accordance with a further embodiment of the invention.
Figure 35B:
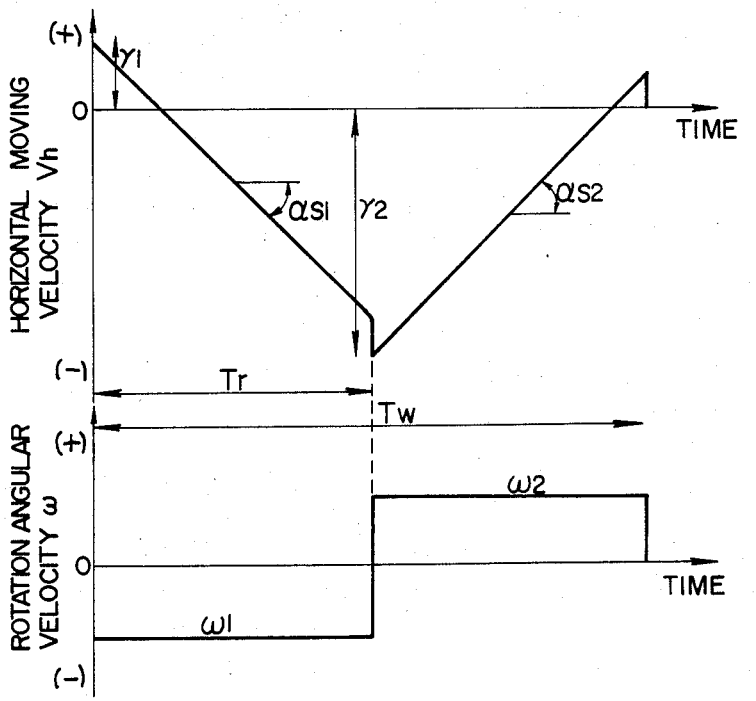

FIGS. 35A and 35B show still another embodiment of the mold equipment in accordance with the invention. These Figures are diagrams illustrating the velocities of horizontal movement and rotational movement of the narrow face as observed when width changing operation is conducted by means of the mold equipment shown in FIGS. 30 to 33, i.e., a mold equipment having the horizontal driving device (referred to simply as "driving device", hereinunder) and a rotary driving device (referred to simply as "rotary device", hereinunder) capable of operating independently of the driving device. The characteristics in the decremental width changing operation is shown in FIG. 35A, while the characteristic shown in FIG. 35B are for the incremental width changing operation. The velocity towards the mold center is expressed as being positive (plus), while the velocity away from the mold center is expressed by minus (−). The rotation speed is expressed in terms of the angular velocity $\omega$ of the rotary device. The direction of angular velocity for increasing the angle $\beta$ of inclination, i.e., the direction which makes the narrow face incline towards the mold center, is expressed as being positive (+), while the direction of angular velocity which makes the inclination angle $\beta$ smaller, i.e., making the narrow face incline away from the mold center, is expressed as being negative (−).

The explanation will be made first as to the case of decremental width changing operation, with specific reference to FIG. 35A.

In this Figure, full line a expresses horizontal moving velocity Vh of the narroow face, while full line b shows the angular velocity $\omega$ of the rotary device. In the decremental width changing operation, the narrow face is moved towards to center of the mold. In the earlier half period, the narrow face is inclined forwardly and, when almost a half of the width changing has been attained, a rearward taper changing operation is commenced without any period of translational movement between the forward and rearward taper changing periods, thus completing one cycle of width changing operation. The velocity Vh of the narrow face in the width changing operation has a constant acceleration $\alpha s$ which is positive, i.e., serves to increase the velocity towards the mold center, in the forward taper changing period and is negative, i.e., serves to decrease the velocity towards the mold center, in the rearward taper changing period. Thus, the horizontal moving velocity is increased and decreased in the forward and rearward taper changing periods, respectively, as the time elapses. The acceleration $\alpha s$ is determined by using the allowable sheel deformation resistance as a parameter, as in the case explained before.

In the forward taper changing period, the narrow face is roated at a constant positive angular velocity which is given by the following formula (4)

$$\omega = \alpha s / Uc \qquad (4)$$

where, $\omega$: angular velocity of rotary device (rad/min)

$\alpha s$: acceleration of horizontal moving velocity of narrow face (mm/min$^2$)

Uc: casting speed (mm/min)

As a result, the angle $\beta$ of inclination of the narrow face 1 and, hence, the amount of forward inclination are gradually increased. Conversely, in the rearward taper changing period, the narrow face is rotated at constant negative angular velocity $\omega$ so that the angle $\beta$ of inclination and, hence, the amount of forward inclination, are progressively decreased.

In FIG. 35A, the acceleration and angular velocity in the forward taper changing period are expressed by $\alpha s_1$ and $\omega_1$, respectively, while the acceleration and angular velocity in the rearward taper changing period are represented by $\alpha_{s2}$ and $\omega_2$, respectively. The turning point at which the operation is switched from the forward taper changing period to the rearward taper changing period is represented by Tr, while Tw represents the whole time required for completing the width changing operation.

The incremental width changing operation will be explained hereinunder with reference to FIG. 35B. For increasing the width, the narrow face has to be moved away from the mold center, unlike the case of the decremental width change. In the earlier half period of operation, the narrow face is moved horizontally at horizontal moving velocity which has a constant acceleration $\alpha s$ while being rotated at a negative constant angular velocity $\omega$ such as to be inclined rearwardly. After a predetermined distance has been travelled by the narrow face, the operation is switched to the forward taper changing operation in which the narrow face is rotated at a predetermined positive angular velocity. In this incremental width changing operation also, the horizontal moving velocity has the acceleration $\alpha s$ such as to be increased or decreased as the time elapses.

In FIGS. 35A and 35B, there is a slight difference in the horizontal moving velocity Vh between the earlier and later half periods of the width changing operation. This is attributed to the offset of the pivot of rotation of the shorter mold wall from the center of the same ($l_1 > l_2$), as will be explained later in connection with FIG. 36. When the pivot is located substantially on the center of the narrow face, i.e., if the condition of $l_1 = l_2$ is met, the above-mentioned difference in the velocity is eliminated and the forward or rearward taper changing operation in the later half period is commenced at the velocity Vh which is the same as that at the end of the earlier half period.

Thus, according to the invention, the acceleration $\alpha s$ is beforehand selected in accordance with the factors such as the kind of steel, slab size, casting speed and so forth, using the alowable shell deformation resistance as a parameter, while the angular velocity $\omega$ of the rotary device is determined in accordance with the formula (2). The width changing operation is carried out by maintaining constant acceleration and angular velocity in each of the forward and rearward taper changing periods. With this arrangement, it is possible to attain various advantages which will be explained later.

An explanation will be made hereinunder as to the reason why an efficient width changing operation can be carried out by using the acceleration $\alpha$ and the angular velocity $\omega$ as the controlling factors.

As explained before, for attaining a high width changing speed, it is necessary to maintain a suitable shell deformation rate by the narrow face in such a manner as to avoid any excessive shell deformation rate and eliminating any air gap which may be formed between the slab and the narrow face throughout the period of the width changing operation.

Figure 36:
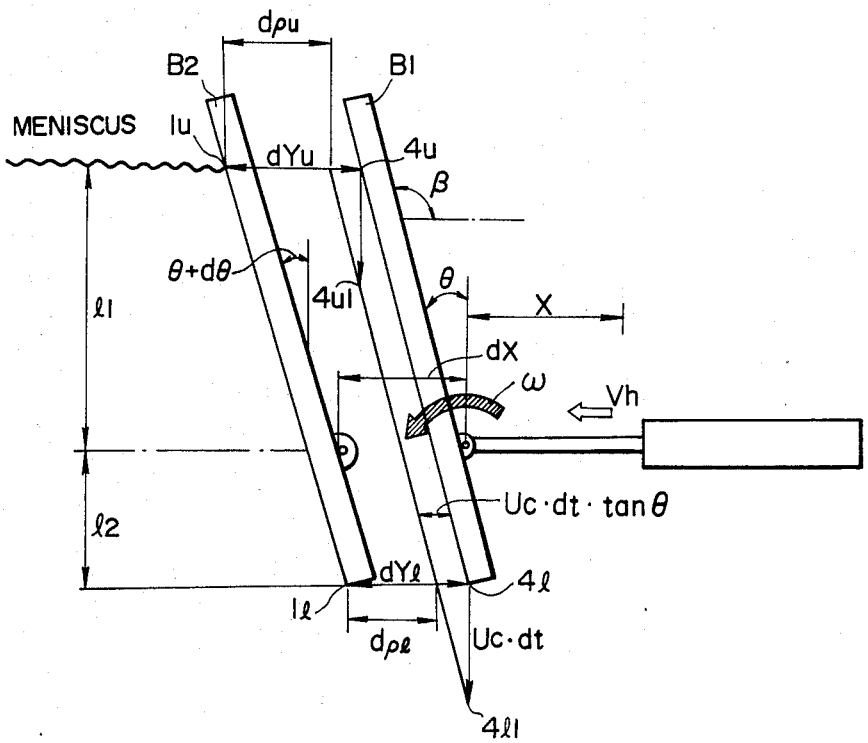
FIG. 36 is an illustration of the concept of movement of the narrow face and deformation of the slab.

FIG. 36 is a view similar to FIG. 8 and shows the relative movement between the slab and the narrow face caused by a movement of the narrow face driven by the driving device shown in FIG. 30 during a continuous casting.

An explanation will be made with specific reference to FIG. 36 as to the strain which is caused in the slab as a result of a width changing operation. In FIG. 36, a numeral 1*u* represents the upper end of the narrow face corresponding to the meniscus, while 1*l* represents the lower end of the narrow face. A symbol $\beta$ represents the angle of inclination of the narrow face with respect to the horizontal line z, while $\theta$ represents the angle of inclination of the same with respect to the vertical line ($\theta=\beta-90°$).

It is assumed here that the narrow face 1 is positioned at a point B1 at a moment t and moves to a point B2 in a unit time dt. The horizontal moving velocity and the angular velocity in this unit time are expressed by Vh and $\omega$, respectively. It is assumed also that the upper and lower ends of the narrow face travel distances dYu and dYl, respectively, in this unit time. The slab 4*u* which is located at the same position as the upper end 1*u* is moved to a position $4u_1$ in the unit time dt, while the slab $4l_1$ which is located at the same position as the lower end 1*l* moves to the position $4L_1$ in the unit time dt. The travel distance can be expressed by Uc.dt.

As a result of the movement of the narrow face from the position $B_1$ to $B_2$, the slab is seemingly deformed by dYu and dYl at the upper and lower ends. Actually, however, the slab is moved downwardly by a distance [Uc.dt], so that the deformation of the slab is suppressed by an amount corresponding to the horizontal component of the slab movement which is expressed by [Uc.dt. tan $\theta$]. Representing the actual amounts of deformation of the slab at the meniscus portion and at the lower end of the narrow face by $\rho u$ and $\rho l$, respectively, these amount are given by the following formulae (134) and (135) similar to the formulae (7) and (8), respectively.

$$d\rho u = dYu - Uc\cdot dt\cdot\tan\theta \quad (134)$$

$$d\rho l = dYl - Uc\cdot dt\cdot\tan\theta \quad (135)$$

Representing the horizontal displacement of the narrow face by X and assuming that the inclination angle of the narrow face is changed by d$\theta$ in the unit time dt, the travels dYu and dYl are given by the following formulae (136) and (137).

$$dYu = l_1\cdot\tan(\theta+d\theta)+dX-l_1\cdot\tan\theta \quad (136)$$

$$dYl = -l_2\cdot\tan(\theta+d\theta)+dX-(-l_2\cdot\tan\theta) \quad (137)$$

where, $l_1$: distance (mm) from upper end 1*u* of narrow face t$\theta$ driving device (shaft 11 shown in FIG. 31)

$l_2$: distance (mm) from lower tu 1*l* of narrow face and driving device (shaft 11 shown in FIG. 31)

Since the angle $\theta$ is actually small, the following approximating formula is established.

$$\tan\theta \approx \theta \quad (138)$$

The following formulae (139) and (140) are obtained by substituting the formula (138) for the formulae (136) and (137), while the following formulae (141) and (142) are obtained by substituting the formulae (139) and (140) for the aforementioned formulae (134) and (135).

$$dYu = l_1\cdot d\theta + dX \quad (139)$$

$$dYl = -l_2\cdot d\theta + dX \quad (140)$$

$$d\rho u = l_1\cdot d\theta + dX - Uc\cdot dt\cdot\theta \quad (141)$$

$$d\rho l = -l_2\cdot d\theta + dX - Uc\cdot dt\cdot\theta \quad (142)$$

The following formulae (143) and (144) are determined by dividing the formulae (141) and (142) by dt.

$$d\rho u/dt = \dot{\epsilon}u = l_1\cdot d\theta/dt + dX/dt - Uc\cdot\theta \quad (143)$$

$$d\rho l/dt = \dot{\epsilon}l = -l_2\cdot d\theta/dt + dX/dt - Uc\cdot\theta \quad (144)$$

In these formulae, $d\rho u/dt=\dot{\epsilon}u$ and $d\rho l/dt=\dot{\epsilon}l$ represents the actual amounts of deformation per unit time, i.e., the deformation speeds. Also, d$\theta$/dt represents the amount of change in the inclination angle of the narrow face in unit time, i.e., the angular velocity. On the other hand, dX/dt represents the change in the horizontal displacement per unit time, i.e., the horizontal moving velocity Vh.

The strain in the slab can be determined by dividing the amount of slab deformation by the deformed length, i.e., by a half of the billet width. Thus, the strain rates $\dot{\epsilon}$ can be obtained as the following formula (145) and (146) by dividing the formulae (143) and (144) by a half W of the slab width 2W.

$$\dot{\epsilon}u = l_1\cdot\omega/W + Vh/W - Uc\cdot\theta/W \quad (145)$$

$$\dot{\epsilon}l = -l_2\cdot\omega/W + Vh/W - Uc\cdot\theta/W \quad (146)$$

In order to eliminate any change in the strain speed in relation to time, i.e., to maintain an adequate level of the deformation of the slab, it is necessary that the conditions of $[d\dot{\epsilon}u/dt=0]$ and $[d\dot{\epsilon}l/dt=0]$ are met. To this end, it is necessary that the following formulae (147) and (148) are satisfied.

$$d\dot{\epsilon}u/dt = (l_1/W)\cdot d\omega/dt + (1/W)\cdot dVh/dt - (Uc/W)\cdot\omega \equiv 0 \quad (147)$$

$$d\dot{\epsilon}l/dt = (-l_2/W)\cdot d\omega/dt + (1/W)\cdot dVh/dt - (Uc/W)\cdot\omega \equiv 0 \quad (148)$$

The following formula (149) is given by the formulae (147) and (148).

$$d\omega/dt = 0 \quad (149)$$

The following formula (150) is obtained by solving the formula (149), and the following formula (151) is obtained by substituting the formula (149) to the formulae (147) and (148).

$$\omega = M \tag{150}$$

where, M is an integration constant $$dVh/dt = Uc \cdot \omega \tag{151}$$

The right side of the formula (151) is constant in relation to time. Expressing this constant by $A_1$, the formula (151) is rewritten as the following formula (152).

$$dVh/dt = Uc \cdot \omega \equiv A_1 \tag{152}$$

The general solution of the formula (152) can be obtained as the following formula (153).

$$Vh = A_1 \cdot t + \gamma \tag{153}$$

where, $\gamma$ represents an integration constant

The following formula (154) is obtained from the formula (152).

$$\omega = A/Uc \tag{154}$$

It will be seen that, in order to keep the constant strain rate in relation to time thereby maintaining adequate deformation of the slab, it is necessary to select the horizontal moving velocity Vh as a linear function of the time t from the commencement of the width change, while maintaing the angular velocity $\omega$ at a constant level which is determined by the constant $A_1$ and the casting speed Uc.

With these knowledge, the inventions have made an intense study on the width changing in an actual continuous casting operation and found that these knowledges can be utilized in an industrial scale by selecting the constant $A_1$ of the formula (152) and (154) at a suitable value which is determined by using the allowable deformation resistance as a parameter.

The constant $A_1$ in the invention is a value other than zero, so that the horizontal moving velocity Vh is increased or decreased in relation to time. The constant $A_1$ for increasing or decreasing the horizontal moving velocity Vh is used in this specification as the acceleration $\alpha s$. The intergation constant $\gamma$ appearing in the formulae (152) and (154) are the initial value of the horizontal moving velocity Vh at the time of commencement of the width changing operation, and can be determined suitably in accordance with the width changing conditions, as well as the operating conditions. If the acceleration is given, the angular velocity $\omega$ is determined as follows from the casting speed Uc.

$$\omega = \alpha s/Uc \tag{4}$$

A description will be made hereinunder as to the practical way for changing the slab width.

As stated before, in order to maintain the stress in the slab at a constant level, it is necessary to maintain the acceleration $\alpha s$ of the horizontal moving velocity Vh and also the angular velocity $\omega$ constant. The angular velocity $\omega$ is determined from the acceleration $\alpha s$ and the casting speed Uc in accordance with the formula (4). Therefore, the angular velocity $\omega$ takes a positive value when $\alpha s$ is positive, so that the narrow face is inclined forwardly. Conversely, when the acceleration $\alpha s$ is negative, the angular velocity $\omega$ also takes a negative value and the narrow face is inclined rearwardly.

It is necessary that, at the end of the width changing operation, and initial inclination angle of the narrow face, i.e., the inclination angle in the state before the width changing operation, has been substantially recovered. Thus, a series of width changing operation requires at least one period in which the acceleration $\alpha s$ is positive and at least one period in which the acceleration $\alpha s$ is negative. Various width changing pattern are obtainable by varying the forms of combination of the periods having positive and negative accelerations $\alpha s$. Among these patterns, the pattern which is the simplest and which affords a high width changing speed is the pattern which includes one period having positive acceleration $\alpha s$ and one period having negative acceleration $\alpha s$ as shown in FIG. 35, i.e., the pattern which is composed of a forward taper changing period and a rearward taper changing period.

The horizontal moving velocity Vh and the angular velocity $\omega$ in the earlier half period and in the later half period are expressed as follows, with the suffixes 1 and 2 representing the earlier half period and later half period, respectively.

earlier half period $$Vh_1 = \alpha_{s1} \cdot t + \gamma_1 \tag{155}$$

$$\omega_1 = \alpha_{s1}/Uc \tag{156}$$

later half period $$Vh_2 = \alpha_{s2} \cdot (t - Tr_1) + \gamma_2 \tag{157}$$

$$\omega_2 = \alpha_{s2}/Uc \tag{158}$$

The strain rate in respective periods are determined as the following formulae (159) to (162), by substituting the formulae (155) to (156) to the formulae (144) and (145).

earlier half period $$\dot{\epsilon}u_1 = (l_1/W) \cdot (\alpha_{s1}/Uc) + \gamma_1/W \tag{159}$$

$$\dot{\epsilon}l_1 = (-l_2/W) \cdot (\alpha_{s1}/Uc) + \gamma_1/W \tag{160}$$

later half period $$\dot{\epsilon}u_2 = (l_1/W) \cdot (\alpha_{s2}/Uc) + \gamma_2/W - \alpha_{s1} \cdot Tr/W \tag{161}$$

$$\dot{\epsilon}l_2 = (-l_2/W) \cdot (\alpha_{s2}/Uc) + \gamma_2/W - \alpha_{s1} \cdot Tr/W \tag{162}$$

When the strain speed $\epsilon$ is negative, an air gap is formed between the narrow face and the slab. When the strain rate is increased beyond a critical value, troubles are encountered such as a drastic in the narrow face driving device, buckling of the slab and so forth. Thus, the strain rate determined by the formulae (159) to (162) are required to meet the following condition.

$$0 \leqq \dot{\epsilon}ij \leqq \dot{\epsilon} \max i \tag{163}$$

where, i: upper end u or lower end l of narrow face j: earlier or later half period of width changing operation The following formulae (164) to (167) are established by substituting the formula (163) to the formulae (159) to (162).

$$0 \leqq (l_1/W) \cdot (\alpha_{s1}/Uc) + \gamma_1/W \leqq \dot{\epsilon} \max u \tag{164}$$

$$0 \leqq (-l_2/W) \cdot (\alpha_{s1}/Uc) + \gamma_1/W \leqq \dot{\epsilon} \max l \tag{165}$$

$$0 \leqq (l_1/W)\cdot(\alpha_{s2}/Uc)+\gamma_2/W-\alpha_{s1}\cdot Tr/W \leqq \dot{\epsilon}\ \max U \quad (166)$$

$$0 \leqq (-l_2/W)\cdot(\alpha_{s2}/Uc)+\gamma_2/W-\alpha_{s1}\cdot Tr/W \leqq \dot{\epsilon}\ \max l \quad (167)$$

correlations for satisfying the above-mentioned formae and, hence, for maintaining stable casting, are summarized as follows:

$$\gamma_1 \geqq -l_1\cdot(\alpha_{s1}/Uc) \quad (i)$$

$$\gamma_1 \leqq -l_1\cdot(\alpha_{s1}/Uc)+W\cdot\dot{\epsilon}\ \max u \quad (j)$$

$$\gamma_1 \geqq l_2\cdot(\alpha_{s1}/Uc) \quad (k)$$

$$\gamma_1 \leqq l_2\cdot(\alpha_{s1}/Uc)+W\cdot\dot{\epsilon}\ \max l \quad (l)$$

$$\gamma_2 > \alpha_{s1}\cdot Tr-l_1\cdot(\alpha_{s2}/Uc) \quad (m)$$

$$\gamma_2 \leqq -l_1\cdot(\alpha_{s2}/Uc)+\alpha_{s1}\cdot Tr+W\cdot\dot{\epsilon}\ \max u \quad (n)$$

$$\gamma_2 > \alpha_{s1}\cdot Tr+\alpha_2\cdot(\alpha_{s2}/Uc) \quad (o)$$

$$\gamma_2 \leqq l_2\cdot(\alpha_{s2}/Uc)+\alpha_{s1}\cdot Tr+W\cdot\dot{\epsilon}\ \max l \quad (p)$$

Figure 37A:
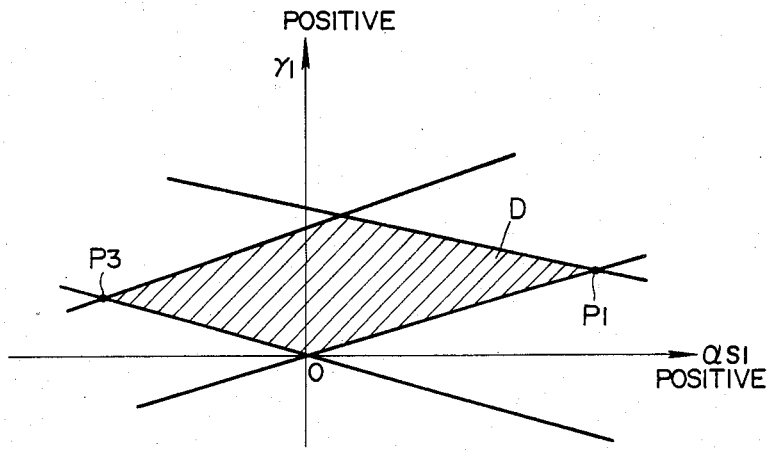
FIGS. 37A and 37B are diagrams showing the ranges of acceleration $\alpha$s and initial velocity $\Theta$ of the narrow face.
Figure 37B:
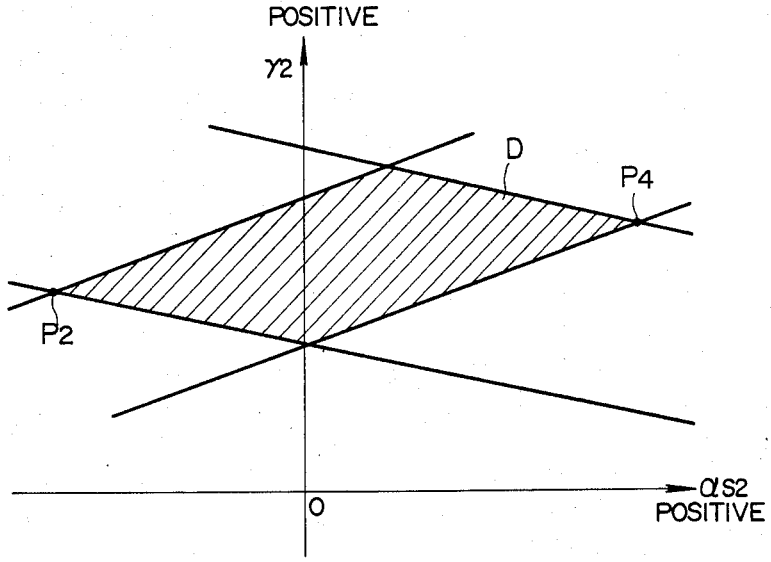

FIGS. 37A and 37B shows the correlations (i) to (p) for the earlier and later half periods of operation, respectively. In these Figures, the axes of abscissa represent accelerations $\alpha_{s1}$ and $\alpha_{s2}$ while axes of coordinate represent initial velocities $\gamma_1$ and $\gamma_2$. The width changing method of the invention can be successfully carried out by selecting suitable values of accelerations $\alpha_{s1}$ and $\alpha_{s2}$ and initial velocities $\gamma_1$ and $\gamma_2$ such as to fall within the hatched areas.

As stated before, the width changing operation has to be finished in shorter time as possible, and the accelerations $\alpha_s$ has to be determined within the hatched area such as to meet this requirement. Thus, in the earlier half period of decremental width changing operation, the acceleration $\alpha_s$ has to be positive and should have a value which is as large as possible. This means that the optimum acceleration value represented by $P_1$ shown in FIG. 37A is optimum. Conversely, in the earlier half period of incremental width changing operation, the acceleration $\alpha$ should be a negative value and has an absolute value which is as large as possible. Thus, the point $P_3$ is optimum.

In the later half period of the width changing operation, the control has to be made such that the inclination of the narrow face which has been changed in the earlier half period has to be reset to the initial value. This requirement is expressed by the following formula.

$$\omega_1\cdot Tr=-\omega_2\cdot(Tw-Tr) \quad (168)$$

Since the conditions $\omega_1=\alpha_{s1}/Uc$ and $\omega_2=\alpha_{s2}/Uc$ are met, the following relationship is established.

$$Tw-Tr=-(\alpha_{s1}/\alpha_{s2})\cdot Tr \quad (169)$$

It will be seen that the absolute value of the acceleration $\alpha_{s2}$ is selected to be as large as possible, in order to minimize the width changing time. Thus, the point $P_2$ shown in FIG. 37B and the point $P_4$ shown in FIG. 37A provide the optimum conditions for the decremental width changing operation and incremental width changing operation, respectively.

The acceleration $\alpha_s$ for minimizing the width changing time can be obtained in accordance with the conditions explained hereinabove. These conditions are shown in Table 8 below.

TABLE 8

| | Decremental width change | Incremental width change |
|---|---|---|
| $\alpha s_1$ | $[Uc \cdot W/(l_1 + l_2)] \times \dot{\epsilon}$ max u | $-[Uc \cdot W/(l_1 + l_2)] \times \dot{\epsilon}$ max u |
| $\alpha s_2$ | $-[Uc \cdot W/(l_1 + l_2)] \cdot \dot{\epsilon}$ max u | $[Uc \cdot W/(l_1 + l_2)] \times \dot{\epsilon}$ max u |
| $\gamma_1$ | $l_2 \cdot \alpha s_1/Uc$ | $-l_1 \cdot \alpha s_1/Uc$ |
| $\gamma_2$ | $\alpha s_1\ Tr - l_1 \cdot \alpha s_2/Uc$ | $\alpha s_1 \cdot Tr + l_2 \cdot \alpha s_2/Uc$ |

TABLE 9

| | Earlier half period | Later half period |
|---|---|---|
| Vh | $\alpha s_1 \cdot t + l_2 \cdot \alpha s_1/Uc$ | $\alpha s_2(t - Tr) + \alpha s_1 \cdot Tr - l_1 \cdot \alpha s_2/Uc$ |
| $\omega$ | $\alpha s_1/Uc$ | $\alpha s_2/Uc$ |

TABLE 10

| | Earlier half period | Later half period |
|---|---|---|
| Vh | $\alpha s_1 \cdot t - l_1 \cdot \alpha s_1/Uc$ | $\alpha s_2(t - Tr) + \alpha s_1 \cdot Tr + l_2 \cdot \alpha s_2/Uc$ |
| $\omega$ | $\alpha s_1/Uc$ | $\alpha s_2/Uc$ |

The horizontal moving velocities Vh and angular velocities $\omega$ which meet the conditions of Table 8 are shown in Tables 9 and 10.

As stated before, the shell thickness is smaller at the upper side of the narrow face than at the lower portion. This condition is expressed as follows.

$$\dot{\epsilon}\ \max u > \dot{\epsilon}\ \max l \quad (170)$$

From the view point of shell deformation resistance forces, the accelerations can be determined to meet the following conditions. These conditions are preferred for attaining higher width changing speed. In case of decremental width control $$|\alpha_{s1}| > |\alpha_{s2}| \quad (171)$$

In case of incremental width control $$|\alpha_{s1}| > |\alpha_{s2}| \quad (172)$$

In the event that $\alpha_1$ is not equal to $\alpha_2$, the control of change-over from the forward taper changing period to the rearward taper changing period, i.e., the control of the turning point, is made complicated. Therefore, when the easiness of control is a matter of significance, the accelerations should be selected to meet the conditions of $\alpha_{s1}=\alpha_{s2}$. Any way, the accelerations $\alpha_{s1}$ and $\alpha_{s2}$ can be selected freely from the ranges mentioned before, in accordance with the conditions of equipment and operation.

An explanation will be made hereinunder as to the practical way of determination of the acceleration $\alpha_s$.

As stated before, the acceleration $\alpha_s$ can be determined from the strain which is allowed for the shell deformation. However, when the method of the invention has to be carried out using an existing narrow face driving device or when there is a limit in the power of the narrow face driving device due to, for example, restriction of the installation space and facility, the acceleration $\alpha_s$ determined from the strain allowed for the shell may not be attained by the driving device. According to the invention, in such a case, the acceleration $\alpha_s$ can be determined such as to allow an efficient use of the narrow face driving device, within the range limited by the shell strength.

The inventors have conducted experiments by using various values of the acceleration $\alpha_s$ and initial velocity $\gamma$, and found that the required total driving force F can be calculated in accordance with the following formula (173).

$$F=2\int^{1+2}\int^{H}G^{n}\cdot\dot{\epsilon}(E)^{n}dsdE \quad (173)$$

The value $\dot{\epsilon}(E)$ is determined by the following formula (174).

$$\epsilon(E)=\{(\dot{\epsilon}l-\dot{\epsilon}u)/(l_1+l_2)\}\cdot E+\dot{\epsilon}u \quad (174)$$

The values $\epsilon u$ and $\epsilon l$ are determined by the aforesaid formulae (159) to (162), provided that the accelerations $\alpha_{s1}$ and $\alpha_{s2}$, as well as the initial velocities $\gamma_1$ and $\gamma_2$ are given.

Also, the values H and G can be determined in accordance with the formulae (46) and (47).

Thus, the values $\dot{\epsilon}u$ and $\dot{\epsilon}l$ are determined in accordance with the formulae (159) to (162) while changing the acceleration $\alpha_s$ and the initial velocity $\gamma$, and substituting the thus obtained values $\dot{\epsilon}u$ and $\dot{\epsilon}l$ to the formula (174), thereby determining the total driving force F.

On the other hand, the force Fav produced by the narrow face driving device and capable of effectively contributing to the deformation of the slab is obtained by subtracting the static pressure force Fg of the molten steel and the sliding friction force $F\mu$ from the power Fa generated by the driving device, as shown in the following formula (175).

$$Fav=Fa-Fg-F\mu \quad (175)$$

Thus, the width changing pattern can be determined by setting the values of acceleration $\alpha_s$ and the initial velocity $\gamma$ such as to meet the condition of Fav > F, and determining the angular velocity $\omega$ in accordance with these values.

In the example shown in FIG. 35, the horizontal moving velocities at the upper and lower ends of the narrow face are increased as the time elapses, as in the case of the example shown in FIG. 1. When the horizontal moving velocity is limited by the restriction in the narrow face driving device, the required width changing amount may not be obtained by a single width changing operation. In this embodiment, this problem is solved by adopting a period of translational movement of the narrow face between the forward taper changing period (decremental width change) or rearward taper changing period (incremental width change) in the earlier half period and the rearward taper changing period (decremental width change) or forward taper changing period (incremental width change) in the later half period of the width changing operation.

From formulae (153) and (154), it is understood that the adequate deformation of the slab can be obtained throughout the width changing operation provided that the horizontal moving velocity Vh is a linear function of the time t and that the angular velocity $\omega$ is constant. It will be seen also that the conditions of the formulae (149) and (152) are met when the condition of $A_1=\alpha_s=0$ is satisfied in the formulae (153) and (154).

In this case, the angular velocity $\omega$ is determined as being zero by the formula (4), so that the narrow face is moved translationally. This suggests that the slab deformation can be maintained at a constant adequate value also when the narrow face is moved translationally.

Through an intense study, the present inventors have found that a width change can be effected in minimal time while avoiding generation of the casting defects by a method comprising: dividing the width changing period into a forward taper changing period and a rearward taper changing period; determining an acceleration $\alpha_s$ of the narrow face for each period by using the allowable shell deformation resistance as a parameter; determining the angular velocity of the rotary device in accordance with the following formula (4); and conducting a width changing operation while maintaining said acceleration $\alpha_s$ and said angular velocity constant; wherein the improvement comprises determining the maximum allowable horizontal moving velocity Vmax of said narrow face in accordance with the rolling conditions or requirements from the narrow face driving device; and, when the horizontal moving velocity has exceeded the velocity Vmax, effecting a translational movement of the narrow face, between the forward taper changing period and the rearward taper changing period, at a translational moving velocity Vp which falls within the range given by the following formulae (5) and (6), thereby effecting the width changing in minimal time while avoiding the generation of casting defect.

$$|Vmax|\geqq|Vp| \quad (5)$$

$$Vp\geqq\alpha_{s1}\cdot Tr_1 \quad (6)$$

where,

Vmax: maximum allowable horizontal moving velocity (mm/min)

Vp: velocity of translational movement (mm/min)

$\alpha_{s1}$: acceleration of horizontal moving velocities of narrow face in the forward taper changing operation or rearward taper changing operation in the earlier half period of width changing operation ($mm/min^2$)

$Tr_1$: time duration of forward taper changing period or rearward taper changing period in the earlier half part of width changing operation The limitation of the moving velocity Vh of the narrow face is atributable to restriction in the rolling condition or in the narrow face driving device as explained before. In order to maintain the tapering amount of the slab under a certain limit $\xi$ imposed by the rolling conditions, the maximum velocity Vmax has to meet the conditions of the following formulae (176) and (177) which correspond to the formulae (80) and (81).

$$\xi=Vh/Uc \quad (176)$$

$$Vmax=\xi\cdot Uc \quad (177)$$

Figure 38:
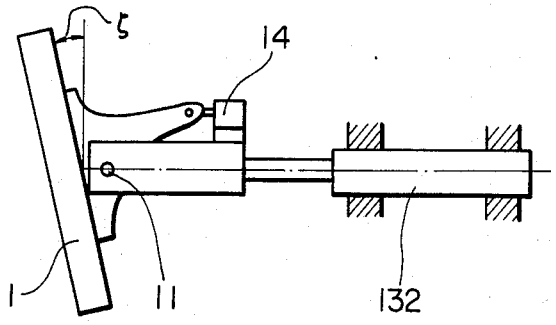
FIG. 38 shows an example of the narrow face driving means.

On the otherhand, the narrow face driving device shown in FIG. 38 has a limit in the rotation angle $\zeta$ of the bearing portion 11. This naturally limits the increase in the inclination angle $\beta$. In the width changing method explained in connection with FIG. 36, the inclination angle $\beta$ is increased or decreased as the time elapses, so that any limit in the inclination angle $\beta$ imposes a limitation also in the time duration of the forward taper changing period and the rearward taper changing period. In consequence, the moving velocity of the narrow face is limited undesirably.

More specifically, the restriction from the narrow face driving device can be sorted into two types: namely, a restriction from the angle $\zeta$ of rotation of the bearing portion and the restriction from the capacity of the driving device. In the width changing method shown in FIGS. 35A and 35B, the rotation angle $\zeta$ can be expressed in terms of tapering angle $\zeta$ as follows.

$$\zeta = \omega \cdot t \tag{178}$$

The horizontally moving velocity Vh in the earlier half period is given by the following formula (179).

$$Vh = \alpha_{s1} \cdot t + \gamma_1 \tag{179}$$

This formula can be rewritten as follows.

$$Vh = Uc \cdot \zeta + \gamma_1 \tag{180}$$

Thus, the maximum velocity Vmax can be determined by the following formula (181).

$$V\max = Uc \cdot \zeta\max + \gamma_1 \tag{181}$$

In the case where the limit is imposed by the capacity of the cylinder, the maximum velocity Vmax is the same as the maximum velocity for cylinder.

Figure 39A:
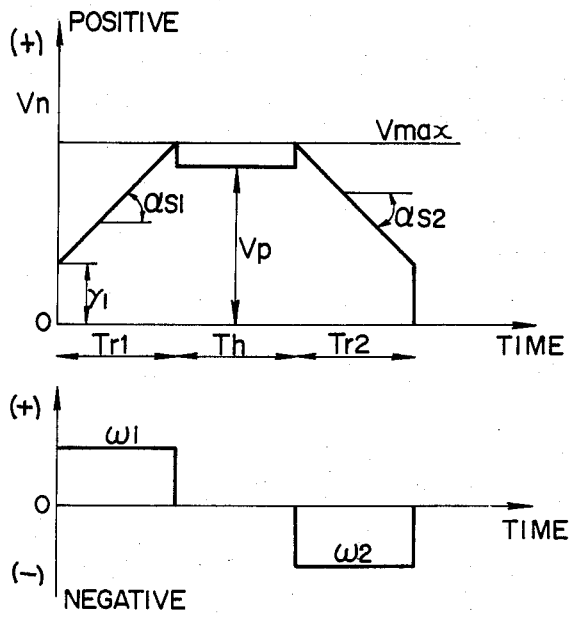
FIGS. 39A and 39B are diagrams explaining the horizontal moving velocity and angular velocity of the narrow face during the width changing operation in accordance with a still further embodiment of the invention.
Figure 39B:
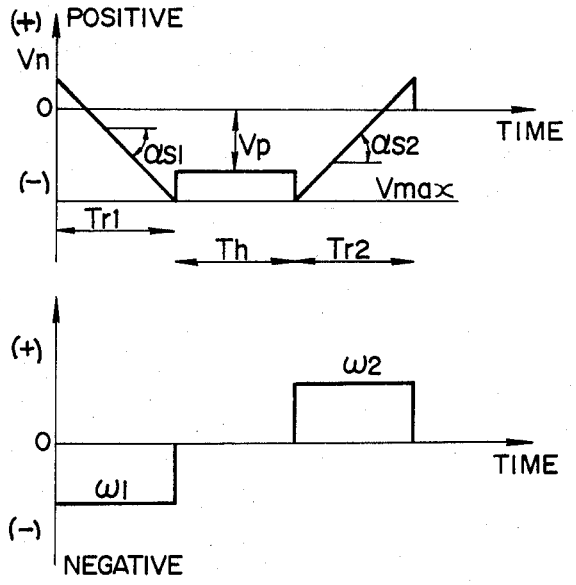

According to the invention, as explained before, the maximum moving velocity Vmax of the narrow face is set beforehand and, any problem which may be caused by the fact that the maximum velocity Vmax is exceeded by the horizontal moving velocity Vh is overcome by adopting a period of translational movement between the earlier half period and the later half period of the width changing operation. FIGS. 39A and 39B are diagrams explanatory of the horizontal moving velocity and the rotation speed of the narrow face in the width changing method explained above in decremental and incremental width changing operations, respectively. In the embodiment shown in these Figures, the pivot for the rotation of the narrow face is located substantially at the center of the narrow face i.e., the condition of $l_1 = l_2$ is substantially met.

In the case of the decremental width changing operation shown in FIG. 39A, the narrow face is moved towards the center of the mold. In the earlier half period, the narrow face is inclined forwardly towards the center of the mold until the horizontal moving velocity Vh of the narrow face reaches the maximum moving velocity Vmax. The forward taper changing operation in the earlier half period is effected by rotating the narrow face at a positive angular velocity $\omega$ while maintaining a constant acceleration $\alpha_s$. When the horizontal moving velocity reaches the maximum velocity Vmax, the rotary device is stopped and the translational movement is commenced in which the narrow face is moved translationally at a given velocity Vp. After elapse of the period of translational movement which is determined by the command width changing amount, the angular velocity is changed to the negative one $\omega$ such as to effect a rearward taper changing operation to incline the narrow face away from the mold center, thereby completing a series of width changing operation.

In the case of incremental width change, the narrow face is progressively moved away from the mold center. In the earlier half period, the narrow face is moved at horizontal velocity having a constant acceleration $\alpha_s$ while being rotated at a predetermined angular velocity $\omega$ in the negative direction such as to be inclined rearwardly. When the maximum velocity Vmax is reached, the translational movement is started in which the narrow face is moved translationally at the given velocity Vp. After elapse of a time Th for translational movement which is determined by the command width changing amount, the angular velocity is switched without delay to positive angular velocity such as to effect forward inclination of the narrow face. In this incremental width changing operation also, the horizontal moving velocity of the narrow face has the constant acceleration $\alpha_s$ such as to be increased and decreased in respective periods.

Thus, the maximum velocity Vmax is determined by either one or both of the rolling conditions and the conditions concerning the narrow face driving device. In the case of the width changing method shown in FIGS. 35A and 35B, the horizontal moving velocity Vh is maximized at the turning point Tr. The maximum horizontal moving velocity Vhmax is expressed by the following formula (182).

$$Vh\max = \alpha_{s1} \cdot Tr + \gamma_1 \tag{182}$$

According to this embodiment, when the Vhmax has been increased to the level of the maximum velocity Vmax, the translational movement is commenced by driving the narrow face translationally at a velocity which does not exceed the velocity Vmax.

The velocity Vp of the translational movement should be determined such as to eliminate generation of air gap and excessive deformation of the slab in the earlier half period of the width changing operation.

The strain rate in the slab in the period of translational movement is derived from the formulae (144) and (145) by the following formula (183) both for the upper and lower ends of the narrow face.

$$\dot{\epsilon}u = \dot{\epsilon}l = (Vp/W) - (Uc/W) \cdot \omega \cdot Tr \tag{183}$$

$$= (Vp - \alpha_{sl} \cdot Tr_1)$$

If the strain rates $\dot{\epsilon}u$ and $\dot{\epsilon}l$ are below zero, air gap is formed between the slab and the narrow face, resulting in casting defects. Therefore, it is necessary that both strain rates be maintained positive. This in turn requires the translational moving velocity Vp to meet the condition of the formula (183). At the same time, the translational moving velocity Vp has to meet the requirements imposed by the formulae (5) and (6), because it must be not higher than the velocity Vmax.

The limitation in the horizontal moving velocity of the narrow face explained before is to limit the absolute value of the velocity, so that the formula (5) has to have a sign representing the absolute value.

As will be understood from the foregoing description, according to the invention, it is possible to effect a width change under continuous casting, while satisfying one or both of the requirement from the rolling condition and the requirement from the narrow face driving device.

Figure 42A:
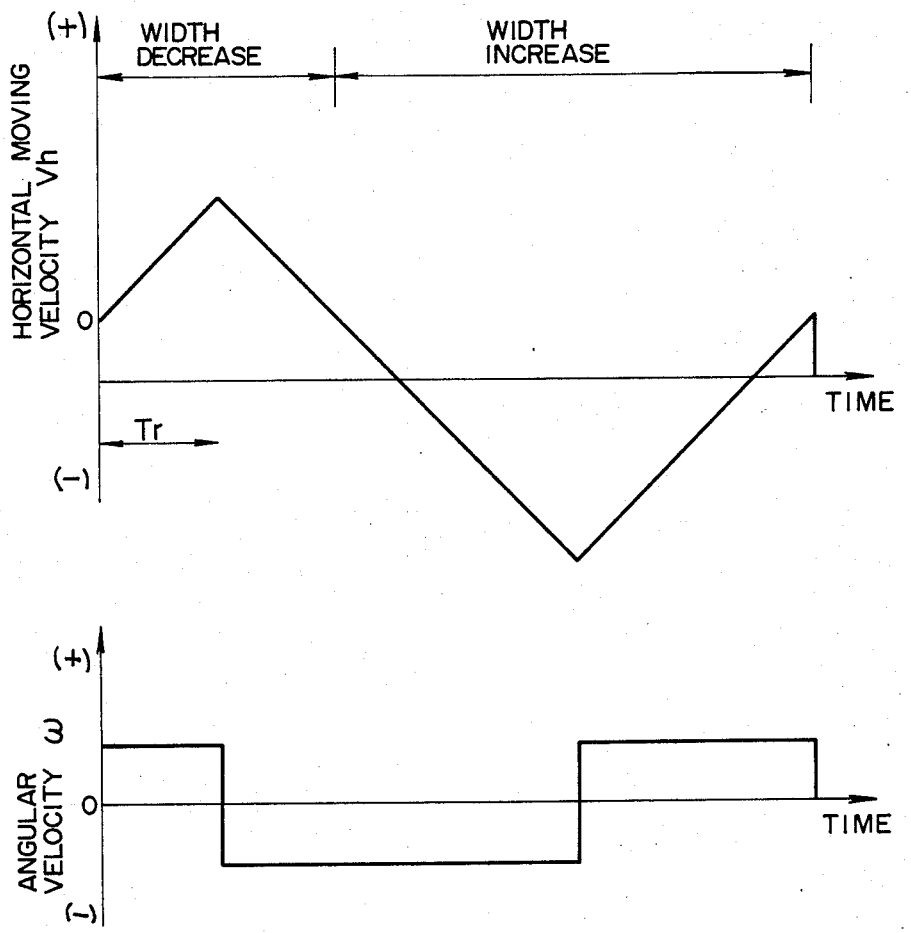
FIGS. 42A and 42B are diagrams illustrating the horizontal moving velocity and angular velocity for changing the slab width in production of the unit slab having restricted portions as shown in FIG. 20.
Figure 42B:
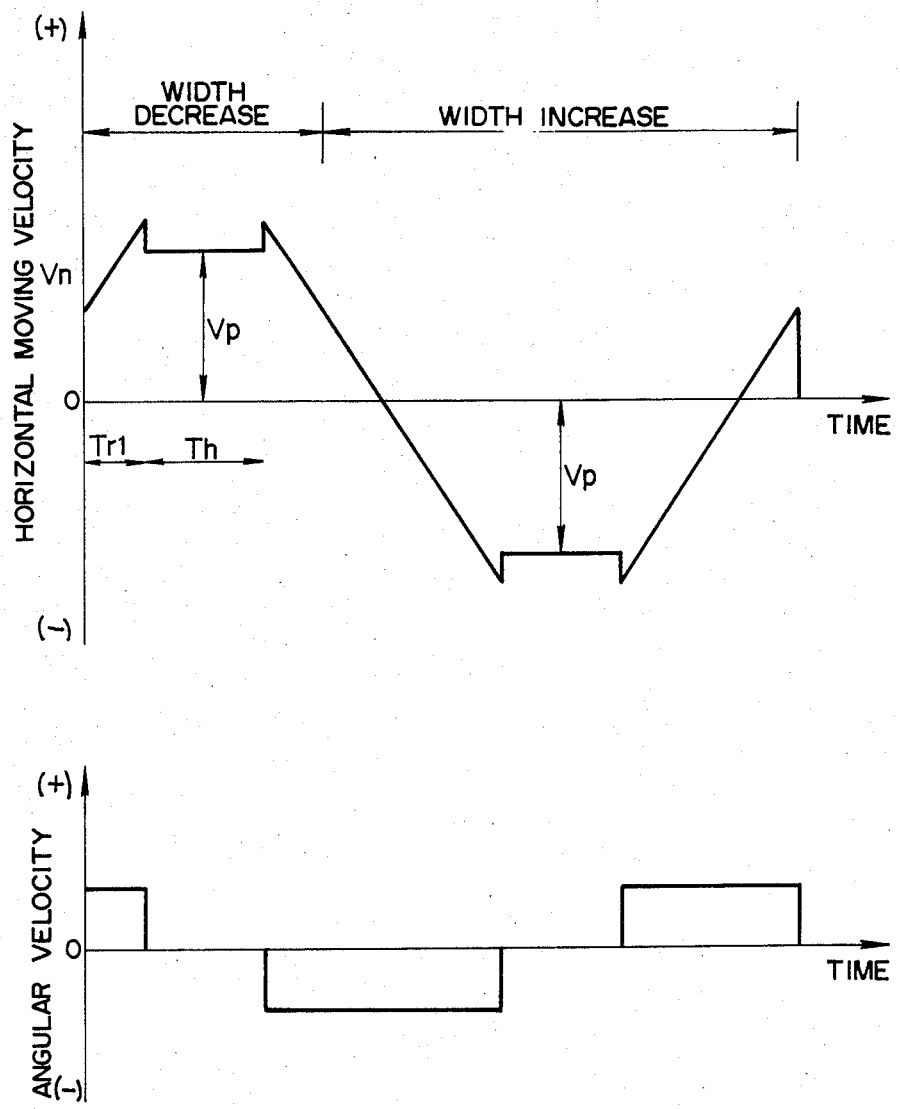

In the case where a rolling condition as explained in connection with FIG. 20 is demanded, such a demand can be met by effecting a decremental width changes at the end of the slab 4*b* and commencing an incremental width change at the leading end of the subsequent slab such as to form a restricted end, as will be seen from FIGS. 42A and 42B. The acceleration $\alpha$ and the velocity difference $\Delta V$ can be set in the same way as that explained before. The maximum velocity Vmax is determined by the tapering amount $\kappa$ at the retricted portion $4b_1$. Other factors such as $Tr_1$, Vp and Th may be set in the same way as that explained before.

As stated before, the angle of inclination of the narrow face in the steady continuous casting is determined by factors such as the slab width and casting speed. Therefore, when the width changed during continuous casting, the inclination angle $\beta$ of the narrow face is changed as a result of change in the slab width. This in turn requires the tapering amount $\kappa$ to be changed. If the change of the tapering amount is conducted after the completion of the width changing operation, it is necessary to take additional step for the correction of the actual narrow face taper, causing various problems as follows. Namely, the width changing control is made complicated and difficult and, since the casting is made with inadequate tapering amount in the period between the end of the width changing operation and the end of the tapering amount correcting operation, the risk of generation of casting defect and break out is increased undesirably. If the correction of the tapering amount is conducted in such a way as to move the upper and lower ends of the narrow face simultaneously, there is a risk of error in the slab width due to deviation of the actual width changing amount and the setting width changing amount.

It may be possible to finish the width changing operation when the command tapering amount has been reached in the rearward or forward taper changing operation in the later half period of the operation. Such a method, however, causes an error in the command slab width because the width changing operaion is finished before the command width changing amount is reached.

According to the invention, it is possible to obviate these problems. Namely, according to one form of the invention, the change of the tapering amount is conducted in the course of the width changing process such as to absorb any error from the command width changing amount which may be caused by a change in the tapering amount, by an intermediate translational movement between the forward taper changing period and rearward taper changing period.

The deviation $\Delta W$ of width from the command width changing amount is the error attributable to the difference between the tapering amount at the beginning of the width changing operation and the command tapering amount at the end of the command tapering amount. According to one form of the invention, the above-mentioned error is absorbed by a translational movement of narrow face which is conducted in the intermediate period between the forward taper changing period and the rearward taper changing period.

Figure 40:
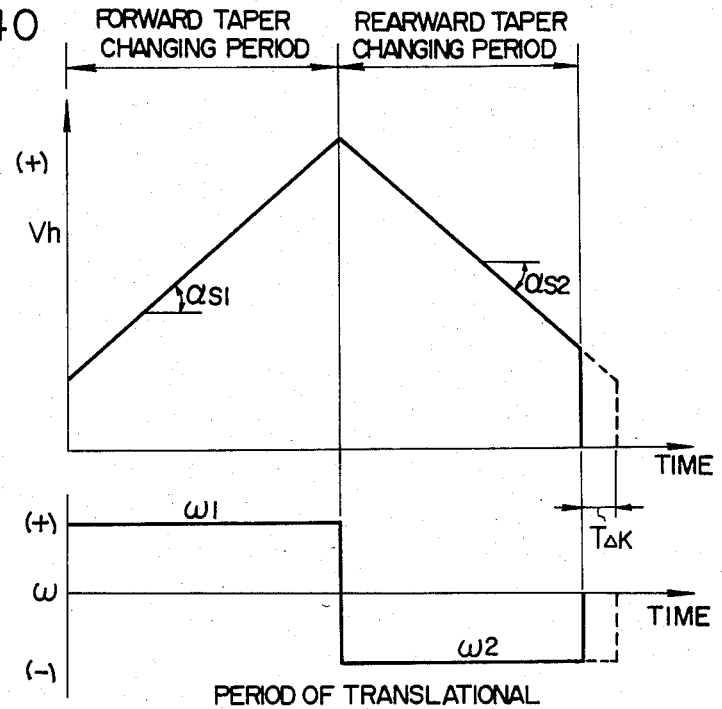
FIG. 40 is a diagram illustrating an error in the width changing amount attributed to a change in the amount of taper.

Due to a reason concerning the solidification shrinkage of the billet, the tapering amount is increased, i.e., the inclination angle $\beta$ is decreased, as the slab width become greater. Conversely, smaller slab width reduces the tapering amount and increases the inclination angle $\beta$. Therefore, when the slab width is decreased, the taper changing amount in the rearward taper changing period is smaller than that in the forward taper changing period. If the width changing operation is finished such that the actual tapering amount coincides with the command tapering amount, the width changing time is reduced by $T\Delta\kappa$ shown in FIG. 40, so that the actual width changing amount becomes smaller than the command width changing amount by $\Delta W$.

The taper changing amount in the rearward taper changing period is smaller than that in the forward taper changing period also in the incremental width changing operation. Thus, the width changing time is reduced by $T\Delta\kappa$ if the operation is finished in the state in which the actual tapering amount coincides with the command tapering amount. In consequence, the actual amount of width change is smaller than the command width changing amount by $\Delta W$.

Figure 41:
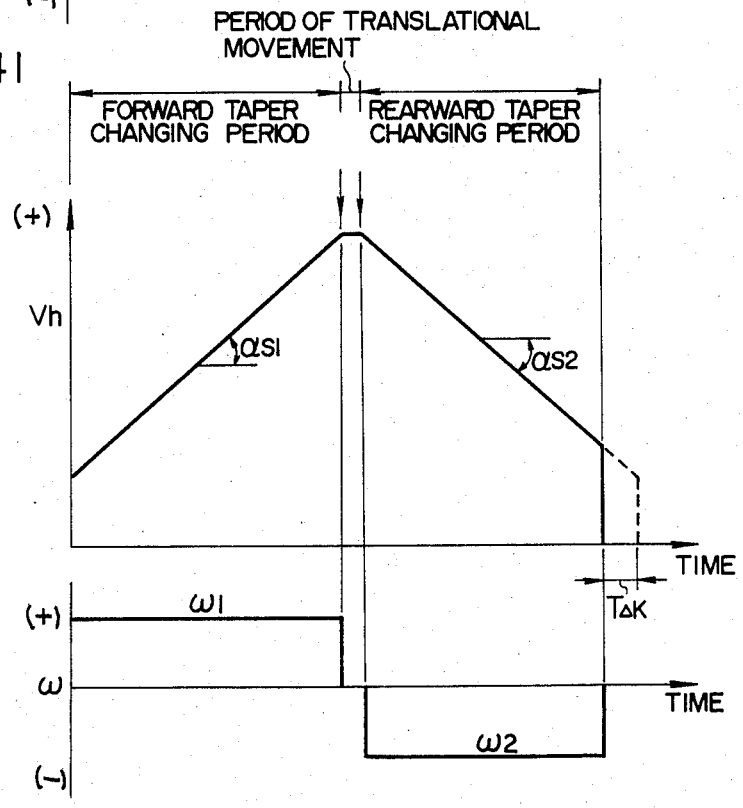
FIG. 41 is a diagram showing an example of a decremental width changing operation.

An example of practical controlling method for absorbing the above-mentioned error will be explained hereinunder with reference to a diagram shown in FIG. 41. In this case, it is assumed that the pivot for the rotation of the narrow face is located substantially at the center of the narrow face, i.e., the condition of $l_1 = l_2$ is met.

As the first step, the tapering amount $\kappa_1$ at the end of the forward tapering period and the slab width $W_2$ (half of the whole slab width) at the end of the translational movement period are determined.

Then, the forward taper changing operatin is commenced while maintaining constant acceleration $\alpha_s$ and angular velocity $\omega$ which have been determined beforehand. This forward taper changing operation is conducted until the tapering amount $\kappa_1$ is reached. When this tapering amount is reached, the rotary device is stopped without delay and the translational movement is commenced at a constant horizontal moving velocity Vh.

This translational movement is carried out until the width of the slab reaches the predetermined width $W_2$ mentioned above, and, immediately after this width is reached, the rearward tapering operation is commenced. The rearward taper changing operation is effected at a constant acceleration $\alpha_s$ which has the same absolute value as that in the forward taper changing operation but the direction is opposite to the same, i.e., the condition of $\alpha_{s1} = \alpha_{s2}$ is met. Thus, in the rearward tapering period, the acceleration $\alpha_s$ and the angular velocity $\omega$ are maintained constant at the same absolute values as those in the forward taper changing period but in the opposite direction to them. As a result of the rearward taper changing operation, the tapering amount is gradually reset to the initial tapering amount, i.e., the tapering amount attained before the start of the width changing operation. When the tapering amount has reached the command tapering amount $\kappa_2$, the width changing operation is completed.

As has been described, according to this embodiment, the tapering amount $\kappa_1$ at the end of the forward taper changing period and the slab width $W_2$ at the end of the translational moving period are suitably determined in such a manner as to compensate for any error in the slab width which may be caused by the difference $\Delta W$ mentioned before, so that the error from the command width changing amount can be effectively absorbed during the period of translational movement which is conducted between the forward taper changing period and the rearward taper changing period.

[Fifth Embodiment]

The invention was applied to the production of an ordinary low-carbon aluminum killed steel by a 350 t/h curved continuous casting machine. The narrow face driving device shown in FIG. 30 was used also in this case, while hydraulic cylinder devices were used for the driving device 13 and the rotary device 14. The specifications and the operating conditions of the narrow face driving device and the continuous casting machine are shown in Table 11 below.

TABLE 11

| | |
|---|---|
| casting speed (Uc) | 1600 mm/min |
| driving device cylinder capacity (Fa) | 16 tons |
| rotary device cylinder capacity | 5 tons |
| billet width (2W) | 1300–650 mm |
| static pressure of molten steel acting on narrow face (Fg) | 3 tons |
| sliding resistance (Fμ) | 3 tons |
| distance between portion corresponding to neniscus to rotary shaft ($l_1$) | 400 mm |
| distance between lower end of rotary shaft and lower end of narrow face ($l_2$) | 400 mm |

In order to minimize the time required for the width changing, the initial velocities $\gamma_1$ and $\gamma_2$ were selected as shown in Table 11.

On the other hand, the acceleration $\alpha_s$ was determined from the cylinder capacity beause the cylinder capacity was insufficient for providing the acceleration $\alpha_s$ determined from the shell strength.

From the formula (175), the effective cylinder capacity Fav was determined to be 16 tons−3 tons−3 tons=10 tons. At the same time, the values $Go=2.5\times10^{-12}\{(Kg/mm^2)^n\cdot sec\}$, n=0.32 and q=28,000 (1/°K.) were obtained through the result of a tensile test conducted for the steel used. At the same time, the shell thickness Ho was measured to be 20 ($mm/min^{\frac{1}{2}}$). While progressively changing the acceleration $\alpha_s$, the required driving force F was determined in accordance with the formula (173) to (174). In consequence, it proved that the acceleration $\alpha_s$ has to be maintained not greater than 50 $mm/min^2$, in order to maintain the required driving force F below 10 tons. In this embodiment, therefore, the acceleration $\alpha_s$ was selected to be 50 $mm/min^2$. Using this value of acceleration, the angular velocity $\omega$ was calculated as follows:

$$\omega=50\ mm/min^2/1600\ mm/min=0.03125\ (rad/min)$$

In addition, the accelerations were selected to meet the condition of $\alpha_{s1}=-\alpha_{s2}$.

With these values, the horizontal moving velocity Vh and the angular velocity $\omega$ were determined as follows for the decremental width changing operation.

Forward taper changing period in decremental width change ($0\leqq t\leqq Tr$)

$$Vh=50t+12.5\ (mm/min)$$

$$\omega=0.03125\ (rad/min)$$

Reward taper changing period in decremental width change ($Tr\leqq t\leqq Tw$)

$$Vh=-50t+100Tr+12.5\ (mm/min)$$

$$\omega=-0.03125\ (rad/min)$$

The timing Tr of the turning point is determined from the slab width changing amount at one side, in accordance with the following formula (184).

$$Tr=0.2\{(1.5625+S/2)^{\frac{1}{2}}-1.25\}\ (min) \quad (184)$$

A decremental width changing operation was conducted by determining the horiaontal moving velocity Vh and the angular velocity $\omega$ as explained before, effecting a forward taper changing operation until the half Tr of the width changing time, and effecting a rearward taper changing operation after the moment Tr. Table 12 shows the width changing time for the decremental width change by the method of the invention in comparison with that of the conventional method. The decremental width changing operation in accordance with the conventional method was conducted by using two cylinders, i.e., an upper cylinder and a lower cylinder as shown in FIG. 3, such that first be inclination angle is increased and then the translational movement is effected. In this case, the velocity of the translational movement could not be increased beyond 15 mm/min, in order to successfully decrease the slab width with required force of not greater than 10 tons and without allowing generation of large air gap.

TABLE 12

| width changing amount at one side of bilet (mm) | width changing method (min) | |
|---|---|---|
| | method of invention | conventional method |
| 50 | 1.6 | 3.3 |
| 100 | 2.4 | 6.7 |
| 150 | 3.0 | 10.0 |

From this Table, it will be seen that the method of the invention affords a remarkable shortening of the width changing time as compared with the conventional method, regardless of the amount of width reduction to be achieved. The time shortening effect of the method of the invention becomes more remarkable as the amount of reduction to be achieved becomes large.

Referring now to the case of incremental width changing operation, the horizontal moving velocity Vh, angular velocity $\omega$ and the timing Tr of the turning point were determined as follows in accordance with Table 10 and the formula (185) as in the case of the decremental width change.

Rearward taper changing period in incremental width change ($0\leqq t\leqq Tr$)

$$Vh=-50T+12.5\ (mm/min)$$

$$\omega=-0.03125\ (rad/min)$$

Forward taper changing period in incremental width change ($Tr\leqq t\leqq Tw$)

$$Vh=50t-100Tr+12.5\ (mm/min)$$

$$\omega=0.03125\ (rad/min)$$

$$Tr=0.2\{(1.5626+S/2)^{\frac{1}{2}}+1.25\}\ (min) \quad (185)$$

Table 13 shows the time required for the width changing operation in accordance with the method of the invention in comparison with that in a conventional method.

From this Table, it will be seen that the width changing time can be remarkably shortened also in the case of incremental width changing operation as compared with the conventional method, without occurrence any casting defect.

TABLE 13

| width changing amount (mm) | width changing time (min) method of invention | conventional method |
|---|---|---|
| 50 | 2.6 | 3.3 |
| 100 | 3.4 | 6.7 |
| 150 | 4.0 | 10.0 |

As has been described, in the embodiment of the invention, the operation for changing the width of a casting mold can be minimized so that the length of the region over which the width varies is decreased such as to remarkably improve the yield.

In addition, since the width can be varied as desired within the range of between 1300 and 650 mm. It is to be noted also that a stable casting operation can be conducted without any risk of cracking and break out, because the amount of the air gap and the shell deformation resistance are kept below limit values throughout the period of width changing operation.

what is claimed is:

1. A width changing method under continuous casting by moving narrow faces of a continuous casting mold, said method including at least one forward taper changing period in which each narrow face is progressively inclined towards the center of said casting mold and at least one rearward taper changing period in which each narrow face is progressively inclined away from the mold center, comprising: determining an acceleration $\alpha$ of horizontal moving velocity of the upper and lower ends of said narrow face by using an allowable shell deformation resistance as a parameter; determining a velocity difference $\Delta V$ between the upper and lower ends of each narrow face in accordance with the following formula 1; and maintaining said acceleration and said velocity difference constant in each of said periods:

$$\Delta V = \alpha \cdot L / Uc \quad (1)$$

where, $\Delta V$: velocity difference between upper and lower ends of narrow face (mm/min), $\alpha$: acceleration of upper and lower ends of narrow face (mm/min$^2$), L: length of narrow face (mm), and Uc: casting speed (mm/min).

2. A width changing method according to claim 1, wherein the width changing operation is conducted by setting the initial velocity of the lower end of said each narrow face at zero when a decremental width change is commenced.

3. A width changing method according to claim 1, wherein the width changing operation is conducted by setting the initial velocity of the upper end of said each narrow face at zero when an incremental width change is commenced.

4. A width changing method according to any one of claims 1 to 3, comprising: determining the maximum allowable horizontal moving velocity Vmax for said narrow face in accordance with rolling conditions and/or restrictions imposed by the narrow face driving device; effecting, when the horizontal moving velocity of said upper end of narrow face has exceeded said maximum allowable horizontal moving velocity Vmax in the earlier half period of width changing operation in which forward taper changing operation is carried out in case of a decremental width change and a rearward taper changing operation is conducted in case of an incremental width change, a translational movement of said narrow face at a translational moving velocity Vp which falls within the range given by the following formulae (2) and (3), thereby effecting the width changing in minimal time while avoiding the generation of casting defect, $$Vmax \geqq Vp \quad (2)$$

$$Vp \geqq \alpha_1 Tr_1 \quad (3)$$

where,

Vmax: maximum allowable horizontal moving velocity (mm/min), $\alpha_1$: acceleration of horizontal moving velocity of upper and lower ends of narrow face in earlier half period of width changing operation (mm/min$^2$), $Tr_1$: time duration of forward taper changing period or rearward taper changing period in the earlier half part of width changing operation (min), and Vp: velocity of translational movement (mm/min).

5. A width changing method according to claim 1, wherein an error from the command width changing amount attributable to the difference between the tapering amount at the time of commencement of the width changing operation and the command tapering amount at the time of completion of the width changing operation is absorbed in a period of translational movement which is conducted between the forward taper changing period and the rearward taper changing period in case of a decremental width changing operation and between the rearward taper changing period and the forward taper changing period in case of an incremental width changing operation.

6. A width changing method in which the width of a slab under casting is changed by movement of a narrow face of a continuous casting mold by the operation of a horizontal driving device and a rotary driving device operable independently of said horizontal driving device, said method comprising: dividing the period of width changing operation into a forward taper changing period and a rearward taper changing period, determining, by means of allowable shell deformation resistance as a parameter, the acceleration $\alpha_s$ of horizontal moving velocity of said narrow face in each period, determining the angular velocity $\omega$ of said rotary device in accordance with the following formula (4), and conducting the width changing operation while maintaining said acceleration $\alpha_s$ and said anguar velocity $\omega$ at constant levels in respective periods;

$$\omega = \alpha s / Uc \quad (4)$$

where, $\omega$: angular velocity of rotary device (rad/min), $\alpha_s$: acceleration of horizontal moving velocity, of narrow face (mm/min$^2$), and Uc: casting speed (mm/min).

7. A width changing method according to claim 6, comprising: determining the maximum allowable horizontal moving velocity Vmax for said narrow face in accordance with the rolling conditions and/or restrictions imposed by the narrow face driving device; effecting, when the horizontal moving velocity of said narrow face has reached said maximum allowable horizontal moving velocity Vmax in the earlier half period of width changing operation in which forward taper changing operation is carried out in case of a decremental width change and a rearward taper changing operation is conducted in case of an incremental width change, a translational movement of said narrow face at a translational moving velocity Vp which falls within the range given by the following formulae (5) and (6), thereby effecting the width changing in minimal time while avoiding the generation of casting defect;

$$|Vmax| \geqq |Vp| \quad (5)$$

$$Vp \geqq \alpha_{s1} \cdot Tr_1 \quad (6)$$

where,

Vmax: maximum allowable horizontal moving velocity (mm/min),

Vp: velocity of translational movement (mm/min), $\alpha_{s1}$: acceleration of horizontal moving velocities of narrow face in the forward taper changing operation or rearward taper changing operation in the earlier half period of width changing operation ($mm/min^2$), and $Tr_1$: time duration of forward taper changing period or rearward taper changing period in the earlier half part of width changing operation (min).

8. A width changing method according to claim 6 or 7, wherein an error from the command width changing amount attributable to the difference between the tapering amount at the time of commencement of the width changing operation and the command tapering amount at the time of completion of the width changing operation is absorbed in a period of translational movement which is conducted between the forward taper changing period and the rearward taper changing period in case of a decremental width changing operation and between the rearward taper changing period and the forward taper changing period in case of an incremental width changing operation.

* * * * *